US008509984B2

(12) United States Patent
Kidokoro et al.

(10) Patent No.: US 8,509,984 B2
(45) Date of Patent: Aug. 13, 2013

(54) MONITORING APPARATUS FOR A MULTI-CYLINDER INTERNAL COMBUSTION ENGINE

(75) Inventors: Toru Kidokoro, Hadano (JP); Hiroshi Sawada, Gotenba (JP); Yasushi Iwazaki, Ebina (JP); Fumihiko Nakamura, Susono (JP); Shuntaro Okazaki, Sunto-gun (JP); Masanori Ishida, Susono (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 252 days.

(21) Appl. No.: 13/146,323

(22) PCT Filed: Jan. 28, 2009

(86) PCT No.: PCT/JP2009/051813

§ 371 (c)(1),
(2), (4) Date: Jul. 26, 2011

(87) PCT Pub. No.: WO2010/087026

PCT Pub. Date: Aug. 5, 2010

(65) Prior Publication Data

US 2011/0282541 A1 Nov. 17, 2011

(51) Int. Cl.
*F02D 45/00* (2006.01)

(52) U.S. Cl.
USPC ..... 701/29.1; 701/104; 701/109; 73/114.72

(58) Field of Classification Search
None
See application file for complete search history.

(56) References Cited

U.S. PATENT DOCUMENTS

| | | | | |
|---|---|---|---|---|
| 4,707,985 | A | 11/1987 | Nagai et al. | |
| 5,168,701 | A * | 12/1992 | Yamamoto et al. | 60/274 |
| 5,528,899 | A * | 6/1996 | Ono | 60/276 |
| 8,122,869 | B2 * | 2/2012 | Fujiwara et al. | 123/434 |
| 2009/0037078 | A1 * | 2/2009 | Takagawa | 701/103 |

FOREIGN PATENT DOCUMENTS

| | | |
|---|---|---|
| JP | A-62-60957 | 3/1987 |
| JP | A-63-205441 | 8/1988 |
| JP | A-2000-220489 | 8/2000 |
| JP | A-2007-154840 | 6/2007 |
| JP | A-2009-13967 | 1/2009 |
| JP | A-2009-30455 | 2/2009 |
| WO | WO2008/044390 A1 * | 4/2008 |

OTHER PUBLICATIONS

U.S. Appl. No. 12/083,879, filed Apr. 21, 2008 in the name of Yusuke Suzuki.
U.S. Appl. No. 12/213,064, filed Jun. 13, 2008 in the name of Yusuke Suzuki et al.

(Continued)

*Primary Examiner* — Michael J Zanelli
(74) *Attorney, Agent, or Firm* — Oliff & Berridge, PLC

(57) ABSTRACT

A monitoring apparatus including a catalytic converter, an upstream air-fuel ratio sensor, and a downstream air-fuel ratio sensor; calculates a sub feedback amount to have an air-fuel ratio represented based on an output value of the downstream air-fuel ratio sensor coincide with a stoichiometric air-fuel ratio; and controls an fuel injection amount based on an output value of the upstream air-fuel ratio sensor and the sub feedback amount, in such a manner that an air-fuel ratio of a mixture supplied to an engine coincides with the stoichiometric air-fuel ratio.

15 Claims, 17 Drawing Sheets

(56) References Cited

OTHER PUBLICATIONS

U.S. Appl. No. 12/663,783, filed Dec. 9, 2009 in the name of Yasushi Iwazaki et al.

International Search Report mailed Apr. 28, 2009 issued in International Patent Application No. PCT/JP2009/051813 (with translation).

* cited by examiner

MONITORING APPARATUS FOR A MULTI-CYLINDER INTERNAL COMBUSTION ENGINE

TECHNICAL FIELD

The present invention relates to "a monitoring apparatus for a multi-cylinder internal combustion engine", which is applied to the multi-cylinder internal combustion engine, and which can determine (or monitor, detect) whether or not "an abnormal state of the engine" is occurring, the abnormal state being, for example, a state in which "an imbalance among each of air-fuel ratios of each of air-fuel mixtures supplied to each of cylinders (i.e., an air-fuel ratio imbalance among cylinders) is excessively large, etc.

BACKGROUND ART

Conventionally, an air-fuel ratio control apparatus has been widely known, which comprises a three-way catalytic converter disposed in an exhaust passage (exhaust gas passage) of an internal combustion engine, and an upstream air-fuel ratio sensor and a downstream air-fuel ratio sensor disposed, in the exhaust passage, upstream and downstream of the three-way catalytic converter, respectively. The air-fuel ratio control apparatus performs a feedback control on an air-fuel ratio (an air-fuel ratio of the engine) of a mixture supplied to the engine based on the output value of the upstream air-fuel ratio sensor and the output value of the downstream air-fuel ratio sensor in such a manner that the air-fuel ratio of the engine coincides with (becomes equal to) a stoichiometric air-fuel ratio.

This type of air-fuel ratio control apparatus controls the air-fuel ratio of the engine utilizing a control amount (an air-fuel ratio feedback amount) common to all of the cylinders. That is, the air-fuel ratio feedback control is performed in such a manner that an average (value) of the air-fuel ratio of the mixture supplied to the entire engine coincides with the stoichiometric air-fuel ratio.

For example, when a measured value or an estimated value of an intake air amount of the engine deviates from "a true intake air amount", each of the air-fuel ratios of each of the cylinders deviates from the stoichiometric air-fuel ratio toward "a rich side or a lean side" with respect to the stoichiometric air-fuel ratio without exception. In this case, the conventional air-fuel ratio control changes the air-fuel ratio of the air-fuel mixture supplied to the engine to "a leaner side or a richer side". Consequently, the air-fuel mixture supplied to each of the cylinders is adjusted so as to be in the vicinity of the stoichiometric air-fuel ratio. Accordingly, a combustion in each of the cylinders comes close to a perfect combustion (a combustion occurring when the air-fuel ratio of the mixture is equal to the stoichiometric air-fuel ratio), and an air-fuel ratio of an exhaust gas flowing into the three-way catalytic converter coincides with the stoichiometric air-fuel ratio or with an air-fuel ratio close to the stoichiometric air-fuel ratio. As a result, a deterioration of emission can be avoided.

Meanwhile, an electronic control fuel injection type internal combustion engine typically comprises one fuel injector in each of the cylinders or in each of intake ports, each communicating with each of the cylinders. Accordingly, when a property (characteristic) of the injector for a specific cylinder becomes "a property that the injector injects fuel in an amount larger (more excessive) than an instructed fuel injection amount", only an air-fuel ratio (air-fuel-ratio-of-the-specific-cylinder) of an air-fuel mixture supplied to the specific cylinder shifts to an extremely richer side. That is, a non-uniformity among air-fuel ratios of the cylinders (a variation in air-fuel ratios among the cylinders, air-fuel ratio imbalance among the cylinders) becomes high (prominent). In other words, there arises an imbalance among air-fuel ratios, each of which is an air-fuel ratio of a mixture supplied to each of a plurality of the cylinders (i.e., air-fuel ratios of individual cylinders).

In this case, the average of the air-fuel ratios of the mixtures supplied to the engine becomes an air-fuel ratio richer (smaller) than the stoichiometric air-fuel ratio. Accordingly, the feedback amount commonly used to all of the cylinders causes the air-fuel ratio of the specific cylinder to shift to a leaner (larger) air-fuel ratio so that the air-fuel ratio of the specific cylinder is made closer to the stoichiometric air-fuel ratio. However, the air-fuel ratio of the specific cylinder is still considerably richer (smaller) than the stoichiometric air-fuel ratio. Further, each of the air-fuel ratios of the other cylinders is caused to shift to a leaner (larger) air-fuel ratio so that the air-fuel ratios of the other cylinders are caused to deviate more from the stoichiometric air-fuel ratio. At this time, since the number of the other cylinders is larger than the number (which is one) of the specific cylinder, each of the air-fuel ratios of the other cylinders is caused to change to an air-fuel ratio slightly leaner (larger) than the stoichiometric air-fuel ratio. As a result, the average of the air-fuel ratios of the entire mixtures supplied to the engine is caused to become roughly equal to the stoichiometric air-fuel ratio.

However, the air-fuel ratio of the specific cylinder is still richer (smaller) than the stoichiometric air-fuel ratio, and the air-fuel ratios of the other cylinders are still leaner (larger) than the stoichiometric air-fuel ratio, and therefore, a combustion condition of the mixture in each of the cylinders is different from the perfect combustion condition. As a result, an amount of emissions (an amount of unburnt substances and/or an amount of nitrogen oxides) discharged from each of the cylinders increases. Accordingly, even though the average of the air-fuel ratios of the mixtures supplied to the engine coincides with the stoichiometric air-fuel ratio, the three-way catalytic converter may not be able to purify the increased emissions, and thus, there is a possibility that the emissions become worse. It is therefore important to detect whether or not the air-fuel ratio non-uniformity among cylinders becomes excessively large, since an appropriate measure can be taken in order not to worsen the emissions.

One of such conventional apparatuses (monitoring apparatuses) that determine "whether or not the non-uniformity of the air-fuel ratios among cylinders (the air-fuel ratio imbalance among cylinders, an imbalance among air-fuel ratios of individual cylinders) becomes excessively large" obtains an estimated air-fuel ratio representing each of the air-fuel ratios of each of the cylinders by analyzing an output of a single air-fuel ratio sensor disposed at an exhaust gas aggregated portion. The conventional apparatus determines whether or not "the non-uniformity of the air-fuel ratios among cylinders" becomes excessively large based on the estimated air-fuel ratio of each of the cylinders (refer to, for example, Japanese Patent Application Laid-Open (kokai) No. 2000-220489).

SUMMARY OF THE INVENTION

However, the conventional apparatus needs to detect, within a short time, the air-fuel ratio of the exhaust gas which varies in accordance with an engine rotation. This requires an air-fuel ratio sensor having an extremely high responsibility. Further, there arises a problem that the apparatus can not estimate the air-fuel ratio of each of the cylinders with high accuracy, when the air-fuel ratio sensor is deteriorated, because a responsibility of the deteriorated air-fuel ratio sensor is low. In addition, it is not easy to separate a noise from the variation in the air-fuel ratio. Furthermore, a high-speed data sampling technique and a high-performance CPU having a high processing ability are required. As described above, the conventional apparatus has a number of problems to be solved. Accordingly, "a monitoring apparatus of practical use" is required, which is capable of determining whether or not "the non-uniformity (imbalance) of the air-fuel ratios among the cylinders" becomes excessively large, with high accuracy (precision).

Meanwhile, a sub feedback amount is "an air-fuel ratio feedback amount (a correction amount of a fuel injection amount)" which makes an air-fuel ratio represented by the output value of the downstream air-fuel sensor coincide with the stoichiometric air-fuel ratio (a target downstream-side air-fuel ratio). An air-fuel ratio control utilizing the sub feedback amount is referred to as a sub feedback control.

When the sub feedback control continues to be carried out stably for a sufficiently long time, the sub feedback amount converges on (comes close to) "a convergent value". The convergent value corresponds to a steady-state component (e.g., an integral term) of the sub feedback control amount. In view of the above, the conventional apparatus calculates "a learning value of the sub feedback amount" reflecting the steady-state component of the sub feedback amount, and stores it in a memory. The conventional apparatus uses the stored learning value to control the air-fuel ratio of the engine, when the sub feedback control can not be performed.

After "the sub feedback control and update of the learning value of the sub feedback amount" are carried out stably for a sufficiently long time, the learning value of the sub feedback amount converges on (comes close to) a value corresponding to the convergent value of the sub feedback amount (i.e., it converges on a convergent value of the learning value). As described later in detail, the convergent value of the learning value reaches a value well reflecting "a degree of the air-fuel ratio imbalance among cylinders", "a misfiring rate", and so on. Accordingly, the monitoring apparatus for a multi-cylinder internal combustion engine of the present invention obtains a first parameter for abnormality determination based on the learning value of the sub feedback amount, and determines whether or not an abnormal state of the engine is occurring based on the first parameter.

Thus, it is necessary for the leaning value which is a basic data for the first parameter to be sufficiently close to the convergent value of the learning value, in order to make an accurate abnormality determination. Meanwhile, when the abnormality determination is delayed after a start of the engine, an emission may worsen. Accordingly, it is preferable that the abnormality determination be made as soon as possible after the start of the engine.

However, in a period immediately after the start of the engine, there may be a case where the learning value does not come closely enough to the convergent value, and therefore, if the first parameter is obtained in such a case, and the abnormality determination is made based on the first parameter, an erroneous determination may occurs. The present invention is made to solve the problem. That is, one of objects of the present invention is to provide "a monitoring apparatus for a multi-cylinder internal combustion engine" which makes an abnormality determination using "the first parameter for abnormality determination" calculated based on the sub feedback amount, and which can make the abnormality determination as early as possible and with high accuracy.

The monitoring apparatus according to the present invention is applied to a multi-cylinder internal combustion engine, and comprises:

a fuel injector for injecting fuel;

a catalytic converter (catalyst) disposed in an exhaust passage of the engine and at a position downstream of "an exhaust gas aggregated portion into which exhaust gases discharged from combustion chambers of a plurality of cylinders of the engine merge";

an upstream air-fuel ratio sensor, disposed at "the exhaust gas aggregated portion" or "the exhaust passage between the exhaust gas aggregated portion and the catalytic converter", and outputting "an output value corresponding to an air-fuel ratio of a gas flowing at a position at which the upstream air-fuel sensor is disposed";

a downstream air-fuel ratio sensor, disposed at a position downstream of the catalytic converter in the exhaust passage, and outputting "an output value corresponding to an air-fuel ratio of a gas flowing at a position at which the downstream air-fuel sensor is disposed";

sub feedback amount calculation means for calculating a sub feedback amount to make "an air-fuel ratio represented by the output value of the downstream air-fuel ratio sensor" coincide with "a stoichiometric air-fuel ratio" every time a first update timing arrives;

fuel injection control means for controlling "an injection amount of fuel injected from the fuel injector" every time a second update timing arrives based on at least "the output value of the upstream air-fuel ratio sensor" and "the sub feedback amount" in such a manner that "an air-fuel ratio of an air-fuel mixture supplied to the engine coincides with the stoichiometric air-fuel ratio";

learning means for changing "a learning value of the sub feedback amount" every time a third timing arrives in such a manner that "the learning value of the sub feedback amount" comes closer to "an amount corresponding to a steady-state component of the sub feedback amount"; and monitoring means for performing an abnormality determination as to "whether or not an abnormality state of the engine is occurring" based on "a first parameter for the abnormality determination" which varies in accordance with the learning value.

For example, the sub feedback amount is calculated according to a Proportional-Integral control or a Proportional-Integral-Derivative control so as to reduce an error (difference) between the air-fuel ratio represented by the output value of the downstream air-fuel ratio sensor and the stoichiometric air-fuel ratio. In this case, "a value corresponding to a time integral of the error" which is a basis for an integral term included in the sub feedback amount corresponds to the steady-state component of the sub feedback amount. Accordingly, the sub feedback amount may be "the value corresponding to a value of time integral of the error" itself. Also, since the learning value of the sub feedback amount may preferably be a value which is updated (or changed) so as to become equal to "the steady-state component of the sub feedback amount", the learning value of the sub feedback amount may be a smoothed value of the sub feedback amount with respect to time, the smoothed value being obtained by smoothing the sub feedback amount using, for example, a first order lag filter (low pass filter), and the like. Alternatively, the learning value of the sub feedback amount may be an average value with respect to time of the sub feedback amount, or the like.

Further, the monitoring apparatus comprises:

learning value changing speed setting means for setting a changing speed of the learning value at any one of a first changing speed, a second changing speed smaller than the first changing speed, and a third changing speed smaller than the second changing speed; and monitoring control means for allowing or prohibiting the monitoring means to perform "the abnormality determination" based on "the set changing speed of the learning value".

By the configuration described above, for example, based on a degree of convergence (convergence state) of the learning value, the changing speed of the learning value is set at (at least) any one of "the first changing speed, the second changing speed smaller than the first changing speed, and the third changing speed smaller than the second changing speed". Accordingly, a time needed for the learning value to come close to the convergent value can be shortened. This allows the abnormality determination based on "the first parameter varying depending on the learning value" to be performed at an early timing.

On the other hand, for example, in a case in which the changing speed of the learning value is set at "the relatively large first changing speed", when some sort of disturbance such as "a fuel cut control, an introduction of an evaporated fuel gas, a change in a valve overlap period, or the like" which varies the air-fuel ratio of the engine occurs, the learning value responds to the disturbance with a high responsibility (or perceptively), and therefore, may become a value greatly different from the convergent value. Further, when the learning value is changed rapidly, the learning value is likely to be a value which is not close to the convergent value.

In view of the above, the present monitoring apparatus performs or cancels the abnormality determination which is based on "the first parameter for abnormality determination varying depending on the learning value", in accordance with the changing speed of the learning value. Accordingly, "the learning value which is close to the convergent value and is stable" can be obtained at an early timing, and the first parameter can be obtained based only on such a stable leaning value. Consequently, the monitoring apparatus which can make the abnormality determination at an early timing and with high accuracy can be provided.

In the present monitoring apparatus for the engine, the learning value changing speed setting means may be configured in such a manner that it determines, based on a second parameter relating to the learning value (for example, a width of variation in the learning value for a predetermined period, an average of actual changing speed of the learning value for a predetermined period, or the like), which one of three states including:

(a) a stable state in which the learning value is in the vicinity of (close to) the convergent value and is stable;

(b) an unstable state in which the learning value greatly deviates from the convergent value and varies at a high speed (the changing rate is high); and (c) a quasi-stable state which is between the stable state and the unstable state is "a convergence state of the learning value" with respect to "the convergent value of the learning value".

In addition, the learning value changing speed setting means may be configured in such a manner that:

it sets the changing speed of the learning value at the first changing speed when the convergence state of the learning value is determined to be the unstable state;

it sets the changing speed of the learning value at the second changing speed when the convergence state of the learning value is determined to be the quasi-stable state; and it sets the changing speed of the learning value at the third changing speed when the convergence state of the learning value is determined to be the stable state.

According to the configuration above, the convergence state of the learning value with respect to "the convergent value" (in other words, a stability degree of the learning value) is determined (discriminated) to belong to any (which) one of the stable state, the unstable state, and the quasi-stable state. Further, the changing speed of the learning value is set according to the determined (discriminated) state. That is, when the convergence state of the learning value is in the unstable state, the changing speed of the learning value is set at "the first changing speed which is the highest changing speed", and therefore, the learning value can come close to (or approaches) the convergent value rapidly. Further, when the convergence state of the learning value is in the quasi-stable state, the changing speed of the learning value is set at "the second changing speed which is a medium changing speed", and therefore, the learning value can come close to (or approaches) the convergent value stably and at a relatively high speed. In addition, when the convergence state of the learning value is in the stable state, the changing speed of the learning value is set at "the third changing speed which is the smallest changing speed", and therefore, the learning value is stably maintained at a value in the vicinity of (close to) the convergent value. Accordingly, the learning value can be shifted to the value in the vicinity of (close to) the convergent value, and thereafter, stabilized.

In the monitoring apparatus, it is preferable that:

the monitoring control means be configured in such a manner that it allows the monitoring means to perform the abnormality determination, when the convergence state of the learning value is determined to be the stable state, or in a case where a time period in which "the convergence state of the learning value is determined to be the quasi-stable state" becomes equal to or longer than "a predetermined first threshold period".

When the convergence state of the learning value is determined to be the stable state, the learning value is in the vicinity of the convergent value, and therefore, the first parameter for abnormality determination varying depending on the learning value well reflects (corresponds to) the convergent value of the learning value. Accordingly, the abnormality determination is properly (accurately) made.

However, if the apparatus is configured so as to perform the abnormality determination only when the convergence state of the learning value is determined to be the stable state, there may be a case in which (performing) the abnormality determination is delayed. In view of this, the monitoring apparatus having the above configuration is configured in such a manner that, even when the convergence state of the learning value is determined to be the quasi-stable state, if the period in which the convergence state of the learning value is determined to be the quasi-stable state is equal to or longer than "the predetermined first threshold period", it performs the abnormality determination. This is because, if the period in which "the convergence state of the learning value is determined to be the quasi-stable state" is equal to or longer than "the predetermined first threshold period", it is considered (or inferred) that the learning value stably comes closer to the convergent value and is in the vicinity of the convergent value. Thus, the abnormality determination at an earlier timing can be performed by allowing to perform the abnormality determination in this case.

Further, in the monitoring apparatus, it is preferable that:

the learning value changing speed setting means be configured in such a manner that it obtains "a width of variation in the learning value in a predetermined state determination period" as "the second parameter relating to the learning value" every time the predetermined state determination period elapses, and it determines which one of the three states is "the convergence state of the learning value (e.g., it determines which "the convergence state of the learning value" corresponds to one of the three states), based on a comparison between "the obtained width of variation in the learning value" and "a predetermined threshold for determination"; and the monitoring control means be configured in such a manner that it allows the monitoring means to perform the abnormality determination, when the convergence state of the learning value is determined to be the stable state, or when the convergence state of the learning value is determined to be the quasi-stable state twice consecutively (in a row).

According to the configuration above, at a timing when the predetermined state determination period has elapsed, "the width of variation in the learning value" in the predetermined state determination period" which has just elapsed (i.e., in the predetermined state determination period just before the timing) is obtained as "the second parameter relating to the learning value" used when the convergence state of the learning value is determined. Thereafter, at the timing, the comparison between "the obtained width of variation in the learning value" and "the predetermined threshold for determination" is made to determine "which one of the three states is the convergence state of the learning value".

At the timing, the abnormality determination is allowed to be performed, not only "in a case in which it is determined that the convergence state of the learning value is the stable state", but also "in a case in which it is determined twice consecutively (in a row) that the convergence state of the learning value is the quasi-stable state". That is, performing the abnormality determination is allowed when it is determined that "the convergence state of the learning value is the quasi-stable state" at a first timing (current determination timing) when the predetermined state determination period has elapsed, and it was also determined that "the convergence state of the learning value was the quasi-stable state" at a second timing (previous determination timing) the (elapsed) predetermined state determination period before the first timing (i.e., it is determined that "the convergence state of the learning value is the quasi-stable state" at both of the current determination timing and the previous determination timing).

A case where the convergence state of the learning value is determined to be the quasi-stable state twice consecutively (in a row) is a case where a period in which "it is determined that the convergence state of the learning value is the quasi-stable state" becomes equal to or longer than "the predetermined state determination period". Thus, in this case, it is considered (or inferred) that the learning value stably comes closer to the convergent value and is in the vicinity of the convergent value. Accordingly, by performing the abnormality determination in this case, the abnormality determination can be performed at an earlier timing.

It is preferable that the learning value changing speed setting means be configured in such a manner that it determines whether or not "the width of variation in the learning value in the predetermined state determination period (the second parameter relating to the learning value)" is smaller than "a predetermined determination threshold for stable state serving as the threshold for determination", and when the width of variation in the learning value is determined to be smaller than the determination threshold for stable state, the learning value changing speed setting means determines that the convergence state of the learning value has changed from one of the three states to the other one of the three states such that the changing speed of the learning value is lowered "from the first changing speed to the second changing speed" or "from the second changing speed to the third changing speed".

According to the configuration above, at a timing when "the width of variation in the learning value in the predetermined state determination period" is determined to be smaller than "the predetermined determination threshold for stable state", if the convergence state of the learning value has been determined to be the unstable state at the timing (or at a timing before the timing); e.g., the changing speed of the learning value has been set at the first changing speed, the convergence state of the learning value is determined in such a manner that the changing speed of the learning value is lowered to the second changing speed (that is, it is determined that the convergence state of the learning value has changed into the quasi-stable state).

Further, at a timing when "the width of variation in the learning value in the predetermined state determination period" is determined to be smaller than "the predetermined determination threshold for stable state", if the convergence state of the learning value has been determined to be the quasi-stable state at the timing (or at a timing before the timing); i.e., the changing speed of the learning value has been set at the second changing speed, the convergence state of the learning value is determined in such a manner that the changing speed of the learning value is lowered to the third changing speed (that is, it is determined that the convergence state of the learning value has changed into the stable state).

It is also preferable that the learning value changing speed setting means be configured in such a manner that it determines whether or not "the width of variation in the learning value in the predetermined state determination period (the second parameter relating to the learning value)" is larger than "a predetermined determination threshold for unstable state serving as the threshold for determination", and when the width of variation in the learning value is determined to be larger than the determination threshold for unstable state, it determines that the convergence state of the learning value has changed from one of the three states to the other one of the three states such that the changing speed of the learning value is increased "from the third changing speed to the second changing speed" or "from the second changing speed to the first changing speed".

According to the configuration above, at a timing when "the width of variation in the learning value in the predetermined state determination period" is determined to be larger than "the predetermined determination threshold for unstable state", if the convergence state of the learning value has been determined to be the stable state at the timing (or at a timing before the timing); i.e., the changing speed of the learning value has been set at the third changing speed, the convergence state of the learning value is determined in such a manner that the changing speed of the learning value is increased to the second changing speed (that is, it is determined that the convergence state of the learning value has changed into the quasi-stable state).

Further, at a timing when "the width of variation in the learning value in the predetermined state determination period" is determined to be larger than "the predetermined determination threshold for unstable state", if the convergence state of the learning value has been determined to be the quasi-stable state at the timing (or at a timing before the timing); i.e., the changing speed of the learning value has been set at the second changing speed, the convergence state of the learning value is determined in such a manner that the changing speed of the learning value is increased to the first changing speed (that is, it is determined that the convergence state of the learning value has changed into the unstable state).

Further, it is preferable that the monitoring control means be configured in such a manner that it prohibits the monitoring means to perform the abnormality determination, in a case where the convergence state of the learning value is determined to be the unstable state, or in a case where a state in which the convergence state of the learning value is determined to be the stable state has changed into a state in which the convergence state of the learning value is determined to be the quasi-stable state.

It is likely that the learning value is not in the vicinity of the convergent value, when the convergence state of the learning value is determined to be the unstable state. Therefore, the first parameter for the abnormality determination varying depending on the learning value can not reflect (correspond to) the convergent value of the learning value properly (accurately). Accordingly, by prohibiting making the abnormality determination, it can be avoided that the erroneous determination occurs.

In addition, when the convergence state of the learning value has changed from "the state in which the convergence state of the learning value is determined to be the stable state" to "the state in which the convergence state of the learning value is determined to be the quasi-stable state", it is considered (inferred) that the convergence state of the learning value is changing "from the stable state to the unstable state" due to some sort of reason (for example, the convergent value has changed rapidly, or a disturbance has occurred which causes the air-fuel ratio to greatly fluctuate (vary) temporally). Accordingly, in such a case as well, by prohibiting making the abnormality determination, it can be avoided that the erroneous determination occurs.

Further, it is preferable that:

the learning value changing speed setting means be configured in such a manner that it obtains "a width of variation in the learning value in a predetermined state determination period" as "the second parameter relating to the learning value" every time the predetermined state determination period elapses, and it determines "which one of the three state is the convergence state of the learning value (i.e., it determines which the convergence state of the learning value corresponds to one of the three states), based on a comparison between "the width of variation in the learning value" and "a predetermined threshold for determination"; and the monitoring control means be configured in such a manner that it prohibits the monitoring means to perform the abnormality determination, in a case where the convergence state of the learning value is determined to be the unstable state, or in a case where a state in which the convergence state of the learning value is determined to be the stable state has changed into a state in which the convergence state of the learning value is determined to be the quasi-stable state.

According to the configuration above, at a timing when the predetermined state determination period has elapsed, "the width of variation in the learning value" in the predetermined state determination period" which has just elapsed (i.e., in the predetermined state determination period just before the timing) is obtained as "the second parameter relating to the learning value" used when the convergence state of the learning value is determined. Thereafter, at the timing, the comparison between "the obtained width of variation in the learning value" and "a predetermined threshold for determination" is made to determine "which one of the three states is the convergence state of the learning value". The threshold for determination here is preferably larger than the threshold for determination described before.

At the timing, the abnormality determination is prohibited to be performed, not only "in a case where it is determined that the convergence state of the learning value is the unstable state", but also "in a case where a state in which the convergence state of the learning value is determined to be the stable state has changed into a state in which the convergence state of the learning value is determined to be the quasi-stable state".

As described before, when the convergence state of the learning value has changed from "the state in which the convergence state of the learning value is determined to be the stable state" to "the state in which the convergence state of the learning value is determined to be the quasi-stable state", it is considered (inferred) that the convergence state of the learning value is changing "from the stable state to the unstable state" for some reason. Accordingly, in such a case as well, by prohibiting making the abnormality determination, it can be avoided that the erroneous determination occurs.

In this case as well, when it is determined that the width of variation in the learning value in the state determination period is smaller than the determination threshold for stable state, it is determined that the convergence state of the learning value has changed from "one of the three states to the other one of the three states" such that the changing speed of the learning value is decreased. Similarly, when it is determined that the width of variation in the learning value in the state determination period is larger than the determination threshold for unstable state, it is determined that the convergence state of the learning value has changed from "one of the three states to the other one of the three states" such that the changing speed of the learning value is increased.

It is preferable that the learning value changing speed setting means included in the monitoring apparatus for the internal combustion engine of the present invention be configured in such a manner that:

it stores, during the engine is operated, "a last (newest) determination result as to which one of the three states is the convergence state of the learning value" and "a last (newest) value of the learning value" into "memory means which can retain data while the engine is stopped"; and it sets "the changing speed of the learning value" based on "the determination result stored in the memory means" when the engine is started, and calculates "the sub feedback amount" based on "the last value of the learning value stored in the memory means".

A representative example of the memory means is a backup RAM. The backup RAM is supplied with an electric power from a battery mounted on a vehicle on which the engine is mounted regardless of a position of an ignition key switch of the vehicle. Data is stored in (written into) the backup RAM according to an instruction of a CPU while the electric power is supplied to the backup RAM, and the backup RAM holds (retains, stores) the data in such a manner that the data is readable. Another representative example of the memory means is a nonvolatile memory such as an EEPROM.

In this case, the learning value changing speed setting means is configured in such a manner that when the data in the memory means is eliminated (lost), it sets the convergence state of the learning value at the unstable state, and sets the learning value at a predetermined initial value.

According to the present invention, the changing speed of the learning value is changed (set) to at least one of the three changing speeds (rates), and thus, the learning value can be brought to the stable state within a short time when such a data-elimination occurred. As a result, the abnormality determination can be made at an early timing after the start of the engine after the data was eliminated.

It is preferable that the monitoring means included in the monitoring apparatus for the internal combustion engine of the present invention be configured in such a manner that it obtains the first parameter for abnormality determination based only on the learning value during a period in which "the monitoring control means allows to perform the abnormality determination".

According to the above configuration, the first parameter for abnormality determination is obtained based only on the learning value during the period in which the abnormality determination is being allowed to be performed. Therefore, data relating the learning value which have been obtained by "a timing at which the abnormality determination is changed to be allowed owing to a change in the convergence state of the learning value" are discarded when the abnormality determination is allowed. Accordingly, since the first parameter is obtained based on the learning value close to the convergent value, the abnormality determination can be performed with high accuracy.

In other words, it is preferable that the monitoring means be configured in such a manner that it does not reflect the learning value in the period in which the abnormality determination is prohibited to be performed by the monitoring control means on the first parameter for abnormality determination.

Meanwhile, when the data in the memory means is eliminated, it takes a considerable time for the convergence state of the learning value to change into "a state in which the abnormality determination is allowed" after the start of the engine. The convergence state of the learning value comes close to the stable state, after a timing at which "the number of update (renewal) of the learning value after the start of the engine" reaches "a predetermined number of learning update threshold".

On the other hand, in a case where the data in the memory means is not eliminated, in a case in which "the convergence state of the learning value" when the engine was stopped previously was, for example, the stable state, the abnormality determination is performed within a relatively short time after the current start of the engine. However, since there is a possibility that a state of the engine in the current operation has changed, it is preferable that the abnormality determination be performed after the timing at which the number of update (renewal) of the learning value after the start of the engine reaches "the predetermined number of learning update threshold".

In view of the above, it is preferable that the monitoring control means of the monitoring apparatus of the present invention be configured in such a manner that it obtains the number of update (renewal) of the learning value after the start of the engine; and "prohibits the monitoring means to perform the abnormality determination" during a period in which "the obtained number of update of the learning value" is smaller than "the predetermined number of learning update threshold". This allows the first parameter for abnormal determination to be obtained based on the learning value when the convergence state of the learning value is satisfactory, regardless of whether or not the data in the memory means is eliminated. Further, it is possible for a period from the start of the engine to a timing at which the abnormality determination is made to be a substantially constant time, regardless of whether or not the data in the memory means is eliminated.

Further, in the monitoring apparatus of the present invention, it is preferable that:

the fuel injection control means be configured so as to control an amount of fuel injected from the injector in such a manner that an air-fuel ratio represented by the output value of the upstream air-fuel ratio sensor coincides with the stoichiometric air-fuel ratio; and the monitoring means be configured in such a manner that it obtains a temporal average of the learning value in a period in which the monitoring control means allows to perform the abnormality determination, obtains the temporal average as the first parameter for abnormality determination, and determines that an air-fuel ratio imbalance among cylinder is occurring when the obtained first parameter is equal to or larger than the threshold for abnormality determination.

A case will next be described in which the monitoring apparatus of the present invention is used as a monitoring apparatus for an air-fuel ratio imbalance among cylinders.

In this case, the catalytic converter is a catalytic unit (catalyst) which oxidizes at least hydrogen among components included in an exhaust gas discharged from the engine. Therefore, the catalytic converter may be a three-way catalytic converter, an oxidation converter, or the like.

The upstream air-fuel ratio sensor includes a diffusion resistance layer with which an exhaust gas which has not passed through the catalytic converter contacts, and an air-fuel ratio detecting element which is covered with (by) the diffusion resistance layer and outputs an output value according to an air-fuel ratio of an exhaust gas which has reached the air-fuel ratio detecting element after passing through the diffusion resistance layer. The air-fuel ratio detecting element generally comprises a solid electrolyte layer, an exhaust-gas-side electrode layer, and an atmosphere-side electrode layer.

As described above, the fuel injection control means (which is also air-fuel ratio control means) performs the feedback control on an injection amount of fuel supplied to the engine in such a manner that the air-fuel ratio represented by the output value of the upstream air-fuel ratio sensor coincides with "the stoichiometric air-fuel ratio serving as a target upstream-side air-fuel ratio". Accordingly, if the air-fuel ratio represented by the output value of the upstream air-fuel ratio sensor coincides with a true average (true temporal average of the air-fuel ratio) of the air-fuel ratio of the air-fuel mixture supplied to the entire engine, the true average of the air-fuel ratio of the air-fuel mixture supplied to the entire engine coincides with the stoichiometric air-fuel ratio, without a correction by the sub feedback amount.

However, in practice, when the air-fuel ratio imbalance among cylinders becomes excessively large, the true average (true temporal average of the air-fuel ratio) of the air-fuel ratio of the air-fuel mixture supplied to the entire engine may sometimes be controlled to be an air-fuel ratio leaner than the stoichiometric air-fuel ratio serving as the target upstream-side air-fuel ratio. The reason for this will next be described.

The fuel supplied to the engine is a chemical compound of carbon and hydrogen. Accordingly, when the air-fuel ratio of the air-fuel mixture for the combustion is richer than the stoichiometric air-fuel ratio, "carbon hydride HC, carbon monoxide CO, and hydrogen $H_2$, and so on" are generated as intermediate products. A probability that the intermediate products meet and bind with oxygen greatly decreases during the combustion, as the air-fuel ratio of the mixture for the combustion deviates more from the stoichiometric air-fuel ratio in the richer side than the stoichiometric air-fuel ratio. As a result, an amount of the unburnt substances (HC, CO, and $H_2$) drastically (e.g., in a quadratic function fashion) increases as the air-fuel ratio of the mixture supplied to the cylinder becomes richer (refer to FIG. 8).

Here, it is assumed that only the air-fuel ratio of a specific cylinder greatly deviates to the richer side (becomes richer). This state occurs, for example, when the fuel injection property (characteristic) of the fuel injector provided for the specific cylinder becomes "the property that the injector injects the fuel in an amount considerably larger (more excessive) than the instructed fuel injection amount".

In the case described above, the air-fuel ratio (the air-fuel ratio of the specific cylinder) of the mixture supplied to the specific cylinder greatly changes (shifts) to a richer air-fuel ratio (smaller air-fuel ratio), compared with the air-fuel ratio (the air fuel ratio of the other cylinders) of the mixture supplied to the rest of the cylinders. That is, the air-fuel ratio imbalance among cylinders occurs. At this time, an extremely large amount of the unburnt substances (HC, CO, and $H_2$) are discharged from the specific cylinder.

In the mean time, hydrogen $H_2$ is a small molecule, compared with carbon hydride HC and carbon monoxide CO. Accordingly, hydrogen $H_2$ rapidly diffuses through the diffusion resistance layer of the upstream air-fuel ratio sensor, compared to the other unburnt substances (HC, CO). Therefore, when a large amount of the unburnt substances including HC, CO, and $H_2$ are generated, a preferential diffusion of hydrogen $H_2$ occurs in the diffusion resistance layer. That is, hydrogen $H_2$ reaches the surface of the air-fuel ratio detecting element in a larger amount compared with "the other unburnt substances (HC, CO)". As a result, a balance between a concentration of hydrogen $H_2$ and a concentration of the other unburnt substances (HC, CO) is lost. In other words, a fraction of hydrogen $H_2$ to all of the unburnt substances included in the exhaust gas reaching the air-fuel ratio detecting element of the upstream air-fuel ratio sensor becomes larger than a fraction of hydrogen $H_2$ to all of the unburnt substances included in the exhaust gas discharged from the engine.

This causes the air-fuel ratio represented by the output value of the upstream air-fuel ratio sensor to be richer than the true average of the air-fuel ratio of the mixture supplied to the entire engine (i.e. the true air-fuel ratio of the exhaust gas discharged from the engine) due to the preferential diffusion of hydrogen $H_2$.

For example, it is assumed that an air-fuel ratio A0/F0 is equal to the stoichiometric air-fuel ratio (e.g., 14.5), when the intake air amount (weight) introduced into each of the cylinders of the 4-cylinder engine is A0, and the fuel amount (weight) supplied to each of the cylinders is F0. Further, for convenience of description, it is assumed that the target upstream-side air-fuel ratio is equal to the stoichiometric air-fuel ratio.

Under these assumptions, it is further assumed that an amount of fuel supplied (injected) to each of the cylinders is uniformly excessive in 10%. That is, it is assumed that the fuel of 1.1·F0 is supplied to each of the cylinder. Here, a total amount of the intake air supplied to the four cylinders (an intake amount supplied to the entire engine during a period in which each and every cylinder completes one combustion stroke) is equal to 4·A0, and a total amount supplied to the four cylinders (a fuel amount supplied to the entire engine during the period in which each and every cylinder completes one combustion stroke) is equal to 4.4·F0 (=1.1·F0+1.1·F0+1.1·F0+1.1·F0). Accordingly, a true average of the air-fuel ratio of the mixture supplied to the entire engine is 4·A0/(4.4·F0)=A0/(1.1·F0). At this time, the output value of the upstream air-fuel ratio sensor becomes an output value corresponding to the air-fuel ratio A0/(1.1·F0). The air-fuel ratio of the mixture supplied to the entire engine therefore is caused to coincide with the stoichiometric air-fuel ratio which is the target upstream-side air-fuel ratio by the air-fuel ratio feedback control. In other words, the fuel amount supplied to each of the cylinders is decreased in 10% by the air-fuel ratio feedback control. That is, the fuel of 1·F0 is again supplied to each of the cylinders, and the air-fuel ratio of each of the cylinders coincides with the stoichiometric air fuel ratio A0/F0.

Next, it is assumed that an amount of fuel supplied to one certain specific cylinder is excessive in 40% (i.e., 1.4·F0), and an amount of fuel supplied to each of the other three cylinders is an appropriate amount (a fuel amount required to obtain the stoichiometric air-fuel ratio which is the target upstream-side air fuel ratio, here F0). Under this assumption, a total amount of the intake air supplied to the four cylinders is equal to 4·A0. A total amount of the fuel supplied to the four cylinders is equal to 4.4·F0 (=1.4·F0+F0+F0+F0). Accordingly, the true average of the air-fuel ratio of the mixture supplied to the entire engine is 4·A0/(4.4·F0)=A0/(1.1·F0). That is, the true average of the air-fuel ratio of the mixture supplied to the entire engine is the same as the value obtained "when the amount of fuel supplied to each of the cylinders is uniformly excessive in 10%" as described above.

However, as described above, the amount of the unburnt substances (HC, CO, and $H_2$) in the exhaust gas drastically increases as the air-fuel ratio of the mixture supplied to the cylinder becomes richer. Further, the exhaust gas into which the exhaust gases from the cylinders are mixed reaches the upstream air-fuel ratio sensor. Accordingly, "the amount of hydrogen $H_2$ included in the exhaust gas in the above described case in which only the amount of fuel supplied to the specific cylinder becomes excessive in 40%" is considerably greater than "the amount of hydrogen $H_2$ included in the exhaust gas in the case in which the amount of fuel supplied to each of the cylinders uniformly becomes excessive in 10%".

As a result, due to "the preferential diffusion of hydrogen $H_2$" described above, the air-fuel ratio represented by the output value of the upstream air-fuel ratio sensor becomes richer than "the true average (A0/(1.1·F0)) of the air-fuel ratio of the mixture supplied to the entire engine". That is, even when the average of the air-fuel ratio of the exhaust gas is the same richer air-fuel ratio, the concentration of hydrogen $H_2$ in the exhaust gas reaching the air-fuel ratio detecting element of the upstream air-fuel ratio sensor when the air-fuel ratio imbalance among cylinders is occurring becomes greater than when the air-fuel ratio imbalance among cylinders is not occurring. Accordingly, the output value of the upstream air-fuel ratio sensor becomes a value indicating an air-fuel ratio richer than the true average of the air-fuel ratio of the mixture.

Consequently, by the fuel injection amount feedback control based on the output value of the upstream air-fuel ratio sensor, the true average of the air-fuel ratio of the mixture supplied to the entire engine is caused to be leaner than the stoichiometric air-fuel ratio (the target upstream-side air-fuel ratio). This is the reason why the true average of the air-fuel ratio is controlled to be leaner when the non-uniformity of the air-fuel ratio among cylinders becomes excessive.

On the other hand, hydrogen $H_2$ included in the exhaust gas discharged from the engine is oxidized (purified) together with the other unburnt substances (HC, CO) in the catalytic converter. Further, the exhaust gas which has passed through the catalytic converter reaches the downstream air-fuel ratio sensor. Accordingly, the output value of the downstream air-fuel ratio sensor becomes a value corresponding to the average of the true air-fuel ratio of the mixture supplied to the engine. Therefore, when only the air-fuel ratio of the specific cylinder greatly deviates to the richer side, the output value of the downstream air-fuel ratio sensor becomes a value corresponding to the true air-fuel ratio which is excessively corrected so as to be the leaner side by the air-fuel ratio feedback control. That is, as the air-fuel ratio of the specific cylinder deviates to the richer side, "the true air-fuel ratio of the mixture supplied to the engine" is controlled to be leaner due to "the preferential diffusion of hydrogen $H_2$" and "the feedback control based on the output value of the upstream air-fuel ratio sensor", and the resultant appears in the output value of the downstream air-fuel ratio sensor. In other words, the output value of the downstream air-fuel ratio sensor varies depending upon a degree of the air-fuel ratio imbalance among cylinders.

In view of the above, the monitoring means (imbalance determining means) is configured so as to obtain "the first parameter for abnormality determination (imbalance determining parameter) based on "the learning value of the sub feedback amount" which is updated (changed) in such a manner that the leaning value becomes (comes close to) a value corresponding to the steady-state component of the sub feedback amount. The first parameter for abnormality determination is a value varying depending on "the true air-fuel ratio (an average air-fuel ratio) of the air-fuel mixture supplied to the entire engine" which varies due to the feedback control based on the output value of the upstream air-fuel ratio sensor. The first parameter for abnormality determination is also a value which increases as "a difference between an amount of hydrogen included in the exhaust gas which has not passed through the catalytic converter and an amount of hydrogen included in the exhaust gas which has passed through the catalytic converter" becomes larger.

Further, the monitoring means (the air-fuel ratio imbalance among cylinders determining means) is configured so as to determine that the imbalance is occurring among "the air-fuel ratios of each of the individual cylinders, each of the air-fuel ratios of each of the individual cylinders being an air-fuel ratio of the mixture supplied to each of the cylinder" (i.e., the air-fuel ratio imbalance among cylinders is occurring), when the obtained "first parameter for abnormality determination (imbalance determining parameter) is larger than "the abnormality determining threshold". As a result, the monitoring apparatus according to the present invention can determine whether or not the air-fuel ratio imbalance among cylinders is occurring with high accuracy.

DESCRIPTION OF THE BEST EMBODIMENT TO CARRY OUT THE INVENTION

An embodiment of monitoring apparatus (hereinafter, simply referred to as "a monitoring apparatus") for a multi-cylinder internal combustion engine according to the present invention will next be described with reference to the drawings. The monitoring apparatus is a portion of an air-fuel ratio control apparatus for controlling the air-fuel ratio of the internal combustion engine, an air-fuel ratio imbalance among cylinders determining apparatus, or a misfire detecting apparatus. Further, the air-fuel amount control apparatus is a fuel injection amount control apparatus for controlling a fuel injection amount.

(Structure)

Figure 1:
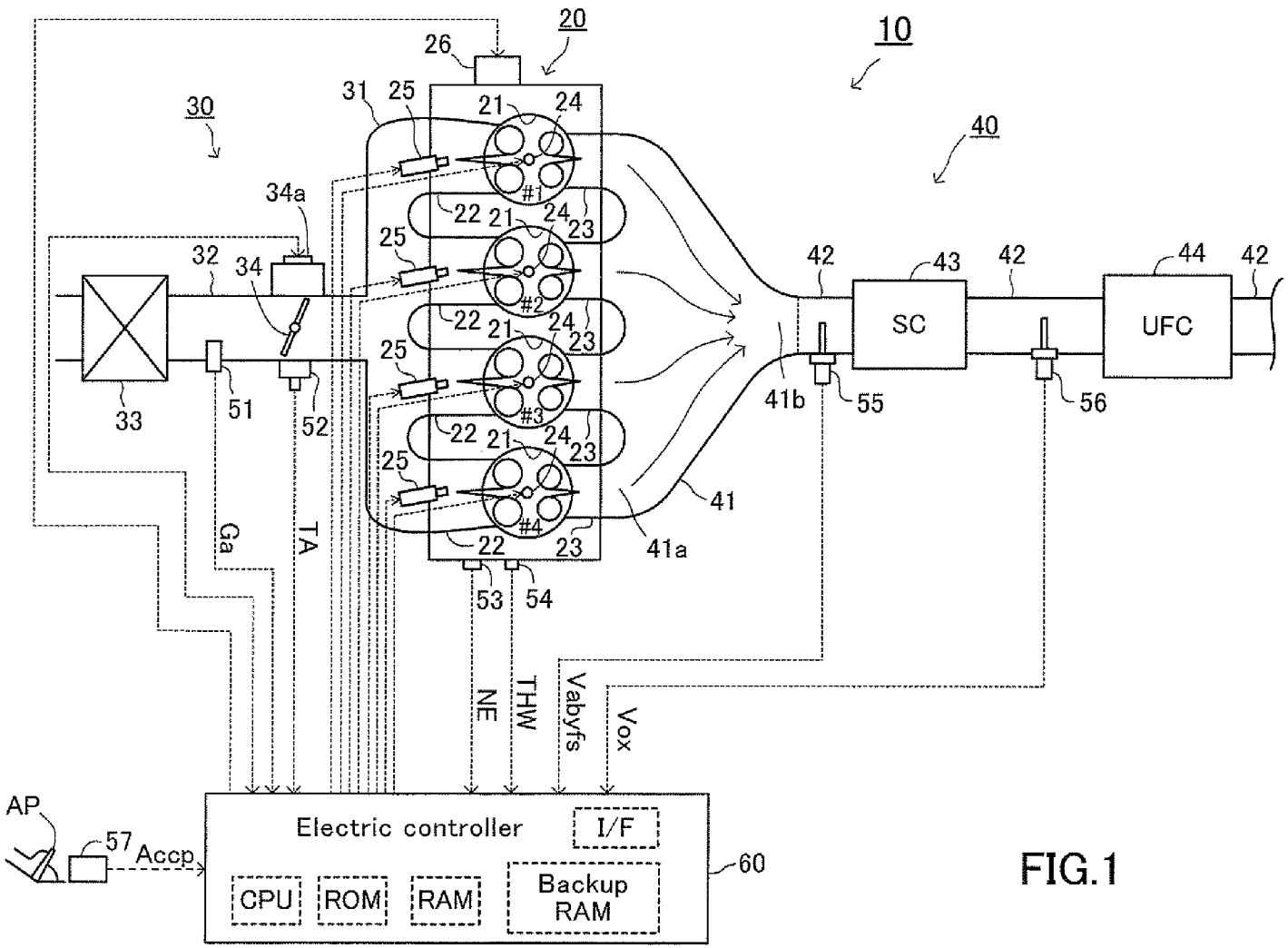
FIG. 1 is a schematic view of an internal combustion engine to which a monitoring apparatus according to an embodiment of the present invention is applied.

FIG. 1 schematically shows a configuration of an internal combustion engine 10 to which the monitoring apparatus is applied. The engine 10 is a 4 cycle, spark-ignition, multi-cylinder (in the present example, 4 cylinder), gasoline engine. The engine 10 includes a main body section 20, an intake system 30, and an exhaust system 40.

The main body section 20 comprises a cylinder block section and a cylinder head section. The main body section 20 includes a plurality (four) of combustion chambers (a first cylinder #1 to a fourth cylinder #4) 21, each being composed of an upper surface of a piston, a wall surface of the cylinder, and a lower surface of the cylinder head section.

In the cylinder head section, intake ports 22 each of which is for supplying "a mixture comprising an air and a fuel" to each of combustion chambers (each of the cylinders) 21 are formed, and exhaust ports 23 each of which is for discharging an exhaust gas (burnt gas) from each of the combustion chambers 21 are formed. Each of the intake ports 22 is opened and closed by an intake valve which is not shown, and each of the exhaust ports 23 is opened and closed by an exhaust valve which is not shown.

A plurality (four) of spark plugs 24 are fixed in the cylinder head section. Each of the spark plugs 24 are provided in such a manner that its spark generation portion is exposed at a center portion of each of the combustion chambers 21 and at a position close to the lower surface of the cylinder head section. Each of the spark plugs 24 is configured so as to generate a spark for an ignition from the spark generation portion in response to an ignition signal.

A plurality (four) of fuel injection valves (injectors) 25 are fixed in the cylinder head section. Each of the fuel injectors 25 is provided for each of the intake ports 22 one by one (e.g., one injector per one cylinder). Each of the fuel injectors 25 is configured so as to inject, in response to an injection instruction signal, "a fuel of an instructed injection amount included in the injection instruction signal" into a corresponding intake port 22, when the fuel injector 25 is normal. In this way, each of the plurality of the cylinders 21 comprises the fuel injector 25 for supplying the fuel independently from the other cylinders.

An intake valve control apparatus 26 is provided in the cylinder head section. The intake valve control apparatus 26 comprises a well known configuration for hydraulically adjusting a relative angle (phase angle) between an intake cam shaft (now shown) and intake cams (not shown). The intake valve control apparatus 26 operates in response to an instruction signal (driving signal) so as to change opening-and-closing timings of the intake valve.

The intake system 30 comprises an intake manifold 31, an intake pipe 32, an air filter 33, a throttle valve 34, and a throttle valve actuator 34*a*.

The intake manifold 31 includes a plurality of branch portions each of which is connected to each of the intake ports 22, and a surge tank to which the branch portions aggregate. The intake pipe 32 is connected to the surge tank. The intake manifold 31, the intake pipe 32, and a plurality of the intake ports 22 constitute an intake passage. The air filter is provided at an end of the intake pipe. The throttle valve 34 is rotatably supported by the intake pipe 32 at a position between the air filter 33 and the intake manifold 31. The throttle valve 34 is configured so as to adjust an opening sectional area of the intake passage provided by the intake pipe 32 when it rotates. The throttle valve actuator 34*a* includes a DC motor, and rotates the throttle valve 34 in response to an instruction signal (driving signal).

The exhaust system 40 includes an exhaust manifold 41, an exhaust pipe 42, an upstream-side catalytic converter (catalyst) 43, and a downstream-side catalytic converter (catalyst) 44.

The exhaust manifold 41 comprises a plurality of branch portions 41*a*, each of which is connected to each of the exhaust ports 23, and a aggregated (merging) portion (exhaust gas aggregated portion) 41*b* into which the branch portions 41*a* aggregate (merge). The exhaust pipe 42 is connected to the aggregated portion 41*b* of the exhaust manifold 41. The exhaust manifold 41, the exhaust pipe 42, and a plurality of the exhaust ports 23 constitute a passage through which the exhaust gas passes. It should be noted that the aggregated portion 41*b* of the exhaust manifold 41 and the exhaust pipe 42 are referred to as "an exhaust passage" for convenience, in the present specification.

The upstream-side catalytic converter 43 is a three-way catalytic unit which supports "noble (precious) metals which are catalytic substances", and "ceria ($CeO_2$)" on a support made of ceramics to provide an oxygen storage function and an oxygen release function (oxygen storage function). The upstream-side catalytic converter 43 is disposed (interposed) in the exhaust pipe 42. When a temperature of the upstream-side catalytic converter reaches a certain activation temperature, it exerts "a catalytic function for purifying unburnt substances (HC, CO, $H_2$, and so on) and nitrogen oxide (NOx) simultaneously" and "the oxygen storage function". It should be noted that the upstream-side catalytic converter 43 can be said to have "a function for purifying at least hydrogen $H_2$ by oxidizing the hydrogen $H_2$" in order to monitor (detect) the air-fuel ratio imbalance among cylinders. That is, the upstream-side catalytic converter 43 may be other types of catalyst (e.g., an oxidation catalyst), as long as it has "the function for purifying hydrogen $H_2$ by oxidizing the hydrogen $H_2$".

The downstream-side catalytic converter 44 is the three-way catalyst similar to the upstream-side catalytic converter 43. The downstream-side catalytic converter 44 is disposed (interposed) in the exhaust pipe 43 at a position downstream of the upstream-side catalytic converter 43.

The monitoring apparatus includes a hot-wire air flowmeter 51, a throttle position sensor 52, an engine rotational speed sensor 53, a water temperature sensor 54, an upstream (upstream-side) air-fuel ratio sensor 55, a downstream (downstream-side) air-fuel ratio sensor 56, and an accelerator opening sensor 57.

The hot-wire air flowmeter 51 measures a mass flow rate of an intake air flowing through the intake pipe 32 so as to output an signal Ga representing the mass flow rate (an intake air amount of the engine 10 per unit time).

The throttle position sensor 52 detects the opening of the throttle valve 34, and outputs a signal representing the throttle valve opening TA.

The engine rotational speed sensor 53 outputs a signal which includes a narrow pulse generated every time the intake cam shaft rotates 5 degrees and a wide pulse generated every time the intake cam shaft rotates 360 degrees. The signal output from the engine rotational speed sensor 53 is converted into a signal representing an engine rotational speed NE by an electric controller 60. Further, the electric controller 60 obtains, based on the signal from the engine rotational speed sensor 53 and a crank angle sensor which is not shown, a crank angle (an absolute crank angle) of the engine 10.

The water temperature sensor 54 detects a temperature of a cooling water (coolant) so as to output a signal representing the cooling water temperature THW.

The upstream air-fuel ratio sensor 55 is disposed at a position between the aggregated portion 41*b* of the exhaust manifold 41 and the upstream-side catalyst 43, and in either one of "the exhaust manifold 41 and the exhaust pipe 42 (that is, in the exhaust passage)". The upstream air-fuel ratio sensor 55 is "a wide range air-fuel ratio sensor of a limiting current type having a diffusion resistance layer" described in, for example, Japanese Patent Application Laid-Open (kokai) No. Hei 11-72473, Japanese Patent Application Laid-Open No. 2000-65782, and Japanese Patent Application Laid-Open No. 2004-69547, etc.

Figure 2:
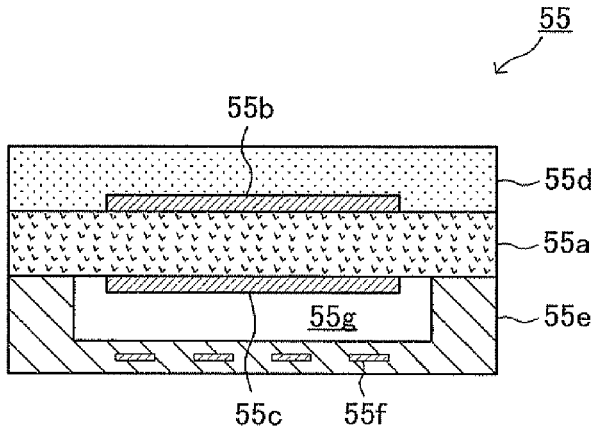
FIG. 2 is a schematic sectional view of an upstream air-fuel ratio sensor shown in FIG. 1.

As shown in FIG. 2, the upstream air-fuel ratio sensor 55 includes a solid electrolyte layer 55*a*, an exhaust-gas-side electrode layer 55*b*, an atmosphere-side electrode layer 55*c*, a diffusion resistance layer 55*d*, a wall section 55*e*, and a heater 55*f*.

The solid electrolyte layer 55*a* is an oxide sintered body having oxygen ion conductivity. In the present example, the solid electrolyte layer 55*a* is "a stabilized zirconia element"

in which CaO as a stabilizing agent is solid-solved in $ZrO_2$ (zirconia). The solid electrolyte layer 55*a* exerts a well-known "an oxygen cell characteristic" and "an oxygen pumping characteristic", when a temperature of the solid electrolyte layer 55*a* is equal to or higher than an activation temperature. As described later, these characteristics are to be exerted when the upstream air-fuel ratio sensor 55 outputs an output value according to the air-fuel ratio of the exhaust gas. The oxygen cell characteristic is a characteristic of causing oxygen ion to move from a high oxygen concentration side to a low oxygen concentration side so as to generate an electro motive force. The oxygen pumping characteristic is a characteristic of causing oxygen ion to move from a negative electrode (lower potential side electrode) to a positive electrode (higher potential side electrode) in an amount according to an electric potential difference between these electrodes, when the electric potential difference is applied between both sides of the solid electrolyte layer 55*a*.

The exhaust-gas-side electrode layer 55*b* is made of a precious metal such as Platinum (Pt) which has a high catalytic activity. The exhaust-gas-side electrode layer 55*b* is formed on one of surfaces of the solid electrolyte layer 55*a*. The exhaust-gas-side electrode layer 55*b* is formed by chemical plating and the like in such a manner that it has an adequately high permeability (i.e., it is porous).

The atmosphere-side electrode layer 55*c* is made of a precious metal such as Platinum (Pt) which has a high catalytic activity. The atmosphere-side electrode layer 55*c* is formed on the other one of surfaces of the solid electrolyte layer 55*a* in such a manner that it faces (opposes) to the exhaust-gas-side electrode layer 55*b* to sandwich the solid electrolyte layer 55*a* therebetween. The atmosphere-side electrode layer 55*c* is formed by chemical plating and the like in such a manner that it has an adequately high permeability (i.e., it is porous).

The diffusion resistance layer (diffusion rate limiting layer) 55*d* is made of a porous ceramic (a heat resistant inorganic substance). The diffusion resistance layer 55*d* is formed so as to cover an outer surface of the exhaust-gas-side electrode layer 55*b* by, for example, plasma spraying and the like. A diffusion speed of hydrogen $H_2$ whose diameter is small in the diffusion resistance layer 55*d* is higher than a diffusion speed of "carbon hydride HC, carbon monoxide CO, or the like" whose diameter is relatively large in the diffusion resistance layer 55*d*. Accordingly, hydrogen $H_2$ reaches "exhaust-gas-side electrode layer 55*b*" more promptly than carbon hydride HC, carbon monoxide CO, owing to an existence of the diffusion resistance layer 55*d*. The upstream air-fuel ratio sensor 55 is disposed in such a manner that an outer surface of the diffusion resistance layer 55*d* is "exposed to the exhaust gas (the exhaust gas discharged from the engine 10 contacts with the outer surface of the diffusion resistance layer 55*d*).

The wall section 55*e* is made of a dense alumina ceramics through which gases can not pass. The wall section 55*e* is configured so as to form "an atmosphere chamber 55*g*" which is a space that accommodates the atmosphere-side electrode layer 55*c*. An air is introduced into the atmosphere chamber 55*g*.

The heater 55*f* is buried in the wall section 55*e*. When the heater is energized, it generates heat to heat up the solid electrolyte layer 55*a*.

Figure 3:
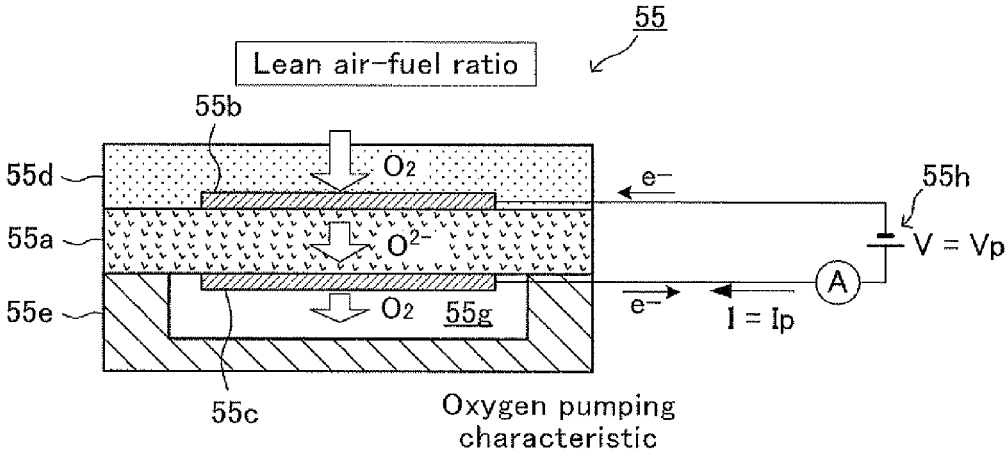
FIG. 3 is a figure for describing an operation of the upstream air-fuel ratio sensor, when an air-fuel ratio of an exhaust gas (gas to be detected) is in a lean side with respect to the stoichiometric air-fuel ratio.

As shown in FIG. 3, the upstream air-fuel ratio sensor 55 uses an electric power supply 55*h*. The electric power supply 55*h* applies an electric voltage V in such a manner that an electric potential of the atmosphere-side electrode layer 55*c* is higher than an electric potential of the exhaust-gas-side electrode layer 55*b*.

As shown in FIG. 3, when the air-fuel ratio of the exhaust gas is in the lean side with respect to the stoichiometric air-fuel ratio, the oxygen pumping characteristic is utilized so as to detect the air-fuel ratio. That is, when the air-fuel ratio of the exhaust gas is leaner than the stoichiometric air-fuel ratio, a large amount of oxygen molecules included in the exhaust gas reach the exhaust-gas-side electrode layer 55*b* after passing through the diffusion resistance layer 55*d*. The oxygen molecules receive electrons to change to oxygen ions. The oxygen ions pass through the solid electrolyte layer 55*a*, and release the electrons to change to oxygen molecules. As a result, a current I flows from the positive electrode of the electric power supply 55*h* to the negative electrode of the electric power supply 55*h*, thorough the atmosphere-side electrode layer 55*c*, the solid electrolyte layer 55*a*, and the exhaust-gas-side electrode layer 55*b*.

Figure 4:
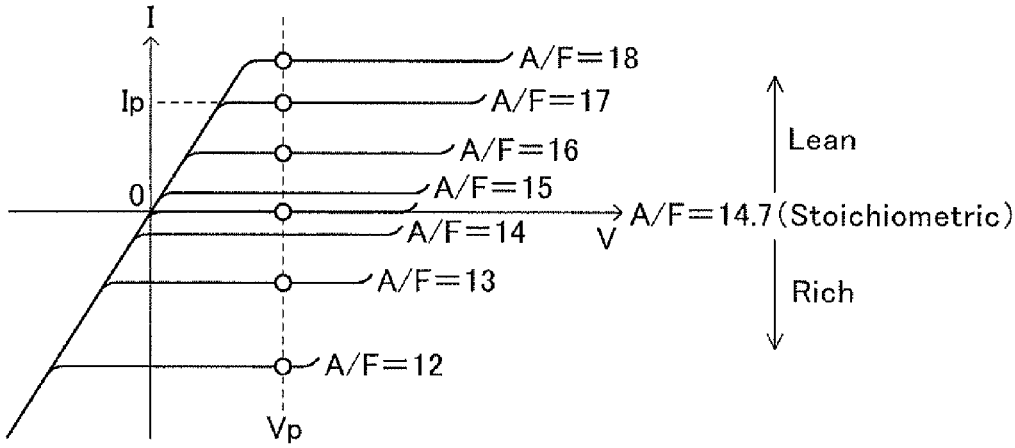
FIG. 4 is a graph showing a relationship between the air-fuel ratio of the exhaust gas and a limiting current value of the upstream air-fuel ratio sensor.

The magnitude of the electrical current I varies according to an amount of "the oxygen molecules reaching the exhaust-gas-side electrode layer 55*b* after passing through the diffusion resistance layer 55*d* by the diffusion" out of the oxygen molecules included in the exhaust gas reaching the outer surface of the diffusion resistance layer 55*d*. That is, the magnitude of the electrical current I varies depending upon a concentration (partial pressure) of oxygen at the exhaust-gas-side electrode layer 55*b*. The concentration of oxygen at the exhaust-gas-side electrode layer 55*b* varies depending upon the concentration of oxygen of the exhaust gas reaching the outer surface of the diffusion resistance layer 55*d*. The current I, as shown in FIG. 4, does not vary when the voltage V is set at a value equal to or higher than the predetermined value Vp, and therefore, is referred to as a limiting current Ip. The air-fuel ratio sensor 55 outputs the value corresponding to the air-fuel ratio based on the limiting current Ip.

Figure 5:
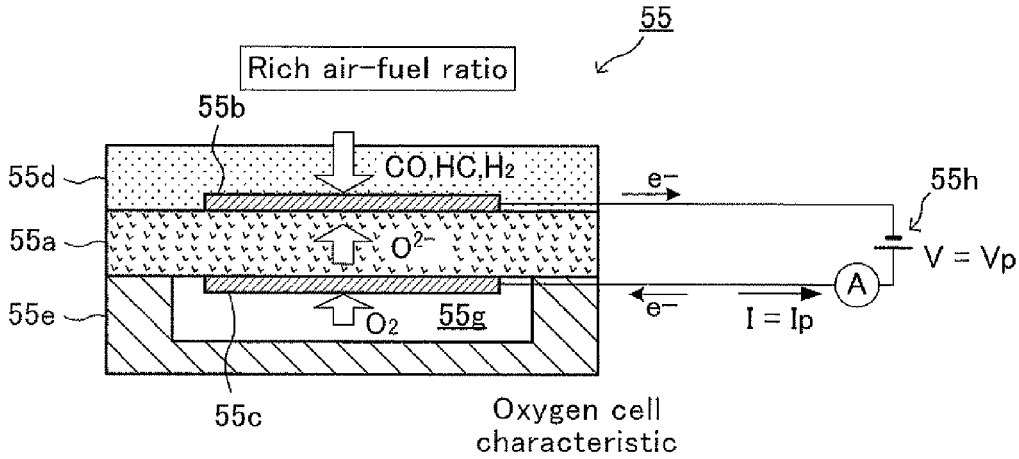
FIG. 5 is a figure for describing an operation of the upstream air-fuel ratio sensor, when the air-fuel ratio of the exhaust gas (gas to be detected) is in a rich side with respect to the stoichiometric air-fuel ratio.

On the other hand, as shown in FIG. 5, when the air-fuel ratio of the exhaust gas is in the rich side with respect to the stoichiometric air-fuel ratio, the oxygen cell characteristic is utilized so as to detect the air-fuel ratio. More specifically, when the air-fuel ratio of the exhaust gas is richer than the stoichiometric air-fuel ratio, a large amount of unburnt substances (HC, CO, and $H_2$ etc.) reach the exhaust-gas-side electrode layer 55*b* through the diffusion resistance layer 55*d*. In this case, a difference (oxygen partial pressure difference) between the concentration of oxygen at the atmosphere-side electrode layer 55*c* and the concentration of oxygen at the exhaust-gas-side electrode layer 55*b* becomes large, and thus, the solid electrolyte layer 55*a* functions as an oxygen cell. The applied voltage V is set at a value lower than the elective motive force of the oxygen cell.

Accordingly, oxygen molecules existing in the atmosphere chamber 55*g* receive electrons at the atmosphere-side electrode layer 55*c* so as to change into oxygen ions. The oxygen ions pass through the solid electrolyte layer 55*a*, and move to the exhaust-gas-side electrode layer 55*b*. Then, they oxidize the unburnt substances at the exhaust-gas-side electrode layer 55*b* to release electrons. Consequently, a current I flows from the negative electrode of the electric power supply 55*h* to the positive electrode of the electric power supply 55*h*, thorough the exhaust-gas-side electrode layer 55*b*, the solid electrolyte layer 55*a*, and the atmosphere-side electrode layer 55*c*.

The magnitude of the electrical current I varies according to an amount of the oxygen ions reaching the exhaust-gas-side electrode layer 55*b* from the atmosphere-side electrode layer 55*c* through the solid electrolyte layer 55*a*. As described above, the oxygen ions are used to oxidize the unburnt substances at the exhaust-gas-side electrode layer 55*b*. Accordingly, the amount of the oxygen ions passing through the solid electrolyte layer 55*a* becomes larger, as an amount of the unburnt substances reaching the exhaust-gas-side electrode layer 55*b* through the diffusion resistance layer 55*d* by the diffusion becomes larger. In other words, as the air-fuel ratio is smaller (as the air-fuel ratio is richer, and thus, an amount of the unburnt substances becomes larger), the magnitude of the electrical current I becomes larger. Meanwhile, the amount of the unburnt substances reaching the exhaust-gas-side electrode layer 55*b* is limited owing to the existence of the diffusion resistance layer 55*d*, and therefore, the current I becomes a constant value Ip varying depending upon the air-fuel ratio. The upstream air-fuel ratio sensor 55 outputs the value corresponding to the air-fuel ratio based on the limiting current Ip.

Figure 6:
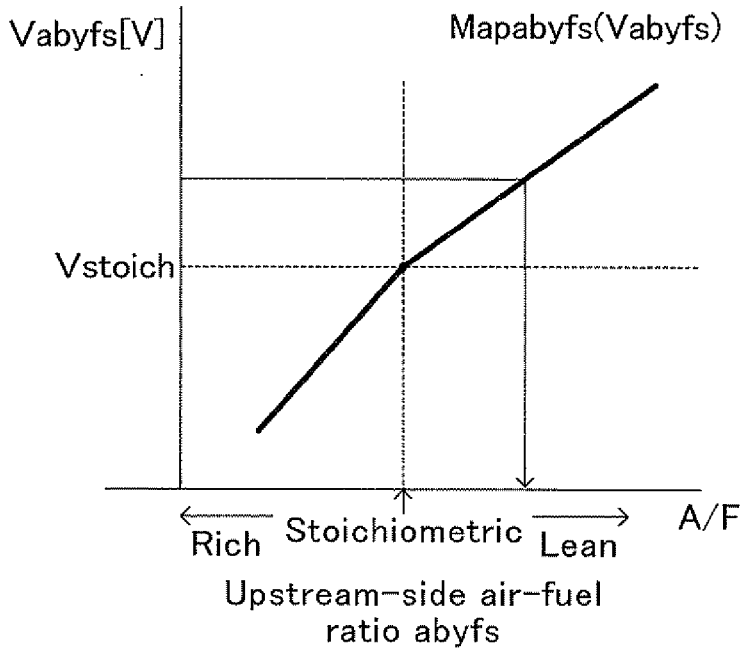
FIG. 6 is a graph showing a relationship between the air-fuel ratio of the exhaust gas and an output value of the upstream air-fuel ratio sensor.

As shown in FIG. 6, the upstream air-fuel ratio sensor 55, utilizing the above described detecting principle, outputs the output values Vabyfs according to the air-fuel ratio (an upstream-side air-fuel ratio abyfs) of the exhaust gas flowing through the position at which the upstream air-fuel ratio sensor 55 is disposed. The output values Vabyfs is obtained by converting the limiting current Ip into a voltage. The output values Vabyfs increases, as the air-fuel ratio of the gas to be detected becomes larger (leaner). The electric controller 60, described later, stores an air-fuel ratio conversion table (map) Mapabyfs shown in FIG. 6, and detects an actual upstream-side air-fuel ratio abyfs by applying an actual output value Vabyfs to the air-fuel ratio conversion table Mapabyfs. The air-fuel ratio conversion table Mapabyfs is made in consideration of the preferential diffusion of hydrogen. In other words, the table Mapabyfs is made based on "an actual output value Vabyfs of the upstream air-fuel sensor 55" when the air-fuel ratio of the exhaust gas reaching the upstream air-fuel ratio sensor 55 is set at a value X by setting each of the air-fuel ratios of each of the cylinders at the same air-fuel ratio X to each other.

As described above, the upstream air-fuel ratio sensor 55 is an fuel-ratio sensor which is disposed in the exhaust passage, and at a position downstream of an exhaust gas aggregated portion of a plurality of the cylinders or between the exhaust gas aggregated portion and the catalytic converter 43, and which includes an air-fuel ratio detecting element which outputs the output value in accordance with the air-fuel ratio of the gas which has not passed through the catalytic converter 43 and contacts with the diffusion resistance layer.

Referring back to FIG. 1 again, the downstream air-fuel ratio sensor 56 is disposed in the exhaust pipe 42 (i.e., the exhaust passage), and at a position between the upstream-side catalytic converter 43 and the downstream-side catalytic converter 44. The downstream air-fuel ratio sensor 56 is a well-known oxygen-concentration-cell-type oxygen concentration sensor (O2 sensor). The downstream air-fuel ratio sensor 56 has a structure similar to the upstream air-fuel ratio sensor 55 shown in FIG. 2 (except the electric power supply 55*h*). Alternatively, the downstream air-fuel ratio sensor 56 may comprise a test-tube like solid electrolyte layer, an exhaust-gas-side electrode layer formed on an outer surface of the solid electrolyte layer, an atmosphere-side electrode layer formed on an inner surface of the solid electrolyte layer in such a manner that it is exposed in an atmosphere chamber and faces (opposes) to the exhaust-gas-side electrode layer to sandwich the solid electrolyte layer therebetween, and a diffusion resistance layer which covers the exhaust-gas-side electrode layer and with which the exhaust gas contacts (or which is exposed in the exhaust gas). The downstream air-fuel ratio sensor 56 outputs an output value Voxs in accordance with an air-fuel ratio (downstream-side air-fuel ratio afdown) of the exhaust gas passing through the position at which the downstream air-fuel ratio sensor 56 is disposed.

Figure 7:
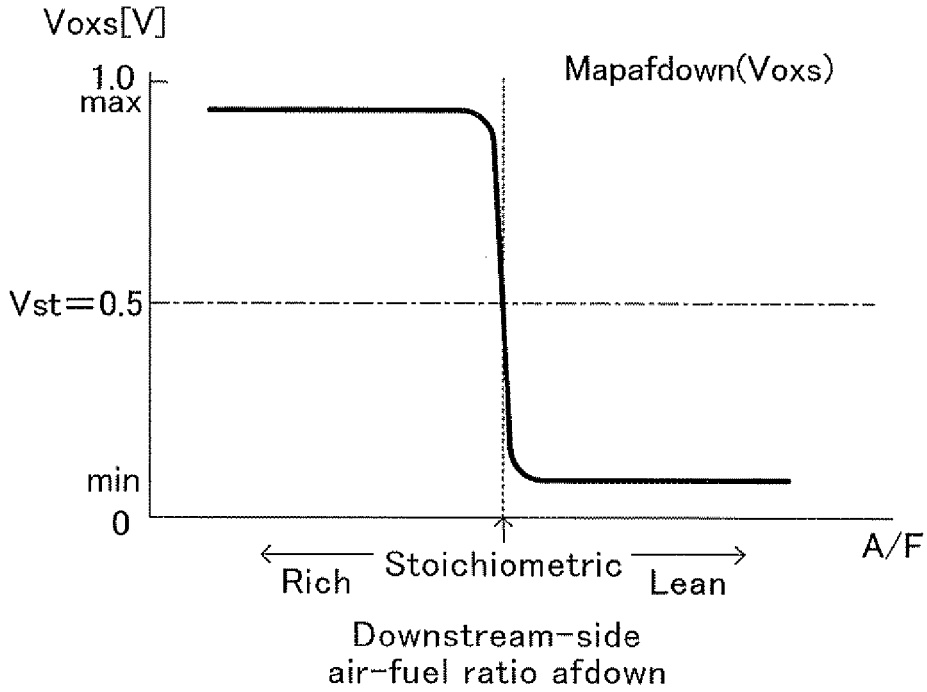
FIG. 7 is a graph showing a relationship between an air-fuel ratio of the exhaust gas and an output value of the downstream air-fuel ratio sensor.

As shown in FIG. 7, the output value Voxs of the downstream air-fuel ratio sensor 56 becomes equal to a maximum output value max (e.g., about 0.9 V) when the air-fuel ratio of the gas to be detected is richer than the stoichiometric air-fuel ratio, becomes equal to a minimum output value min (e.g., about 0.1 V) when the air-fuel ratio of the gas to be detected is leaner than the stoichiometric air-fuel ratio, and becomes equal to a voltage Vst which is about a middle value between the maximum output value max and the minimum output value min (the middle voltage Vst, e.g., about 0.5 V) when the air-fuel ratio of the gas to be detected is equal to the stoichiometric air-fuel ratio. Further, the output value Voxs varies rapidly from the maximum output value max to the minimum output value min when the air-fuel ratio of the gas to be detected varies from the air-fuel ratio richer than the stoichiometric air-fuel ratio to the air-fuel ratio leaner than the stoichiometric air-fuel ratio, and the output value Voxs varies rapidly from the minimum output value min to the maximum output value max when the air-fuel ratio of the gas to be detected varies from the air-fuel ratio leaner than the stoichiometric air-fuel ratio to the air-fuel ratio richer than the stoichiometric air-fuel ratio.

The accelerator opening sensor 57 shown in FIG. 1 detects an operation amount of the accelerator pedal AP operated by a driver so as to output a signal representing the operation amount Accp of the accelerator pedal AP.

The electric controller 60 is "a well-known microcomputer", comprising "a CPU, a ROM, a RAM, a backup RAM (or a nonvolatile memory such as an EEPROM), an interface including an AD converter, and so on".

The backup RAM which the electric controller 60 comprises is supplied with an electric power from a battery mounted on a vehicle on which the engine 10 is mounted, regardless of a position of an unillustrated ignition key switch (off-position, start position, on-position, and so on) of the vehicle. Data is stored in (written into) the backup RAM according to an instruction of the CPU while the electric power is supplied to the backup RAM, and the backup RAM holds (retains, stores) the data in such a manner that the data can be read out. When the electric power supply to the backup RAM is stopped due to a removal of the battery from the vehicle, or the like, the backup RAM can not hold the data. That is, the stored data is lost (eliminated, broken). Therefore, when the electric power supply is resumed, the CPU initializes the data (or sets the data at default values) to be stored in the backup RAM.

The interface of the electric controller 60 is connected to the sensors 51 to 57 and supplies signals from the sensors to the CPU. Further, the interface sends instruction signals (drive signals), in accordance with instructions from the CPU, to each of the spark plugs of each of the cylinders, each of the fuel injectors 25 of each of the cylinders, the intake valve control apparatus 26, the throttle valve actuator 34*a*, and so on. It should be noted that the electric controller 60 sends the instruction signal to the throttle valve actuator 34*a*, in such a manner that the throttle valve opening angle TA is increased as the obtained accelerator pedal operation amount Accp becomes larger.

(Principle of a Determination of an Air-Fuel Ratio Imbalance Among Cylinders)

Next will be described the principle of "the determination of an air-fuel ratio imbalance among cylinders". The determination of an air-fuel ratio imbalance among cylinders is determining whether or not the air-fuel ratio imbalance among cylinders becomes larger than a warning value, in other words, is determining whether or not a non-uniformity among individual cylinder air-fuel-ratios (which can not be permissible in view of the emission) (i.e., the air-fuel ratio imbalance among cylinders) is occurring.

Figure 8:
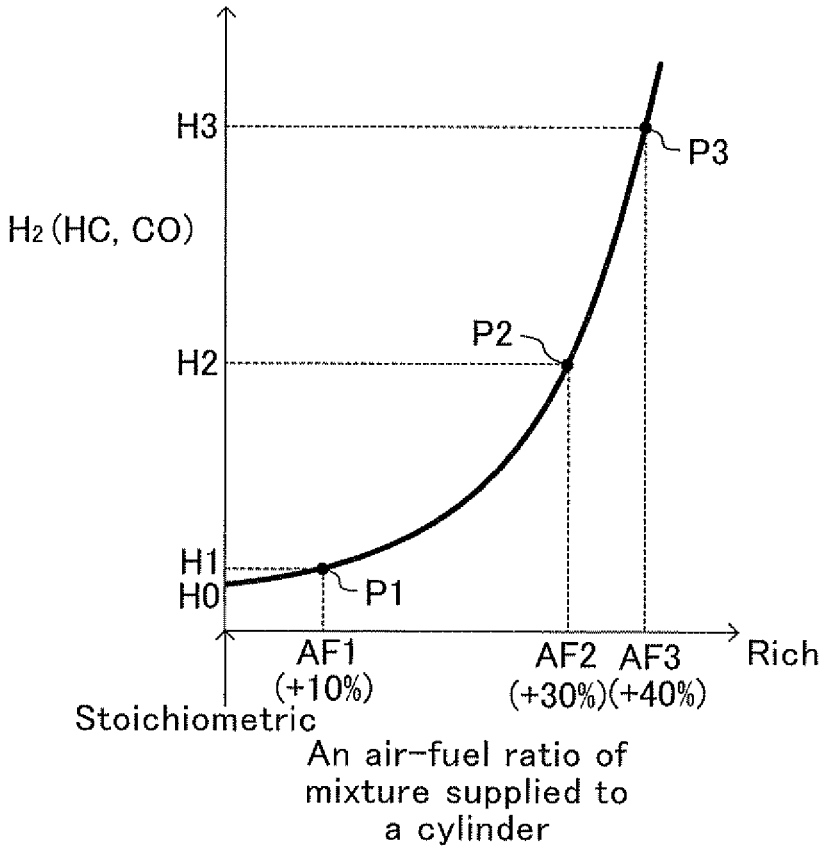
FIG. 8 is a graph showing a relationship between an air-fuel ratio of a mixture supplied to a cylinder and an amount of unburnt substances discharged from the cylinder.

The fuel of the engine 10 is a chemical compound of carbon and hydrogen. Accordingly, "carbon hydride HC, carbon monoxide CO, and hydrogen $H_2$, and so on" are generated as intermediate products, while the fuel is burning to change to water $H_2O$ and carbon dioxide $CO_2$ As the air-fuel ratio of the mixture for the combustion becomes smaller than the stoichiometric air-fuel ratio (i.e., as the air-fuel ratio becomes richer than the stoichiometric air-fuel ratio), a difference between an amount of oxygen required for a perfect combustion and an actual amount of oxygen becomes larger. In other words, as the air-fuel ratio becomes richer, a shortage amount of oxygen during the combustion increases, and therefore, a concentration of oxygen lowers. Thus, a probability that intermediate products (unburnt substances) meet and bind with oxygen greatly decreases. Consequently, as shown in FIG. 8, an amount of the unburnt substances (HC, CO, and $H_2$) discharged from a cylinder drastically (e.g., in a quadratic function fashion) increases, as the air-fuel ratio of the mixture supplied to the cylinder becomes richer. It should be noted that points P1, P2, and P3 corresponds to states in which an amount of fuel supplied to a certain cylinder becomes 10% (=AF1) excess, 30% (=AF2) excess, and 40% (=AF3) excess, respectively, with respect to an amount of fuel that causes an air-fuel ratio of the cylinder to coincide with the stoichiometric air-fuel ratio.

In the mean time, hydrogen $H_2$ is a small molecule, compared with carbon hydride HC and carbon monoxide CO. Accordingly, hydrogen $H_2$ rapidly diffuses through the diffusion resistance layer 55*d* of the upstream air-fuel ratio sensor 55, compared to the other unburnt substances (HC, CO). Therefore, when a large amount of the unburnt substances including HC, CO, and $H_2$ are generated, a preferential diffusion of hydrogen $H_2$ considerably occurs in the diffusion resistance layer 55*d*. That is, hydrogen $H_2$ reaches the surface of an air-fuel ratio detecting element (the exhaust-gas-side electrode layer 55*b* formed on the surface of the solid electrolyte layer 55*a*) in a larger mount compared with "the other unburnt substances (HC, CO)". As a result, a balance between a concentration of hydrogen $H_2$ and a concentration of the other unburnt substances (HC, CO) is lost. In other words, a fraction of hydrogen $H_2$ to all of the unburnt substances included in "the exhaust gas reaching the air-fuel ratio detecting element (the exhaust-gas-side electrode layer 55*b*)" becomes larger than a fraction of hydrogen $H_2$ to all of the unburnt substances included in "the exhaust gas discharged from the engine 10".

Meanwhile, the monitoring apparatus is the portion of the air-fuel ratio control apparatus. The air-fuel ratio control apparatus performs "a feedback control on an air-fuel ratio (main feedback control)" to cause "the upstream-side air-fuel ratio represented by the output value Vabyfs of the upstream air-fuel ratio sensor 55" to coincide with "a target upstream-side air-fuel ratio abyfr". Generally, the target upstream-side air-fuel ratio abyfr is set to (at) the stoichiometric air-fuel ratio.

Further, the air-fuel ratio control apparatus performs "a feedback control on an air-fuel ratio (sub feedback control of an air-fuel ratio)" to cause "the output value Voxs of the downstream air-fuel sensor 56 (or the downstream-side air-fuel ratio afdown represented by the output value Voxs of the downstream air-fuel ratio sensor)" to coincide with "a target downstream-side value Voxsref (or a target downstream-side air-fuel ratio represented by the downstream-side value Voxsref). Generally, the target downstream-side value Voxsref is set at a value (0.5V) corresponding to the stoichiometric air-fuel ratio.

Here, it is assumed that each of air-fuel ratios of each of cylinders deviates toward a rich side without exception, while the air-fuel ratio imbalance among cylinders is not occurring. Such a state occurs, for example, when "a measured or estimated value of the intake air amount of the engine" which is a basis when calculating a fuel injection amount becomes larger than "a true intake air amount".

In this case, for example, it is assumed that the air-fuel ratio of each of the cylinders is AF2 shown in FIG. 8. When the air-fuel ratio of a certain cylinder is AF2, a larger amount of the unburnt substances (thus, hydrogen $H_2$) are included in the exhaust gas than when the air-fuel ratio of the certain cylinder is AF1 closer to the stoichiometric air-fuel ratio than AF2 (refer the point P1 and the point P2). Accordingly, "the preferential diffusion of hydrogen $H_2$" occurs in the diffusion resistance layer 55*d* of the upstream air-fuel ratio sensor 55.

In this case, a true average of the air-fuel ratio of "the mixture supplied to the engine 10 during a period in which each and every cylinder completes one combustion stroke (a period corresponding to 720° crank angle)" is also AF2. In addition, as described above, the air-fuel ratio conversion table Mapabyfs shown in FIG. 6 is made in consideration of "the preferential diffusion of hydrogen $H_2$". Therefore, the upstream-side air-fuel ratio abyfs represented by the actual output value Vabyfs of the upstream air-fuel ratio sensor 55 (i.e., the upstream-side air-fuel ratio abyfs obtained by applying the actual output value Vabyfs to the air-fuel ratio conversion table Mapabyfs) coincides with "the true average AF2 of the air-fuel ratio".

Accordingly, by the main feedback control, the air-fuel ratio of the mixture supplied to the entire engine 10 is corrected in such a manner that it coincides with "the stoichiometric air-fuel ratio which is the target upstream-side air-fuel ratio abyfr", and therefore, each of the air-fuel ratios of each of the cylinders also roughly coincides with the stoichiometric air-fuel ratio, since the air-fuel ratio imbalance among cylinders is not occurring. Consequently, a sub feedback amount (as well as a learning value of the sub feedback amount described later) does not become a value which corrects the air-fuel ratio in (by) a great amount. In other words, when the air-fuel ratio imbalance among cylinders is not occurring, the sub feedback amount (as well as the learning value of the sub feedback amount described later) does not become the value which greatly corrects the air-fuel ratio.

Another description will next be made regarding behaviors of various values when "the air-fuel ratio imbalance among cylinders" is occurring, with reference to the behaviors of various values when "the air-fuel ratio imbalance among cylinders" is not occurring, as described before.

For example, it is assumed that an air-fuel ratio A0/F0 is equal to the stoichiometric air-fuel ratio (e.g., 14.5), when the intake air amount (weight) introduced into each of the cylinders of the engine 10 is A0, and the fuel amount (weight) supplied to each of the cylinders is F0.

Further, it is assumed that an amount of the fuel supplied (injected) to each of the cylinders becomes uniformly excessive in 10% due to an error in estimating the intake air amount, etc., although the air-fuel ratio imbalance among cylinders is not occurring. That is, it is assumed that the fuel of 1.1·F0 is supplied to each of the cylinder. Here, a total amount of the intake air supplied to the engine 10 which is the four cylinder engine (i.e., an intake amount supplied to the entire engine 10 during the period in which each and every cylinder completes one combustion stroke) is equal to 4·A0. A total amount of the fuel supplied to the engine 10 (i.e., a fuel amount supplied to the entire engine 10 during the period in which each and every cylinder completes one combustion stroke) is equal to 4.4·F0 (=1.1·F0+1.1·F0+1.1·F0+1.1·F0). Accordingly, a true average of the air-fuel ratio of the mixture supplied to the entire engine 10 is equal to 4·A0/(4.4·F0)=A0/(1.1·F0). At this time, the output value of the upstream air-fuel ratio sensor becomes equal to an output value corresponding to the air-fuel ratio A0/(1.1·F0).

Accordingly, the amount of the fuel supplied to each of the cylinders is decreased in 10% (the fuel of 1·F0 is supplied to each of the cylinders) by the main feedback control, and therefore, the air-fuel ratio of the mixture supplied to the entire engine 10 is caused to coincide with the stoichiometric air-fuel ratio A0/F0.

In contrast, it is assumed that only the air-fuel ratio of a specific cylinder greatly deviates to (become) the richer side, and thus, the air-fuel ratio imbalance among cylinders is occurring. This state occurs, for example, when the fuel injection property (characteristic) of the fuel injector 25 provided for the specific cylinder becomes the property that the injector 25 injects the fuel in an amount which is considerable larger (more excessive) than the instructed fuel injection amount". This type of abnormality of the injector 25 is also referred to as "rich deviation abnormality of the injector".

Here, it is assumed that an amount of fuel supplied to one certain specific cylinder is excessive in 40% (i.e., 1.4·F0), and an amount of fuel supplied to each of the other three cylinders is a fuel amount required to cause the air-fuel ratio of the other three cylinders to coincide with the stoichiometric air-fuel ratio (i.e., F0). Under this assumption, the air-fuel ratio of the specific cylinder is "AF3" shown in FIG. 8, and the air-fuel ratio of each of the other cylinders is the stoichiometric air-fuel ratio.

At this time, a total amount of the intake air supplied to the engine 10 which is the four cylinder engine (an amount of air supplied to the entire engine 10 during the period in which each and every cylinder completes one combustion stroke) is equal to 4·A0. A total amount of the fuel supplied to the entire engine 10 (an amount of fuel supplied to the entire engine 10 during the period in which each and every cylinder completes one combustion stroke) is equal to 4.4·F0 (=1.4·F0+F0+F0+F0).

Accordingly, the true average of the air-fuel ratio of the mixture supplied to the entire engine 10 is equal to 4·A0/(4.4·F0)=A0/(1.1·F0). That is, the true average of the air-fuel ratio of the mixture supplied to the entire engine 10 is the same as the value obtained "when the amount of fuel supplied to each of the cylinders is uniformly excessive in 10%" as described above.

However, as described above, the amount of the unburnt substances (HC, CO, and $H_2$) drastically increases, as the air-fuel ratio of the mixture supplied to the cylinder becomes richer and richer. Accordingly, "a total amount SH1 of hydrogen $H_2$ included in the exhaust gas in the case in which "only the amount of fuel supplied to the specific cylinder becomes excessive in 40%" is equal to SH1=H3+H0+H0+H0=H3+3·H0, according to FIG. 8. In contrast, "a total amount SH2 of hydrogen $H_2$ included in the exhaust gas in the case in which "the amount of the fuel supplied to each of the cylinders is uniformly excessive in 10%" is equal to SH2=H1+H1+H1+H1=4·H1, according to FIG. 8. The amount H1 is slightly larger than the amount H0, however, both of the amount H1 and the amount H0 are considerably small. That is, the amount H1 and the amount H0, as compared to the amount H3, is substantially equal to each other. Consequently, the total hydrogen amount SH1 is considerably larger than the total hydrogen amount SH2 (SH1>>SH2).

As described above, even when the average of the air-fuel ratio of the mixture supplied to the entire engine 10 is the same, the total amount SH1 of hydrogen included in the exhaust gas when the air-fuel ratio imbalance among cylinders is occurring is considerably larger than the total amount SH2 of hydrogen included in the exhaust gas when the air-fuel ratio imbalance among cylinders is not occurring.

Accordingly, the air-fuel ratio represented by the output value Vabyfs of the upstream air-fuel ratio sensor when only the amount of fuel supplied to the specific cylinder is excessive in 40% becomes richer (smaller) than "the true average of the air-fuel ratio (A0/(1.1·F0)) of the mixture supplied to the engine 10", due to "the preferential diffusion of hydrogen $H_2$" in the diffusion resistance layer 55*d*. That is, even when the average of the air-fuel ratio of the exhaust gas is the same air-fuel ratio, the concentration of hydrogen $H_2$ at the exhaust-gas-side electrode layer 55*b* of the upstream air-fuel ratio sensor 55 becomes higher when the air-fuel ratio imbalance among cylinders is occurring than when the air-fuel ratio imbalance among cylinders is not occurring. Accordingly, the output value Vabyfs of the upstream air-fuel ratio sensor 55 becomes a value indicating an air-fuel ratio richer than "the true average of the air-fuel ratio".

Consequently, by the main feedback control, the true average of the air-fuel ratio of the mixture supplied to the entire engine 10 is caused to be leaner than the stoichiometric air-fuel ratio.

On the other hand, the exhaust gas which has passed through the upstream-side catalytic converter 43 reaches the downstream air-fuel ratio sensor 56. The hydrogen $H_2$ included in the exhaust gas is oxidized (purified) together with the other unburnt substances (HC, CO) in the upstream-side catalytic converter 43. Accordingly, the output value Voxs of the downstream air-fuel ratio sensor 56 becomes a value corresponding to the average of the true air-fuel ratio of the mixture supplied to the engine 10. The air-fuel ratio correction amount (the sub feedback amount) calculated according to the sub feedback control becomes a value which compensates for the excessive correction of the air-fuel ratio to the lean side. The sub feedback amount causes the true average of the air-fuel amount of the engine 10 to coincide with the stoichiometric air-fuel ratio.

As described above, the air-fuel ratio correction amount (the sub feedback amount) calculated according to the sub feedback control becomes the value to compensate for "the excessive correction of the air-fuel ratio to the lean side" caused by the rich deviation abnormality of the injector 25 (the air-fuel ratio imbalance among cylinders). In addition, a degree of the excessive correction of the air-fuel ratio to the lean side increases, as the injector 25 which is in the rich deviation abnormality state injects the fuel in larger amount with respect to "the instructed injection amount" (i.e., the air-fuel ratio of the specific cylinder becomes richer).

Therefore, in "a system in which the air-fuel ratio of the engine is corrected to the richer side" as the sub feedback amount is a positive value and the magnitude of the sub feedback amount becomes larger, "a value varying depending upon the sub feedback amount (in practice, for example, a learning value of the sub feedback amount, the learning value obtained from the steady-state component of the sub feedback amount)" is a value representing the degree of the air-fuel ratio imbalance among cylinders.

In view of the above, the present monitoring apparatus obtains the value varying depending upon the sub feedback amount (in the present example, "the sub FB learning value" which is the learning value of the sub feedback amount"), as the imbalance determining parameter. That is, the imbalance determining parameter is "a value which becomes larger, as a difference becomes larger between an amount of hydrogen included in the exhaust gas before passing through the upstream-side catalytic converter 43 and an amount of hydrogen included in the exhaust gas after passing through the upstream-side catalytic converter 43". Thereafter, the determining apparatus determines that the air-fuel ratio imbalance among cylinders is occurring, when the imbalance determining parameter becomes equal to or larger than "an abnormality determining threshold" (e.g., when the value which increases and decreases according to increase and decrease of the sub FB learning value becomes a value which corrects the air-fuel ratio of the engine to the richer side in an amount equal to or larger than the abnormality determining threshold")

Figure 9:
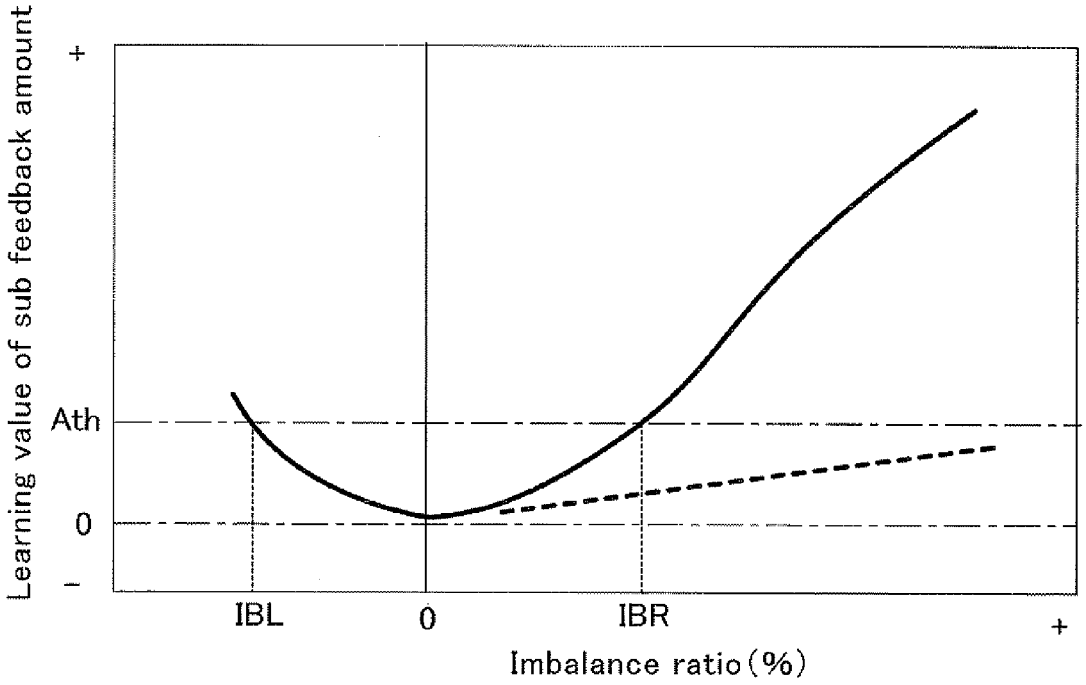
FIG. 9 is a graph showing a relationship between an air-fuel ratio imbalance ratio among cylinders and a learning value of a sub feedback amount.

A solid line in FIG. 9 shows the sub FB learning value, when an air-fuel ratio of a certain cylinder deviates to the richer side and to the leaner side from the stoichiometric air-fuel ratio, due to the air-fuel ratio imbalance among cylinders. An abscissa axis of the graph shown in FIG. 9 is "an imbalance ratio". The imbalance ratio is defined as a ratio (Y/X) of a difference Y(=X−af) between "the stoichiometric air-fuel ratio X and the air-fuel ratio af of the cylinder deviating to the richer side" to "the stoichiometric air-fuel ratio X". As described above, an affect due to the preferential diffusion of hydrogen $H_2$ drastically becomes greater, as the imbalance ratio becomes larger. Accordingly, as shown by the solid line in FIG. 9, the sub FB learning value (and therefore, the imbalance determining parameter) increases in a quadratic function fashion, as the imbalance ratio increases.

It should be noted that, as shown by the solid line in FIG. 9, the sub FB learning value increases as the imbalance ratio increases, when the imbalance ratio is a negative value. That is, for example, in a case in which the air-fuel ratio imbalance among cylinders occurs when an air-fuel ratio of one specific cylinder deviates to the leaner side, the sub FB learning value as the imbalance determining parameter (the value according to the sub feedback learning value) increases. This state occurs, for example, when the fuel injection property (characteristic) of the fuel injector 25 provided for the specific cylinder becomes "the property (characteristic) that the injector 25 injects the fuel in an amount which is considerable smaller than the instructed fuel injection amount". This type of abnormality of the injector 25 is also referred to as "lean deviation abnormality of the injector".

The reason why the sub FB learning value increases when the air-fuel ratio imbalance among cylinders occurs in which the air-fuel ratio of the single specific cylinder greatly deviates to the leaner side will next be described briefly. In the description below, it is assumed that the intake air amount (weight) introduced into each of the cylinders of the engine 10 is A0. Further, it is assumed that the air-fuel ratio A0/F0 coincides with the stoichiometric air-fuel ratio, when the fuel amount (weight) supplied to each of the cylinders is F0.

In addition, it is assumed that the amount of fuel supplied to one certain specific cylinder (the first cylinder, for convenience) is considerably small in 40% (i.e., 0.6·F0), and an amount of fuel supplied to each of the other three cylinders (the second, the third, and the fourth cylinder) is a fuel amount required to cause the air-fuel ratio of the other three cylinders to coincide with the stoichiometric air-fuel ratio (i.e., F0). It should be noted it is assumed that a misfiring does not occur.

In this case, by the main feedback control, it is further assumed that the amount of the fuel supplied to each of the first to fourth cylinder is increased in the same amount (10%) to each other. At this time, the amount of the fuel supplied to the first cylinder is equal to 0.7·F0, and the amount of the fuel supplied to each of the second to fourth cylinder is equal to 1.1·F0.

Under this assumption, a total amount of the intake air supplied to the engine 10 which is the four cylinder engine (an amount of air supplied to the entire engine 10 during the period in which each and every cylinder completes one combustion stroke) is equal to 4·A0. A total amount of the fuel supplied to the engine 10 (an amount of fuel supplied to the entire engine 10 during the period in which each and every cylinder completes one combustion stroke) is equal to 4.0·F0 (=0.7·F0+1.1·F0+1.1·F0+1.1·F0), as a result of the main feedback control. Consequently, the true average of the air-fuel ratio of the mixture supplied to the entire engine 10 is equal to 4·A0/(4·F0)=A0/F0, that is the stoichiometric air-fuel ratio.

However, "a total amount SH3 of hydrogen $H_2$ included in the exhaust gas" in this case is equal to SH3=H4+H1+H1+H1=H4+3·H1. It should be noted that H4 is an amount of hydrogen generated when the air-fuel ratio is equal to A0/(0.7·F0) is smaller than H1 and H2, and is roughly equal to H0. Accordingly, the total amount SH3 is at most equal to (H0+3·H1).

In contrast, "a total amount SH4 of hydrogen $H_2$ included in the exhaust gas" when the air-fuel ratio imbalance among cylinders is not occurring and the true average of the air-fuel ratio of the mixture supplied to the entire engine 10 is equal to the stoichiometric air-fuel ratio is SH4=H0+H0+H0+H0=4·H0. As described above, H1 is slightly larger than H0. Accordingly, the total amount SH3(=H0+3·H1) is larger than the total amount SH4 (=4·H0).

Consequently, when the air-fuel ratio imbalance among cylinders is occurring due to "the lean deviation abnormality of the injector", the output value Vabyfs of the upstream air-fuel ratio sensor 55 is affected by the preferential diffusion of hydrogen, even when the true average of the air-fuel ratio of the mixture supplied to the entire engine 10 is shifted to the stoichiometric air-fuel ratio by the main feedback control. That is, the upstream-side air-fuel ratio abyfs obtained by applying the output value Vabyfs to the air-fuel ratio conversion table Mapabyfs becomes "richer (smaller)" than the stoichiometric air-fuel ratio which is the target upstream-side air-fuel ratio abyfr. As a result, the main feedback control is further performed, and the true average of the air-fuel ratio of the mixture supplied to the entire engine 10 is adjusted (corrected) to the leaner side with respect to the stoichiometric air-fuel ratio.

Accordingly, the air-fuel ratio correction amount calculated according to the sub feedback control becomes larger to compensate for "the excessive correction of the air-fuel ratio to the lean side according to the main feedback control" due to the lean deviation abnormality of the injector 25 (the air-fuel ratio imbalance among cylinders). Therefore, "the imbalance determining parameter (for example, the sub FB learning value)" obtained based on "the air-fuel ratio correction amount calculated according to the sub feedback control" increases as the imbalance ratio is a negative value and the magnitude of the imbalance ratio increases.

Accordingly, the present monitoring apparatus determines that the air-fuel ratio imbalance among cylinders is occurring, when the imbalance determining parameter (for example, the value which increases and decreases according to increase and decrease of the sub FB learning value) becomes equal to or larger than "the abnormality determining threshold Ath", not only in the case in which the air-fuel ratio of the specific cylinder deviates to "the rich side" but also in the case in which the air-fuel ratio of the specific cylinder deviates to "the lean side".

It should be noted that a dotted line in FIG. 9 indicates the sub FB learning value, when the each of the air-fuel ratios of each of the cylinders deviates uniformly to the richer side from the stoichiometric air-fuel ratio, and the main feedback control is terminated. In this case, the abscissa axis is adjusted so as to become the same deviation as "the deviation of the air-fuel ratio of the engine when the air-fuel ratio imbalance among cylinders is occurring". That is, for example, when "the air-fuel ratio imbalance among cylinders" is occurring in which only the air-fuel ratio of the first cylinder deviates by 20%, the imbalance ratio is 20%. In contrast, the actual imbalance ratio is 0%, when each of the air-fuel ratios of each of the cylinders uniformly deviates by 5% (20%/four cylinders), however, the imbalance ratio in this case is treated as 20% in FIG. 9. From a comparison between the solid line in FIG. 9 and the dotted line in FIG. 9, it can be understood that "it is possible to determine that "the air-fuel ratio imbalance is occurring, when the sub FB learning value becomes equal to or larger than the abnormality determining threshold Ath". It should be noted that the sub FB learning value does not increase as shown by the dotted line in FIG. 9 in practice, since the main feedback control is performed when the air-fuel ratio imbalance among cylinders is not occurring.

(Actual Operation)

The actual operation of the present monitoring apparatus will next be described. It should be noted that "MapX(a1, a2, . . . ) represents a table to obtain the value X based on arguments (parameters) a1, a2, . . . . Further, when the argument (parameter) is a detected value of a sensor, a current detected value of the sensor is used for the argument. Furthermore, "statusN" represents "status" which is obtained when the status is set at N (N=0, 1, 2). The statusN represents a progress of learning of the sub FB learning value Vafsfbg (temporal integral term SDVoxs) described later, i.e., the statusN indicates a degree of convergence (stability) of the sub FB learning value Vafsfbg.

<Fuel Injection Amount Control>

Figure 10:
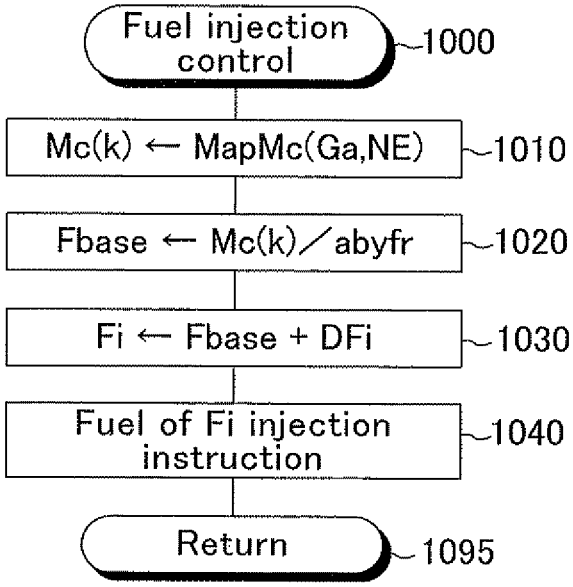
FIG. 10 is a flowchart showing a routine executed by a CPU of an electric controller shown in FIG. 1.

The CPU repeatedly executes a routine shown by a flowchart in FIG. 10, to calculate an fuel injection amount Fi and instruct an fuel injection, every time the crank angle of any one of the cylinders reaches a predetermined crank angle before its intake top dead center (e.g., BTDC 90° CA), for the cylinder (hereinafter, referred to as "an fuel injection cylinder") whose crank angle has reached the predetermined crank angle. Accordingly, at an appropriate timing, the CPU starts a process from step 1000, and performs processes from step 1010 to step 1040 in this order, and thereafter, proceeds to step 1095 to end the present routine tentatively.

Step 1010: The CPU obtains "a cylinder intake air amount Mc(k)" which is "an air amount introduced into the fuel injection cylinder", by applying "the intake air flow rate Ga measured by the air flowmeter 51, and the engine rotational speed NE" to a look-up table MapMc(Ga, NE). The cylinder intake air amount Mc(k) is stored in the RAM, while being related to the intake stroke of each cylinder. The cylinder intake air amount Mc(k) may be calculated based on a well-known air model (a model constructed according to laws of physics describing and simulating a behavior of an air in the intake passage).

Step 1020: The CPU obtains a base fuel injection amount Fbase by dividing the cylinder intake air amount Mc(k) by the target upstream-side air-fuel ratio abyfr. The target upstream-side air-fuel ratio abyfr is set to (at) the stoichiometric air-fuel ratio, with the exception of special cases described later.

Step 1030: The CPU calculates a final fuel injection amount Fi by correcting the base fuel injection amount Fbase with a main feedback amount DFi (more specifically, by adding the main feedback amount DFi to the base fuel injection amount Fbase). The main feedback amount DFi will be described later.

Step 1040: The CPU sends an instruction signal to "the injector 25 disposed so as to correspond to the fuel injection cylinder" in order to inject a fuel of the instructed fuel injection amount Fi from the injector 25.

In this way, the amount of fuel injected from each of the injectors 25 is uniformly increased and decreased based of the main feedback amount DFi commonly used for all of the cylinders.

It should be noted that the CPU performs fuel cut operation (hereinafter, referred to as a "FC control"). The FC control is a control to stop the fuel injection. The FC control is started when a following fuel cut start condition is satisfied, and stopped when a following fuel cut completion (return) condition is satisfied. The fuel injection is stopped from a timing at which the fuel cut start condition is satisfied to a timing at which the fuel cut completion condition is satisfied. That is, the final fuel injection amount Fi at step 1030 in FIG. 10 is set at "0".

Fuel Cut Start Condition

The fuel cut start condition is satisfied, when the throttle valve opening TA is "0" (or the operation amount Accp is "0"), and the engine rotational speed NE is equal to or higher than a fuel cut start rotational speed NEFCth.

Fuel Cut Completion (Return) Condition

The fuel cut completion (return) condition is satisfied, when the throttle valve opening TA (or the operation amount Accp) becomes larger than "0" while the fuel cut operation is being performed, or when the engine rotational speed NE becomes equal to or lower than a fuel cut completion rotational speed NERTth which is smaller than the fuel cut start rotational speed NEFCth while the fuel cut operation is being performed.

<Calculation of the Main Feedback Amount>

Figure 11:
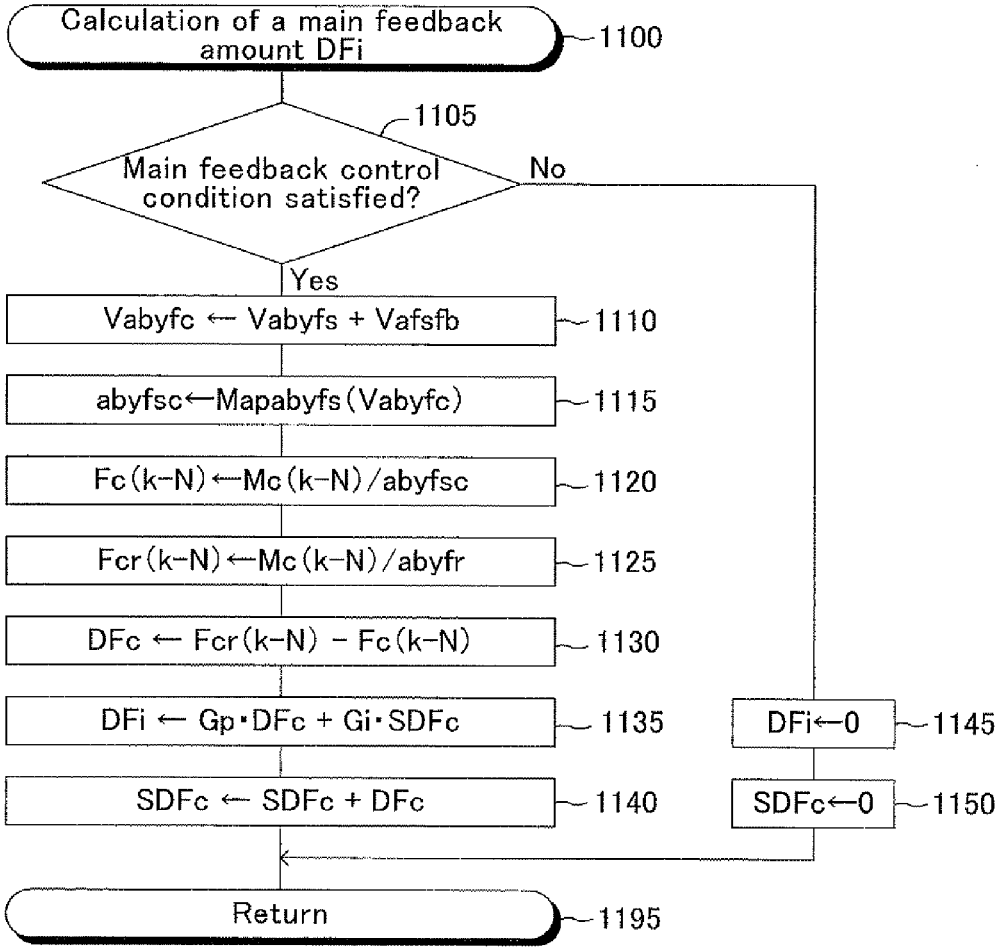
FIG. 11 is a flowchart showing a routine executed by the CPU of the electric controller shown in FIG. 1 for calculating a main feedback amount.

The CPU repeatedly executes a routine, shown by a flowchart in FIG. 11, for the calculation of the main feedback amount, every time a predetermined time period elapses. Accordingly, at an appropriate predetermined timing, the CPU starts the process from step 1100 to proceed to step 1105 at which CPU determines whether or not a main feedback control condition (an upstream-side air-fuel ratio feedback control condition) is satisfied.

The main feedback control condition is satisfied when all of the following conditions are satisfied, for example.

(A1) The upstream air-fuel ratio sensor 55 has been activated.

(A2) The load (load rate) KL of the engine is smaller than or equal to a threshold value KLth.

(A3) An operating state of the engine 10 is not in a fuel-cut operation.

It should be noted that the load rate KL is obtained based on the following formula (1). The accelerator pedal operation amount Accp, the throttle valve opening angle TA, and the like can be used instead of the load rate KL, as a parameter representing the load of the engine. In the formula (1), Mc(k) is the cylinder intake air amount, ρ is an air density (unit is (g/l), L is a displacement of the engine 10 (unit is (l)), and "4" is the number of cylinders of the engine 10.

$$KL=(Mc(k)/(\rho\cdot L/4))\cdot 100\% \quad (1)$$

The description continues assuming that the main feedback control condition is satisfied. In this case, the CPU makes a "Yes" determination at step 1105 to execute processes from steps 1110 to 1140 described below in this order, and then proceed to step 1195 to end the present routine tentatively.

Step 1110: The CPU obtains an output value Vabyfc for a feedback control, according to a formula (2) described below. In the formula (2), Vabyfs is the output value of the upstream air-fuel ratio sensor 55, Vafsfb is the sub feedback amount calculated based on the output value Voxs of the downstream air-fuel ratio sensor 56. These values are currently obtained values. The way by which the sub feedback amount Vafsfb is calculated will be described later.

$$Vabyfc=Vabyfs+Vafsfb \quad (2)$$

Step 1115: The CPU obtains, as shown by a formula (3) described below, an air-fuel ratio abyfsc for a feedback control by applying the output value Vabyfc for a feedback control to the air-fuel ratio conversion table Mapabyfs shown in FIG. 6.

$$abyfsc=Mapabyfs(Vabyfc) \quad (3)$$

Step 1120: According to a formula (4) described below, the CPU obtains "a cylinder fuel supply amount Fc(k−N)" which is "an amount of the fuel actually supplied to the combustion chamber 21 for a cycle at a timing N cycles before the present time". That is, the CPU obtains the cylinder fuel supply amount Fc(k−N) through dividing "the cylinder intake air amount Mc(k−N) which is the cylinder intake air amount for the cycle the N cycles (i.e., N·720° crank angle) before the present time" by "the air-fuel ratio abyfsc for a feedback control".

$$Fc(k-N)=Mc(k-N)/abyfsc \quad (4)$$

The reason why the cylinder intake air amount Mc(k−N) for the cycle N cycles before the present time is divided by the air-fuel ratio abyfsc for a feedback control in order to obtain the cylinder fuel supply amount Fc(k−N) is because "the exhaust gas generated by the combustion of the mixture in the combustion chamber 21" requires time "corresponding to the N cycles" to reach the upstream air-fuel ratio sensor 55. It should be noted that, in practical, a gas formed by mixing the exhaust gases from the cylinders in some degree reaches the upstream air-fuel ratio sensor 55.

Step 1125: The CPU obtains "a target cylinder fuel supply amount Fcr(k−N)" which is "a fuel amount which was supposed to be supplied to the combustion chamber 21 for the cycle the N cycles before the present time", according to a formula (5) described below. That is, the CPU obtains the target cylinder fuel supply amount Fcr(k−N) by dividing the cylinder intake air amount Mc(k−N) for the cycle the N cycles before the present time by the target upstream-side air-fuel ratio abyfr.

$$Fcr(k-N)=Mc(k-N)/abyfr \quad (5)$$

As described before, the target upstream-side air-fuel ratio abyfr is set at the stoichiometric air-fuel ratio during a normal operating state. On the other hand, the target upstream-side air-fuel ratio abyfr is set at a predetermined air-fuel ratio leaner (in the lean side) than the stoichiometric air-fuel ratio when a lean air-fuel ratio setting condition is satisfied for the purpose of avoiding a generation of an emission odor due to sulfur and so on. In addition, the target upstream-side air-fuel ratio abyfr may be set at an air-fuel ratio richer (in the rich side) than the stoichiometric air-fuel ratio when one of following conditions is satisfied.

when a present time is within a predetermined period after a stoppage (completion) of the fuel-cut control, and when an operating condition of the engine 10 is in an operating state (high load operating state) in which an overheat of the upstream-side catalytic converter 43 should be prevented.

Step 1130: The CPU obtains "an error DFc of the cylinder fuel supply amount", according to a formula (6) described below. That is, the CPU obtains the error DFc of the cylinder fuel supply amount by subtracting the cylinder fuel supply amount Fc(k−N) from the target cylinder fuel supply amount Fcr(k−N). The error DFc of the cylinder fuel supply amount represents excess and deficiency of the fuel supplied to the cylinder the N cycle before the present time.

$$DFc=Fcr(k-N)-Fc(k-N) \quad (6)$$

Step 1135: The CPU obtains the main feedback amount DFi, according to a formula (7) described below. In the formula (7) below, Gp is a predetermined proportion gain, and Gi is a predetermined integration gain. Further, "a value SDFc" in the formula (7) is "an integrated value (temporal integrated value) of the error DFc of the cylinder fuel supply amount". That is, the CPU calculates "the main feedback amount DFi" based on a proportional-integral control to have the air-fuel ratio abyfsc for a feedback control coincide with the target upstream-side air-fuel ratio abyfr, $$DFi=Gp\cdot DFc+Gi\cdot SDFc \quad (7)$$

Step 1140: The CPU obtains a new integrated value SDFc of the error DFc of the cylinder fuel supply amount by adding the error DFc of the cylinder fuel supply amount obtained at the step 1130 to the current integrated value SDFc of the error DFc of the cylinder fuel supply amount.

As described above, the main feedback amount DFi is obtained according to the proportional-integral control. The main feedback amount DFi is reflected in (onto) the final fuel injection amount Fi by the process of step 1030 in FIG. 10.

Meanwhile, "the sub feedback amount Vafsfb" in the right-hand side of the formula (2) above is small and is limited to a small value, compared to the output value Vabyfs of the upstream-side air-fuel ratio sensor 55. Accordingly, "the sub feedback amount Vafsfb" may be considered as "a supplement correction amount" to have "the output value Voxs of the downstream air-fuel sensor 56" coincide with "a target downstream-side value Voxsref which is a value corresponding to the stoichiometric air-fuel ratio". The air-fuel ratio abyfsc for a feedback control is therefore said to be a value substantially based on the output value Vabyfs of the upstream air-fuel ratio sensor 55. That is, the main feedback amount DFi can be said to be a correction amount to have "the air-fuel ratio of the engine represented by the output value Vabyfs of the upstream air-fuel ratio sensor 55" coincide with "the target upstream-side air-fuel ratio (the stoichiometric air-fuel ratio)".

At the determination of step 1105, if the main feedback condition is not satisfied, the CPU makes a "No" determination at step 1105 to proceed to step 1145 at which the CPU sets the value of the main feedback amount DFi at "0". Subsequently, the CPU stores "0" into the integrated value SDFc of the error of the cylinder fuel supply amount at step 1150. Thereafter, the CPU proceeds to step 1195 to end the present routine tentatively. As described above, when the main feedback condition is not satisfied, the main feedback amount DFi is set to (at) "0". Accordingly, the correction for the base fuel injection amount Fbase with the main feedback amount DFi is not performed.

<Calculation of the Sub Feedback Amount and the Sub FB Learning Value>

Figure 12:
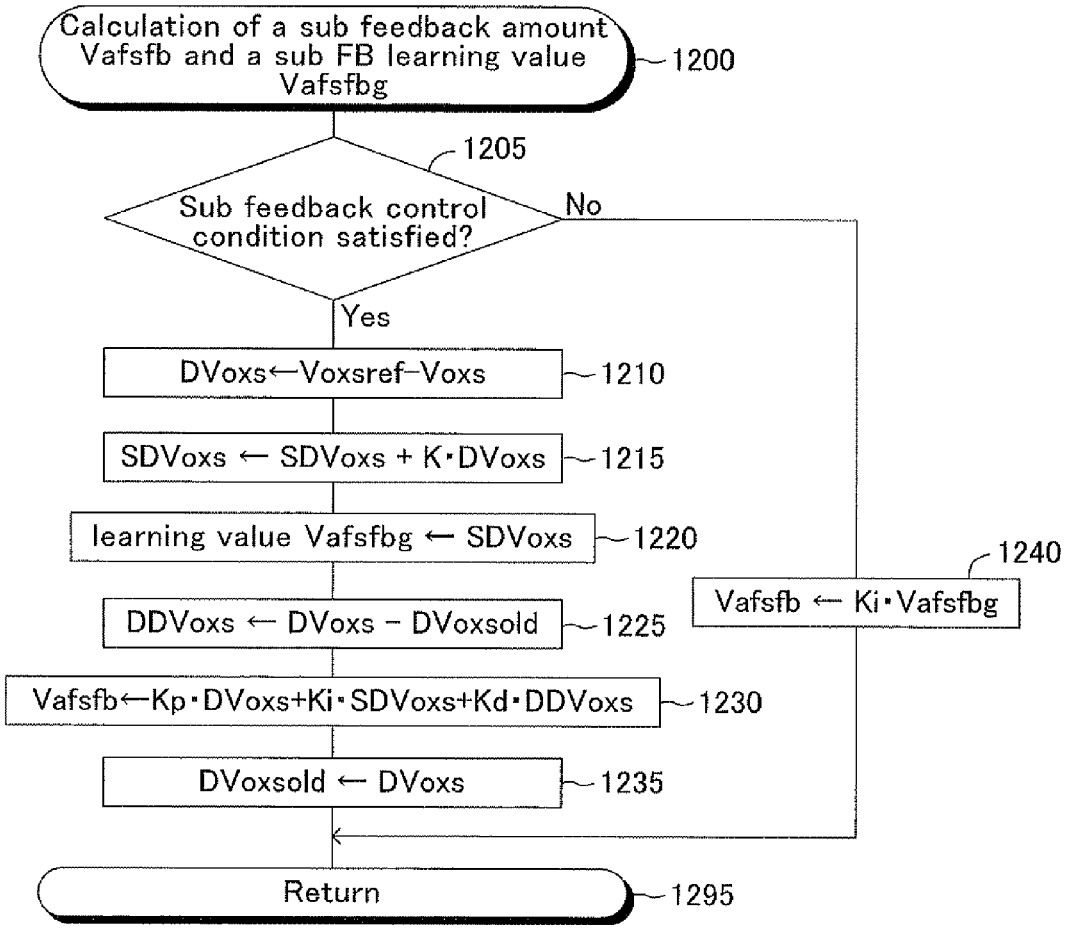
FIG. 12 is a flowchart showing a routine executed by the CPU of the electric controller shown in FIG. 1 for calculating the sub feedback amount and the learning value (sub FB learning value) of the sub feedback amount.

The CPU executes a routine shown in FIG. 12 every time a predetermined time period elapses in order to calculate "the sub feedback amount Vafsfb" and "the learning value (the sub FB learning value) Vafsfbg of the sub feedback amount Vafsfb". Accordingly, at an appropriate timing, the CPU starts the process from step 1200 to proceed to step 1205 at which CPU determines whether or not a sub feedback control condition is satisfied.

The sub feedback control condition is satisfied when all of the following conditions are satisfied. It should be noted that the sub feedback control condition is the same as a learning condition of the sub feedback amount. However, other conditions (e.g., the load KL is within a predetermined region, or the like) may be added to the learning condition of the sub feedback amount, in addition to the sub feedback control condition.

(B1) The main feedback control condition is satisfied.

(B2) The downstream air-fuel ratio sensor 56 has been activated.

(B3) The target upstream-side air-fuel ratio is set at the stoichiometric air-fuel ratio.

(B4) A predetermined time corresponding to the number of times L to prohibition of updating has elapsed since a timing immediately after the completion of the fuel cut (FC) control. The number of prohibition times L of updating will be described later.

The description continues assuming that the sub feedback control condition is satisfied. In this case, the CPU makes a "Yes" determination at step 1205 to execute processes from steps 1210 to 1230 described below in this order, to calculate the sub feedback amount Vafsfb.

Step 1210: The CPU obtains "an error amount of output DVoxs" which is a difference between "the target downstream-side value Voxsref" and "the output value Voxs of the downstream air-fuel ratio sensor 56", according to a formula (8) described below. That is, the CPU obtains "the error amount of output DVoxs" by subtracting "the current output value Voxs of the downstream air-fuel ratio sensor 56" from "the target downstream-side value Voxsref". The target downstream-side value Voxsref is set to (at) the value Vst (0.5 V) corresponding to the stoichiometric air-fuel ratio.

$$DVoxs = Voxsref - Voxs \quad (8)$$

Step 1215: The CPU updates (obtains), according to a formula (9) described below, a temporal integrated value SDVoxs (an integrated value SDVoxs of the error amount of output) which is used in a formula (10) described below. That is, the CPU obtains the new temporal integrated value SDVoxs (updates the temporal integrated value SDVoxs) by adding "a product K·DVoxs of the error amount of output DVoxs obtained at step 1210 and a value K" to "the current temporal integrated value SDVoxs" stored in the backup RAM as "the sub FB learning value Vafsfbg" as described later.

$$SDVoxs = SDVoxs + K \cdot DVoxs \quad (9)$$

In the formula (9) described above, the value K is an adjustment value, which is set/varied as described later. Thus, an updating amount per one time (occasion) of the temporal integrated value SDVoxs is the value K·DVoxs obtained by multiplying the error amount of output DVoxs by the adjustment value K. By setting/varying the adjustment K, the updating amount per one time of the temporal integrated value SDVoxs is set/varied.

Step 1220: The CPU stores "the temporal integrated value SDVoxs" obtained at step 1215 into the backup RAM as "the sub FB learning value Vafsfbg". That is, the CPU performs the learning of the sub feedback amount Vafsfb at step 1215 and step 1220.

Step 1225: The CPU obtains a new differential value (temporal differential value) DDVoxs by subtracting "a previous error amount of the output DVoxsold calculated when the present routine was executed at a previous time" from "the error amount of output DVoxs calculated at the step 1210".

Step 1230: The CPU obtains, according to a formula (10) described below, the sub feedback amount Vafsfb. In the formula (10) below, Kp is a predetermined proportion gain (proportional constant), Ki is a predetermined integration gain (integration constant), and Kd is a predetermined differential gain (differential constant). Kp·DVoxs in the formula (10) corresponds to a proportional term, Ki·SDVoxs corresponds to a temporal integral term, and Kd·DDVoxs corresponds to a time-derivative term. The newest (last) value (i.e. the learning value Vafsfbg) of the temporal integrated value SDVoxs, which is stored in the backup RAM, is utilized to obtain the temporal integral term Ki·SDVoxs.

$$Vafsfb = Kp \cdot DVoxs + Ki \cdot SDVoxs + Kd \cdot DDVoxs \quad (10)$$

Step 1235: The CPU stores "the error amount of output DVoxs calculated at the step 1210" as "the previous error amount of the output DVoxsold".

The temporal integrated value SDVoxs converges on (come close to) a certain value (convergent value SDVoxs1), when the sub feedback control (i.e., the update of the sub feedback amount Vafsfb) is performed stably for a sufficiently long time. In other words, the convergent value SDVoxs1 corresponds to a value according to a steady-state component of the sub feedback amount. The convergent value SDVoxs1 is, for example, a value corresponding to an error in measuring the intake air amount by the air flowmeter 51, an error in detecting the air-fuel ratio by the upstream air-fuel ratio sensor 55, and so on.

In this way, "the CPU calculate the sub feedback amount Vafsfb" according to a proportional-integral-differential (PID) control to have the output value Voxs of the downstream air-fuel ratio sensor 56 coincide with the target downstream-side value Voxsref. As shown in the formula (2) described above, the sub feedback amount Vafsfb is used to calculate the output value Vabyfc for a feedback control.

By the processes described above, the sub feedback amount Vafsfb and the sub FB learning value Vafsfbg are updated every time the predetermined period elapses.

In contrast, when the sub feedback control condition is not satisfied, the CPU makes a "No" determination at step 1205 in FIG. 12 to proceed to step 1240 at which the CPU sets "a value of the sub feedback amount Vafsfb" to (at) a product (ki·Vafsfbg=ki·SDVoxs) of "the sub FB learning value Vafsfbg stored in the backup RAM" and "the integration gain Ki". Thereafter, the CPU proceeds to step 1295 to end the present routine tentatively. In this way described above, the main feedback control and the sub feedback control are carried out.

<Initialization of Status>

Operations of the CPU for initializing "status" representing the progress of the leaning, etc, will next be described.

"statusN" (N=0, 1, or 2) is defined as follows. It should be noted that "the degree (state) of convergence of the sub FB learning value Vafsfbg" with respect to (relative to) its convergent value of the sub FB learning value Vafsfbg may be referred to simply as "the state of convergence of the sub FB learning value", hereinafter.

status0 (status being "0"): The state of convergence of the sub FB learning value Vafsfbg is not sufficient. That is, a state of status0 means "an unstable state" in which the sub FB learning value Vafsfbg is (deviates) away from "the convergent value SDVoxs1" and "a changing speed (updating rate) of the sub FB learning value Vafsfbg" is large".

status2 (status being "2"): The state of convergence of the sub FB learning value Vafsfbg is sufficient (excellent). That is, a state of status2 means "a stable state" in which the sub FB learning value Vafsfbg is stable in the vicinity of the convergent value SDVoxs1.

status1 (status being "1"): The state of convergence of the sub FB learning value Vafsfbg is a state (a quasi-stable state) between the stable state and the unstable state.

Hereinafter, for convenience of description, it is assumed that the present time is immediately after the start of the engine 10, and "the battery to supply the electric power to the electric controller 60" was swapped (replaced) before the start of the engine 10. The CPU executes "a status initialization routine" shown by a flowchart in FIG. 13 every time a predetermined time elapses after the start of the engine 10.

Therefore, at an appropriate timing after the start of the engine 10, the CPU starts a process from step 1300 to proceed to step 1310 at which the CPU determines whether or not the present time is immediately after the start of the engine 10.

Under the assumption described above, the present time is immediately after the start of the engine 10. Therefore, the CPU makes a "Yes" determination at step 1310 to proceed to step 1320 at which the CPU determines whether or not "the battery to supply the electric power to the electric controller 60" has been swapped. According to the assumption described above, the battery was swapped beforehand. Therefore, the CPU makes a "Yes" determination at step 1320 to proceed to step 1330 at which the CPU sets/updates the status to (at) "0". A value of "the status" is stored in the backup RAM every time the value of the status is updated.

Subsequently, the CPU proceeds to step 1340 to clear a counter CI (i.e., sets the counter CI to (at) "0"), and sets "the sub FB learning value Vafsfbg which is the temporal integrated value SDVoxs stored in the backup RAM" to (at) "0 (initial value, default)" at step 1345. Thereafter, the CPU proceeds to step 1395 to end the present routine tentatively.

It should be noted that when the CPU determines that the battery has not been swapped at step 1320, the CPU makes a "No" determination at step 1320 to proceed to step 1350 to read out (fetch) the status stored in the backup RAM.

After these processes, the CPU makes a "No" determination at step 1310 to proceed directly to step 1395 to end the present routine tentatively.

<Setting of the Adjustment Value K and the Number of Prohibition Times L of Updating>

Operations of the CPU for setting the adjustment value K and the number of prohibition times L of updating will next be described. The number of prohibition times L of updating indicates the number of times of prohibiting updating "the temporal integrated value SDVoxs at step 1215 in FIG. 12" after the FC control is stopped. The number of prohibition times L of updating is set at a value larger than the times of the fuel injection corresponding to an execution period of a rich control after FC control. The rich control after FC control is to set the target upstream-side air-fuel ratio to (at) a rich air-fuel ratio smaller than the stoichiometric air-fuel ratio for a predetermined period of time after the FC control is stopped.

Figure 14:
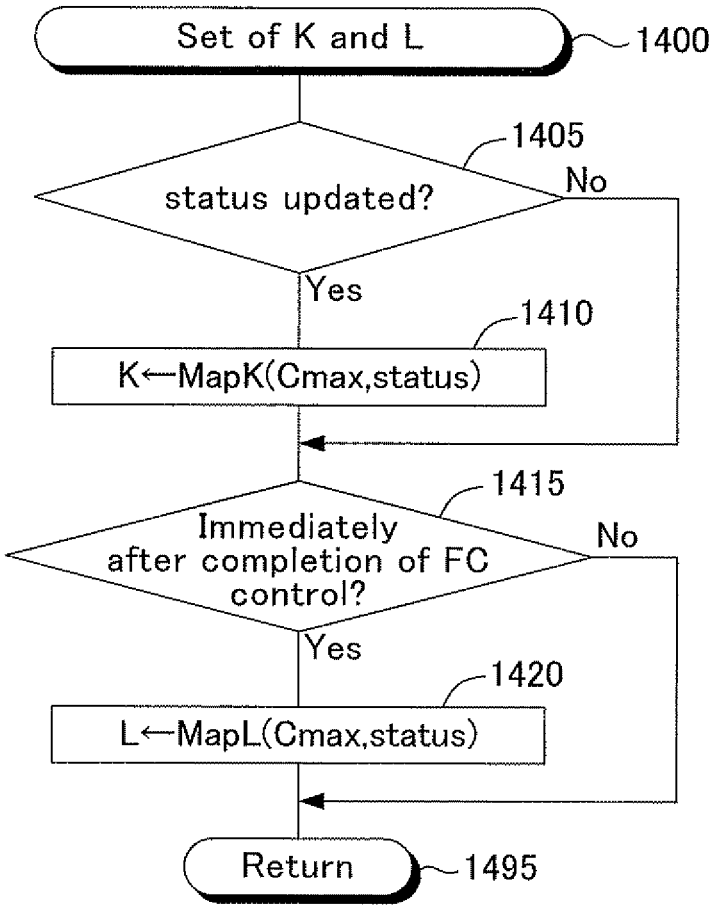
FIG. 14 is a flowchart showing a routine executed by the CPU of the electric controller shown in FIG. 1.

In order to set the adjustment value K and the number of prohibition times L of updating, the CPU repeatedly executes a routine shown by a flowchart in FIG. 14 every time a predetermined time elapses or every time a fuel injection timing arrives for a cylinder which is about to be in its intake stroke, after the start of the internal combustion engine 10.

Therefore, at an appropriate timing after the start of the internal combustion engine 10, the CPU starts the process from step 1400 in FIG. 14 to proceed to step 1405 at which CPU determines whether or not the status is updated. The update of the status includes the initialization of the status at step 1330 in FIG. 13.

Figure 13:
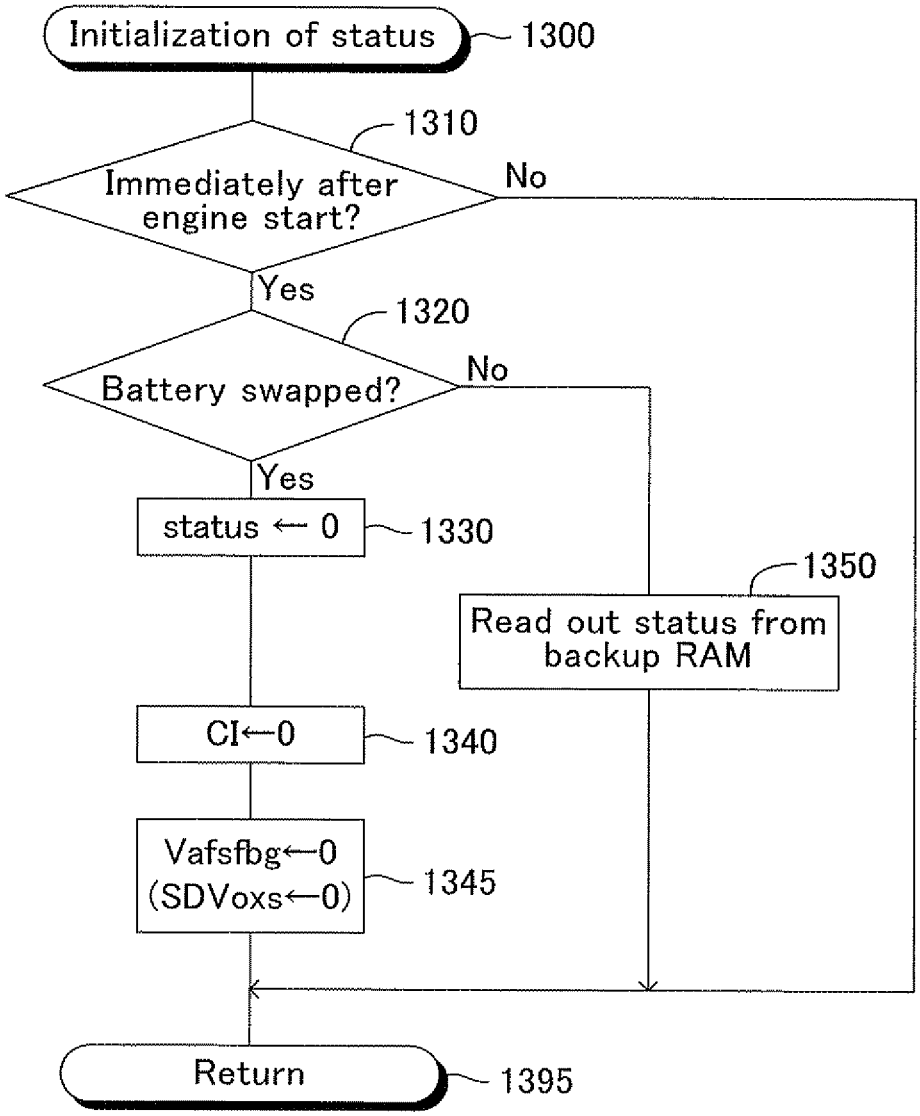
FIG. 13 is a flowchart showing a routine executed by the CPU of the electric controller shown in FIG. 1.

The present time is immediately after the status is set at (updated to be) "0" at step 1330 in FIG. 13. Therefore, the CPU makes a "Yes" determination at step 1405 to proceed to step 1410 at which the CPU determines (obtains) the adjustment value K based on a table MapK(Cmax, status).

Figure 15:
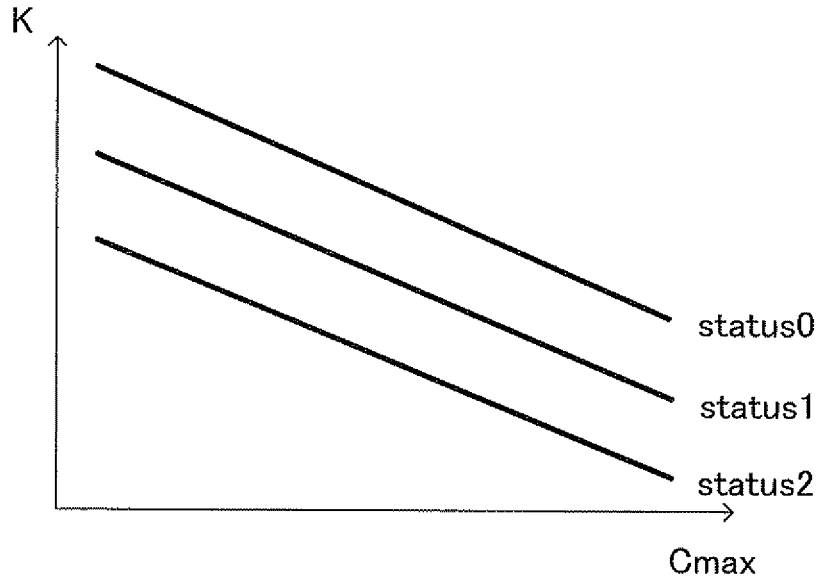
FIG. 15 is a graph showing a look up table to which the CPU of the electric controller shown in FIG. 1 refers.

FIG. 15 shows the table MapK(Cmax, status) which defines (determines) a relationship between "a maximum oxygen storage amount Cmax of the upstream-side catalytic converter 43, and the status" and the adjustment value K. According to the table MapK(Cmax, status), when the maximum oxygen storage amount Cmax is a certain constant value, the adjustment value K is determined in such a manner that the adjustment value K at status0 is larger than the adjustment value K at status1, and the adjustment value K at status1 is larger than the adjustment value K at status2. As described, a "one to one" relation between the adjustment value K and the value of the status is maintained, when the maximum oxygen storage amount Cmax is constant. The status is set at "0" at the present time. Therefore, the adjustment value K is set to (at) a large value. Further, according to the table MapK (Cmax, status), the adjustment value K is determined in such a manner that the adjustment value K becomes smaller as the maximum oxygen storage amount Cmax becomes larger, at each status. It should be noted that the adjustment value K set here is referred to as "a first value".

As described above, the adjustment value K is used when the temporal integrated value SDVoxs is updated (changed) at step 1215 in FIG. 12. Therefore, the changing speed of the temporal integrated value SDVoxs when the status is "0" is larger than the changing speed of the temporal integrated value SDVoxs when the status is "1" or "2". In other words, the changing speed of sub FB learning value Vafsfbg is large when the status is "0" (refer to step 1215 and step 1220 in FIG. 12).

It should be noted that the maximum oxygen storage amount Cmax of the upstream-side catalytic converter 43 is obtained separately according to so called an active air-fuel ratio control. The active air-fuel ratio control is a well known control, described, for example, in Japanese Patent Application Laid-Open (kokai) No. Hei 5-133264, etc., Accordingly, the detail description of the active air-fuel ratio control is omitted. The maximum oxygen storage amount Cmax is stored/set into the backup RAM every time it is obtained. The maximum oxygen storage amount Cmax is read out (fetched) from the backup RAM when it is used to calculate various parameters (such as the adjustment value K and the number of prohibition times L of updating).

Subsequently, the CPU proceeds to step 1415 to determine whether or not the present time is immediately after the completion of the FC control. When a "No" determination is made at step 1415, the CPU proceeds directly to step 1495 to end the present routine tentatively. In contrast, when a "Yes" determination is made at step 1415, the CPU proceeds to step 1420 to determine (obtain) the number of prohibition times L of updating according to a table MapL(Cmax, status), and thereafter, proceeds to step 1495 to end the present routine tentatively.

Figure 16:
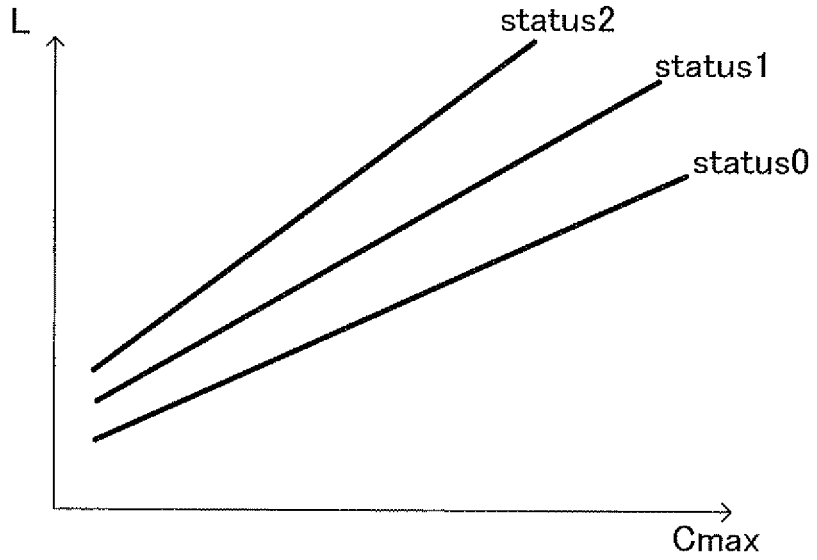
FIG. 16 is a graph showing a look up table to which the CPU of the electric controller shown in FIG. 1 refers.

FIG. 16 shows the table MapL(Cmax, status) which defines (determines) a relationship between "a maximum oxygen storage amount Cmax of the upstream-side catalytic converter 43, and the status" and the number of prohibition times L of updating. According to the table MapL(Cmax, status), when the maximum oxygen storage amount Cmax is a certain constant value, the number of prohibition times L of updating is determined in such a manner that the number of prohibition times L of updating at status0 is smaller than the number of prohibition times L of updating at status1, and the number of prohibition times L of updating at status1 is smaller than the number of prohibition times L of updating at status2. A period corresponding to the number of prohibition times L of updating set here is referred to as "a first period". Further, according to the table MapL(Cmax, status), the number of prohibition times L of updating is determined in such a manner that the number of prohibition times L of updating becomes larger as the maximum oxygen storage amount Cmax becomes larger, at each status.

After these processes, the CPU always makes a "No" determination at step 1405, and executes the processes of step 1405 and step 1415 until the condition at step 1405 is satisfied. In addition, when the CPU proceeds to step 1415 immediately after the FC control, the number of prohibition times L of updating is set again.

<Status Determination (First Status Determination)>

Figure 17:
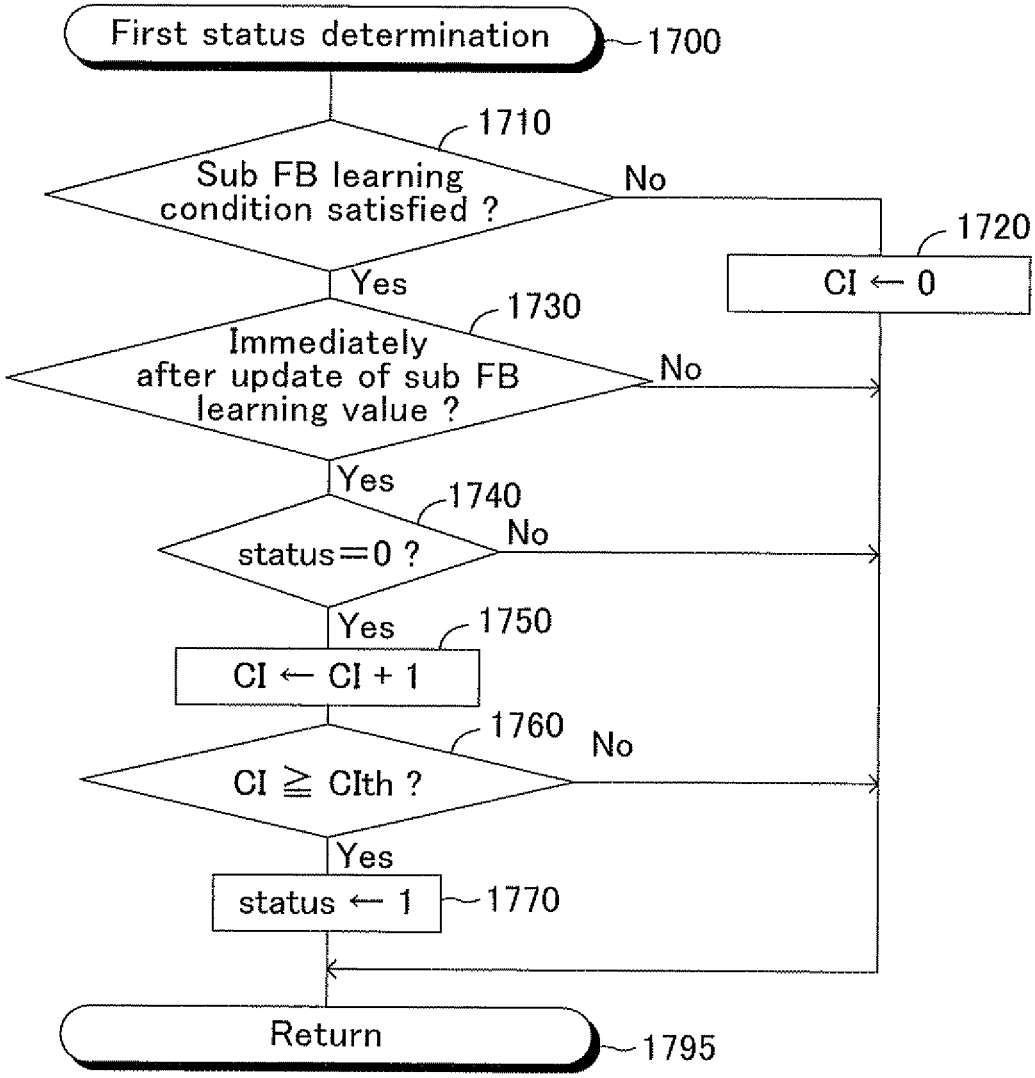
FIG. 17 is a flowchart showing a routine executed by the CPU of the electric controller shown in FIG. 1.

In order to determine and change (the value of) the status, the CPU executes "a first status determination routine" shown by a flowchart in FIG. 17 every time a predetermined time elapses. Therefore, at an appropriate timing, the CPU starts the process from step 1700 in FIG. 17 to proceed to step 1710 at which CPU determines whether or not the sub FB learning condition is satisfied. If the sub FB learning condition is not satisfied, the CPU makes a "No" determination at step 1710 to proceed to step 1720. Then, the CPU sets the counter CI to (at) "0" at step 1720, and thereafter, proceeds directly to step 1795 to end the present routine tentatively. It should be noted that the counter CI is set to (at) "0" by an unillustrated initialization routine executed when an unillustrated ignition key switch is changed from the off-position to the on-position of a vehicle on which the engine 10 is mounted.

In contrast, if the sub FB learning condition is satisfied when the CPU proceeds to step 1710, the CPU makes a "Yes" determination at step 1710 to proceed to step 1730 at which the CPU determines whether or not the present time is immediately after "a timing at which the sub FB learning value Vafsfbg is updated/changed (i.e., whether or not the present time is immediately after the processes of step 1215 and step 1220 in FIG. 12 were performed).

If the present time is not immediately after "the timing at which the sub FB learning value Vafsfbg is updated", the CPU makes a "No" determination at step 1730 to proceed directly to step 1795 to end the present routine tentatively.

In contrast, if the present time is immediately after "the timing at which the sub FB learning value Vafsfbg is updated" when the CPU proceeds to step 1730, the CPU makes a "Yes" determination at step 1730 to proceed to step 1740 at which the CPU determines whether or not the status is "0". At this time, if the status is not "0", the CPU makes a "No" determination at step 1740 to proceed directly to step 1795 to end the present routine tentatively.

In contrast, if the status is "0" when the CPU proceeds to step 1740, the CPU makes a "Yes" determination at step 1740 to proceed to step 1750 at which the CPU increments the counter CI by "1". Subsequently the CPU proceeds to step 1760 to determine whether or not the counter CI is equal to or larger than a first update times threshold CIth. At this time, if the counter CI is smaller than the first update times threshold CIth, the CPU makes a "No" determination at step 1760 to proceed directly to step 1795 to end the present routine tentatively.

In contrast, if the counter CI is equal to or larger than the first update times threshold Clth when the CPU proceeds to step 1760, the CPU makes a "Yes" determination at step 1760 to proceed to step 1770 at which the CPU sets (updates) the status to (at) "1".

In this way, in a case in which the status is "0", when the sub FB learning value Vafsfbg is updated/changed certain times equal to or larger than first update times threshold CIth, the status is changed to "1". This is because, when the sub FB learning value Vafsfbg is updated first update times threshold Clth or more, it is determined/inferred that the sub FB learning value Vafsfbg has come close to the convergent value to some degree. It should be noted that step 1720 may be omitted. In addition, the counter CI may be set to (at) "0" at step 1770. Further, the routine shown in FIG. 17 itself may be omitted.

<Status Determination (Second Status Determination)>

Figure 18:
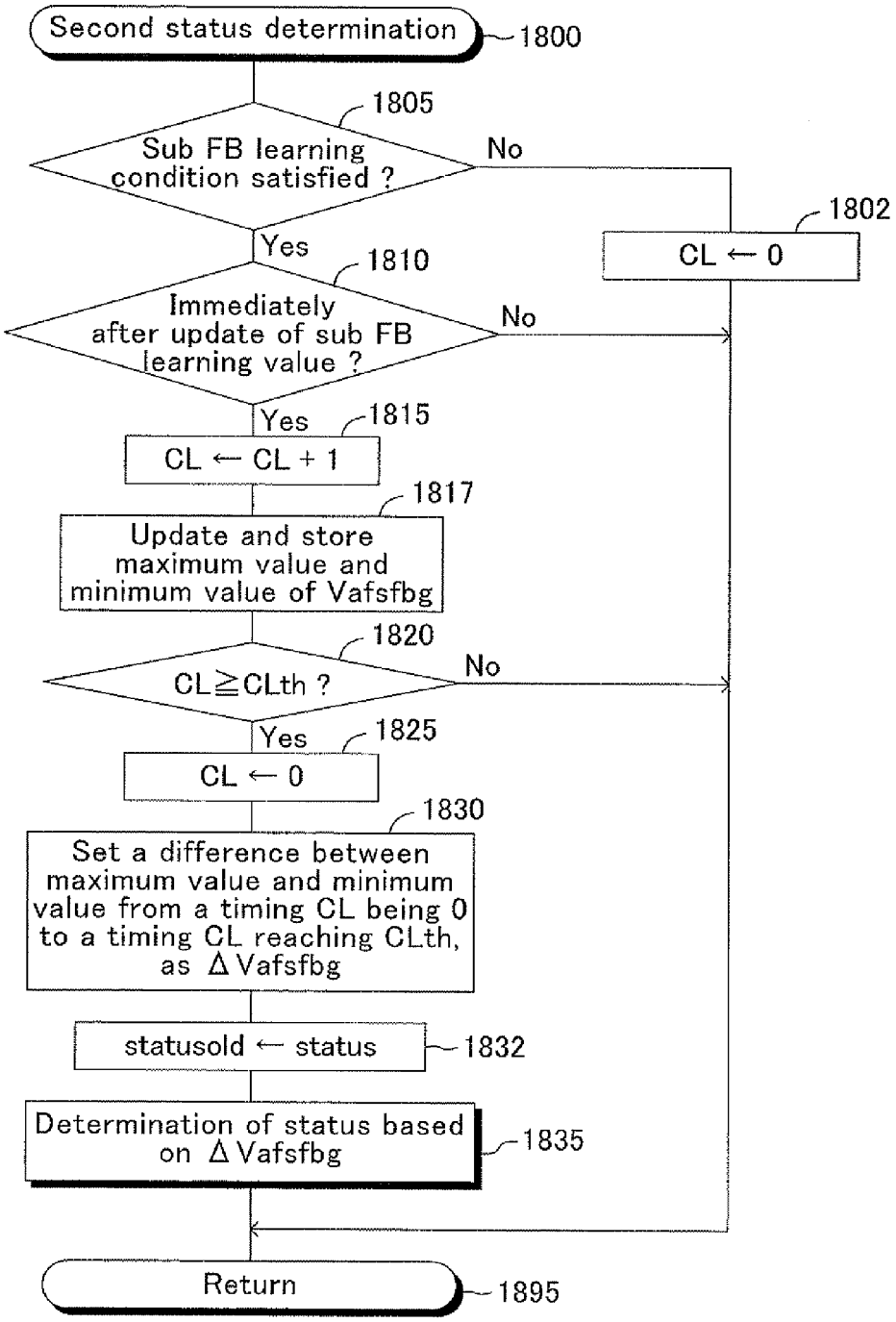
FIG. 18 is a flowchart showing a routine executed by the CPU of the electric controller shown in FIG. 1.

In order to determine and change (the value of) the status, the CPU executes "a second status determination routine" shown by a flowchart in FIG. 18 every time a predetermined time elapses. The description is made under the assumption that the status was set to (at) "0" at step 1330 in FIG. 13 since "the battery to supply the electric power to the electrical control unit 60" was swapped before the current start of the engine 10, and the sub FB learning value Vafsfbg (temporal integrated value SDVoxs) was set to (at) "0" at step 1345. Further, it is assumed that the present time is immediately after the start of the engine 10.

At an appropriate timing, the CPU starts the process from step 1800 in FIG. 18 to proceed to step 1805 at which CPU determines whether or not the sub FB learning condition is satisfied. The sub FB learning condition is not generally satisfied immediately after the start of the engine 10. Therefore, the CPU makes a "No" determination at step 1805 to proceed to step 1802 to set the counter CL to (at) "0". It should be noted that the counter CL is set to (at) "0" by the initialization routine described above. Thereafter, the CPU proceeds directly to step 1895 to end the present routine tentatively.

In this case, the CPU proceeds from step 1205 to step 1240 in FIG. 12, and thus, the sub feedback amount Vafsfb (=ki·Vafsfbg=ki·SDVoxs) is calculated based on the sub FB learning value Vafsfbg (temporal integrated value SDVoxs) stored in the backup RAM. In other words, since step 1215 and step 1220 in FIG. 12 are not executed, the sub FB learning value Vafsfbg (temporal integrated value SDVoxs) is maintained at "0".

Thereafter, when the engine 10 is continuously operated, the sub feedback control condition and the sub FB learning condition are satisfied. This allows the routine shown in FIG. 12 to update the sub feedback amount Vafsfb. At this time, the initialization of the status (setting to "0") is performed at step 1330 in FIG. 13, and therefore, the adjustment value K is set at "the adjustment value K when the status is "0" owing to the processes at step 1405 and 1410 in FIG. 14.

Under this state, when the CPU proceeds to step 1805 in FIG. 18, the CPU makes a "Yes" determination at step 1805 to proceed to step 1810. The CPU determines, at step 1810, whether or not the present time is immediately after the timing at which the sub FB learning value Vafsfbg is (has been) updated/changed. If the present time is not immediately after the timing at which the sub FB learning value Vafsfbg is updated, the CPU makes a "No" determination at step 1810 to proceed directly to step 1895 to end the present routine tentatively.

In contrast, when the present time is immediately after the timing at which the sub FB learning value Vafsfbg is updated, the CPU makes a "Yes" determination at step 1810 to proceed to step 1815 to increment the counter CL by "1". Subsequently, the CPU proceeds to step 1817 to renew a maximum value and a minimum value of the sub FB learning value Vafsfbg (in the present example, temporal integrated value SDVoxs). The maximum value and the minimum value of the sub FB learning value Vafsfbg are a maximum value and a minimum value of the sub FB learning value Vafsfbg, respectively, in a period from when the counter CL is "0" to when the counter CL reaches a second update times threshold CLth used in the next step 1820.

Subsequently, the CPU proceeds to step 1820 to determine whether or not the counter CL is equal to or larger than the second update times threshold CLth. If the counter CL is smaller than the second update times threshold CLth, the CPU makes a "No" determination at step 1820 to proceed directly to step 1895 to end the present routine tentatively.

Thereafter, as time goes by, the process at step 1815 is performed every time the sub FB learning value Vafsfbg is updated (renewed). Therefore, the counter CL reaches the second update times threshold CLth. At this time, when the CPU proceeds to step 1820, the CPU makes a "Yes" determination at step 1820 to proceed to step 1825 to set the counter CL to (at) "0".

Subsequently, the CPU proceeds to step 1830 to obtain a difference between "the maximum value and the minimum value" of the sub FB learning value Vafsfbg in the period from when the counter CL is "0" to when the counter CL reaches the second update times threshold CLth, as a width of variation ΔVafsfbg in (of) the sub FB learning value Vafsfbg. The width of variation ΔVafsfbg is referred to as a second parameter relating to the learning value Vafsfbg. Further, the CPU clears the maximum value and the minimum value of the sub FB learning value Vafsfbg at this step.

Subsequently, the CPU proceeds to step 1832 to store the newest (last) status (i.e., statusnow which is the status at the current determination timing, described later) into the backup RAM as a previous status (i.e., statusold which is the status at the previous determination timing). In other words, the statusold is the status the predetermined state determination period (which is the period from when the counter CL is "0" to when the counter CL reaches the second update times threshold CLth) before.

Subsequently, the CPU proceeds to step 1835 to start the process from step 1900 of a sub routine shown in FIG. 19. The CPU proceeds to step 1905 (subsequent to step 1900) to determine whether or not the status is "0". Under the assumption described above, the status is "0", and therefore, the CPU makes a "Yes" determination at step 1905 to proceed to step 1910 to determine whether or not the width of variation ΔVafsfbg obtained at step 1830 in FIG. 18 is equal to or smaller than a first width of variation threshold ΔVth. The first width of variation threshold ΔVth is a positive constant.

In the mean time, according to the assumption described above, the sub FB learning value Vafsfbg (temporal integrated value SDVoxs) is set to (at) "0" at step 1345 in FIG. 13, because the battery was swapped before the start of the engine. In this case, generally, a difference between the sub FB learning value Vafsfbg and the convergent value SDVoxs1 is large, and thus, the changing speed (rate) of the sub feedback amount and the changing speed (rate) of the sub FB learning value Vafsfbg are large. Accordingly, the width of variation ΔVafsfbg is larger than the first width of variation threshold ΔVth. Therefore, the CPU makes a "No" determination at step 1910 to proceed to step 1970 at which the CPU stores the current status (i.e., "0") into the backup RAM as the current (newest, last) status (i.e., the statusnow at the current determination timing). Subsequently, the CPU proceeds to step 1895 in FIG. 18 through step 1995. As a result, the status is maintained at "0".

Under this state, since the status is "0", the adjustment value K is large (refer to step 1410 in FIG. 14 and FIG. 15). Accordingly, the updating amount per one time (occasion) K·DVoxs (an absolute value of the K·DVoxs) of the temporal integrated value SDVoxs is set at a large value. That is, the large adjustment value K allows the sub feedback amount Vafsfb and the temporal integrated value SDVoxs (i.e., the sub FB learning value Vafsfbg) to be updated (changed) rapidly. In addition, the number of prohibition times L of updating is set at a small value every time the FC control is completed (refer to step 1420 in FIG. 14, and FIG. 16). Therefore, in a case in which the FC control is performed, the temporal integrated value SDVoxs is maintained at a constant value for a relatively short period corresponding to the number of prohibition times L of updating, after the FC control is stopped.

Accordingly, the sub FB learning value Vafsfbg (temporal integrated value SDVoxs) comes closer to (converges on) the convergent value SDVoxs1 at a large changing speed from "0 (initial value, default)". That is, the sub FB learning value Vafsfbg (temporal integrated value SDVoxs) comes close to the convergent value SDVoxs1 within a relatively short time. The changing speed (updating rate) of the sub FB learning value Vafsfbg (temporal integrated value SDVoxs) is referred to as "a first rate, or a first updating speed). That is, the changing speed (updating rate) of the sub FB learning value Vafsfbg based on the adjustment value K determined when the status is "0" is referred to as a first changing speed.

While this state continues, the sub FB learning value Vafsfbg comes close to the convergent value SDVoxs1, and varies in the vicinity of the convergent value SDVoxs1 relatively moderately. Consequently, the width of variation ΔVafsfbg obtained at step 1835 in FIG. 18 becomes equal to or smaller than the first width of variation threshold ΔVth. At this time, when the CPU proceeds step 1905 and step 1910 both in FIG. 19 through step 1835 in the routine shown in FIG. 18, the CPU makes a "Yes" determination at step 1910 to proceed to step 1915 to set the status to (at) "1". Thereafter, the CPU proceeds to step 1970 at which the CPU stores the current status (i.e., "1") into the backup RAM as the current (newest, last) status (i.e., the statusnow). Subsequently, the CPU proceeds to step 1895 in FIG. 18 through step 1995.

It should be noted that even in a case in which the condition at step 1910 is not satisfied when the status is "0", the status is changed to "1" at step 1770 if the condition at step 1760 (the condition that the counter CI is equal to or larger than the first update times threshold Clth) is satisfied. In this case, the statusnow may be set to (at) "1", and the statusold may be set to (at) "0".

After the status is set/changed to (at) "1", when the CPU repeatedly executing the routine in FIG. 14 proceeds to step 1405, the CPU makes a "Yes" determination at step 1405. Thereafter, the CPU proceeds to step 1410 to determine the adjustment value K based on the table MapK(Cmax, status). Thus, the adjustment value K is set/changed to (at) a medium value (refer to FIG. 15). It should be noted that the adjustment value K which is set at this timing is referred to as "a second value".

Further, after this point of time, the number of prohibition times L of updating is set based on the table MapL(Cmax, status) at step 1420 every time the FC control is completed. In this case, the number of prohibition times L of updating is set to (at) a medium value (refer to FIG. 16). A period corresponding to the number of prohibition times L of updating set here is referred to as "a second period".

When the status is changed from "0" to "1" as described above, the adjustment value K which has been set at the large value is set/changed to (at) the medium value, the updating amount per one time (occasion) K·DVoxs (an absolute value of the K·DVoxs) of the temporal integrated value SDVoxs is also set to (at) a medium value. Further, the number of prohibition times L of updating is set to (at) the medium value every time the FC control is completed.

Accordingly, when the status is change from "0" to "1", the sub FB learning value Vafsfbg (temporal integrated value SDVoxs) comes closer to or converge on the convergent value SDVoxs1 at a medium speed from a value relatively close to the convergent value SDVoxs1. The changing speed (updating rate) of the sub FB learning value Vafsfbg (temporal integrated value SDVoxs) is referred to as "a second changing speed, or a second updating speed/rate". That is, the changing speed (updating rate) of the sub FB learning value Vafsfbg based on the adjustment value K determined when the status is "1" is referred to as the second changing speed.

Figure 19:
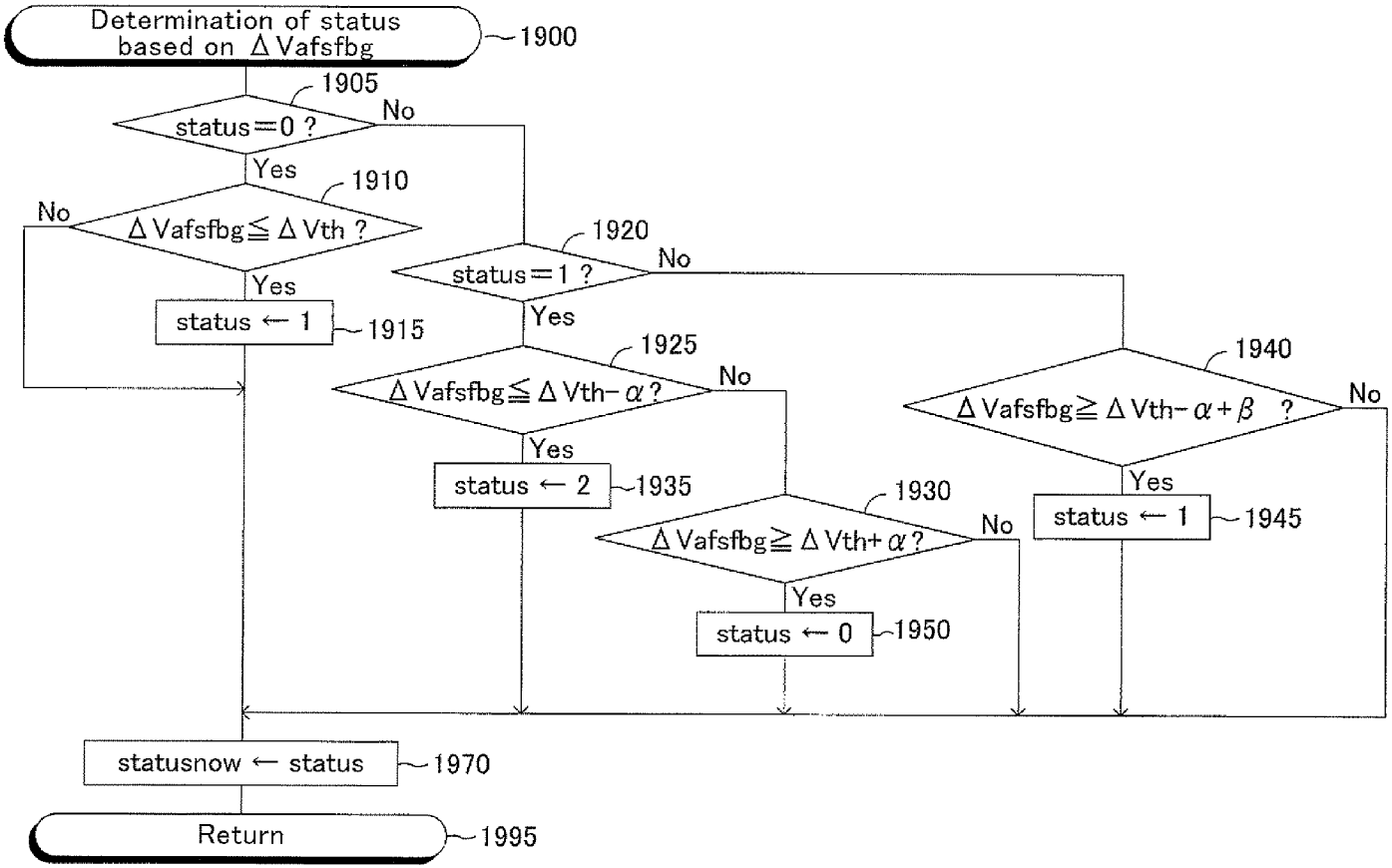
FIG. 19 is a flowchart showing a routine executed by the CPU of the electric controller shown in FIG. 1.

After this point of time, when the CPU proceeds to step 1905 in FIG. 19 through step 1835 in FIG. 18, the CPU makes a No determination at step 1905, since the status is set at "1". Therefore, the CPU proceeds to step 1920 to determine whether or not the status is "1". In this case, the CPU makes a "Yes" determination at step 1920 to proceed to step 1925 to determine whether or not the width of variation ΔVafsfbg is equal to or smaller than a second width of variation threshold (ΔVth−α). The value a is a predetermined positive value. The second width of variation threshold (ΔVth−α) is a positive value, and is smaller than the first width of variation threshold ΔVth. It should be noted that the value α may be "0" (this also applies to the following description).

The present time is immediately after the status is changed from "0" to "1", the width of variation ΔVafsfbg is larger than the second width of variation threshold (ΔVth−α). Therefore, the CPU makes a "No" determination at step 1925 to proceed to step 1930 to determine whether or not the width of variation ΔVafsfbg is equal to or larger than a third width of variation threshold (ΔVth+α). The third width of variation threshold (ΔVth+α) is larger than the first width of variation threshold ΔVth.

Since the present time is immediately after the status is changed from "0" to "1", the width of variation ΔVafsfbg is generally smaller than the third width of variation threshold (ΔVth+α). Therefore, the CPU makes a "No" determination at step 1930 to proceed to step 1970 at which the CPU stores the current status (i.e., "1") into the backup RAM as the current (newest, last) status (i.e., the statusnow). Subsequently, the CPU proceeds to step 1895 in FIG. 18 through step 1995.

Here, it is assumed that the sub FB learning value Vafsfbg (temporal integrated value SDVoxs) is approaching the convergent value SDVoxs1 steadily. Under this assumption, when a certain time elapses, the width of variation ΔVafsfbg becomes equal to or smaller than the second width of variation threshold (ΔVth−α). At this time, when the CPU proceeds to step 1905 in FIG. 19 through step 1835 in the routine shown in FIG. 18, the CPU makes a "No" determination at step 1905, makes a "Yes" determination at step 1920 since the status is "1", and makes a "Yes" determination at step 1925. The CPU proceeds to step 1935 to set the status to (at) "2". Thereafter, the CPU proceeds to step 1970 at which the CPU stores the current status (i.e., "2") into the backup RAM as the current (newest, last) status (i.e., the statusnow). Subsequently, the CPU proceeds to step 1895 in FIG. 18 through step 1995.

Consequently, since the status is set/changed to (at) "2", when the CPU repeatedly executing the routine in FIG. 14 proceeds to step 1405, the CPU makes a "Yes" determination at step 1405 to proceed to step 1410 at which the CPU determines the adjustment value K based on the table MapK(Cmax, status). Thus, the adjustment value K is set/changed to (at) a small value (refer to FIG. 15). It should be noted that the adjustment value K which is set at this timing is referred to as "a third value".

Further, after this point of time, the number of prohibition times L of updating is set based on the table MapL(Cmax, status) at step 1420 every time the FC control is completed. In this case, the number of prohibition times L of updating is set to (at) a large value (refer to FIG. 16). A period corresponding to the number of prohibition times L of updating set here is referred to as "a third period".

When the status is changed from "1" to "2" as described above, and thus, the adjustment value K which has been set at the medium value is set/changed to (at) the small value, and the updating amount per one time (occasion) K·DVoxs (an absolute value of the K·DVoxs) of the temporal integrated value SDVoxs is also set to (at) a small value. Further, the number of prohibition times L of updating is set to (at) the large value every time the FC control is completed.

Accordingly, when the status is change from "1" to "2", the changing speed of the sub FB learning value Vafsfbg (temporal integrated value SDVoxs) becomes smaller than when the status is "1". The changing speed (updating rate) of the sub FB learning value Vafsfbg (temporal integrated value SDVoxs) is referred to as "a third changing speed, or a third updating speed/rate". That is, the changing speed (updating rate) of the sub FB learning value Vafsfbg based on the adjustment value K determined when the status is "2" is referred to as the third updating speed. In this state, the sub FB learning value Vafsfbg (temporal integrated value SDVoxs) is sufficiently close to the convergent value SDVoxs1. Therefore, the sub FB learning value Vafsfbg (temporal integrated value SDVoxs) is stably maintained a value in the vicinity of the convergent value SDVoxs, even when a disturbance occurs.

After the status is changed from "1" to "2", when the CPU proceeds to step 1905 in FIG. 19 through step 1835 in FIG. 18, the CPU makes a "No" determination at step 1905, and further CPU makes a "No" determination at step 1920, since the status is set at "2". Therefore, the CPU proceeds to step 1940 whether or not the width of variation ΔVafsfbg is equal to or larger than a fourth width of variation threshold (ΔVth−α+β). The value β is a predetermined positive value smaller than the value α. The fourth width of variation threshold (ΔVth−α+β) is a positive value, and is larger than the second width of variation threshold (ΔVth−α). It should be noted that the value β may be "0" (this also applies to the following description).

As described before, since the current status is "2", the sub FB learning value Vafsfbg (temporal integrated value SDVoxs) is stably maintained at a value in the vicinity of the convergent value SDVoxs1 even when a state which disturbs the air-fuel ratio (i.e., disturbance) occurs. Therefore, the width of variation ΔVafsfbg is smaller than the fourth width of variation threshold (ΔVth−α+β). Accordingly, the CPU makes a "No" determination at step 1940 to proceed to step 1970 at which the CPU stores the current status (i.e., "2") into the backup RAM as the current (newest, last) status (i.e., the statusnow). Subsequently, the CPU proceeds to step 1895 in FIG. 18 through step 1995.

Under this state, when a disturbance such as a misfire which greatly disturbs the air-fuel ratio occurs, and when a width of variation ΔSDVoxs of the temporal integrated value SDVoxs is equal to or larger than the fourth width of variation threshold (ΔVth−α+β) due to the disturbance, the CPU makes a "Yes" determination at step 1940 when it proceeds to step 1940. Thereafter, the CPU proceeds to step 1945 to set the status to (at) "1". Consequently, the adjustment value K is set (changed) to (at) the middle value (refer to FIG. 15), and the number of prohibition times L of updating is set (changed) to (at) the middle value (refer to FIG. 16). Thereafter, the CPU proceeds to step 1970 to store the current status (i.e., "1") into the backup RAM as the current (newest, last) status (i.e., the statusnow). Subsequently, the CPU proceeds to step 1895 in FIG. 18 through step 1995.

Further, while the status is "1", when the width of variation ΔVafsfbg of the temporal integrated value SDVoxs becomes larger than the third width of variation threshold (ΔVth+α), the CPU makes a "No" determination at step 1905, makes a "Yes" determination at step 1920, makes a "No" determination at step 1925, and makes a "Yes" determination at step 1930. Accordingly, the CPU proceeds to step 1950 to set the status to (at) "0". Consequently, the adjustment value K is set (changed) to (at) a large value (refer to FIG. 15), and the number of prohibition times L of updating is set (changed) to (at) a small value (refer to FIG. 16). Thereafter, the CPU proceeds to step 1970 to store the current status (i.e., "0") into the backup RAM as the current (newest, last) status (i.e., the statusnow). Subsequently, the CPU proceeds to step 1895 in FIG. 18 through step 1995.

As described before, the status is determined/set/changed based on "the width of variation ΔVafsfbg (width of variation ΔSDVoxs) in the predetermined period (that is, the period from when the counter CL is "0" to when the counter CL reaches the second update times threshold CLth, in other words, a period in which the sub FB learning value Vafsfbg is updated a predetermined times)", and the changing speed of the sub FB learning value Vafsfbg (temporal integrated value SDVoxs) (i.e., the adjustment value K) is changed based on the set status. Further, as described later, the status is used to determine whether to perform/execute the abnormality determination (the air-fuel ratio imbalance determination).

<Count of the Number of Times of Updating Learning Value>

Figure 20:
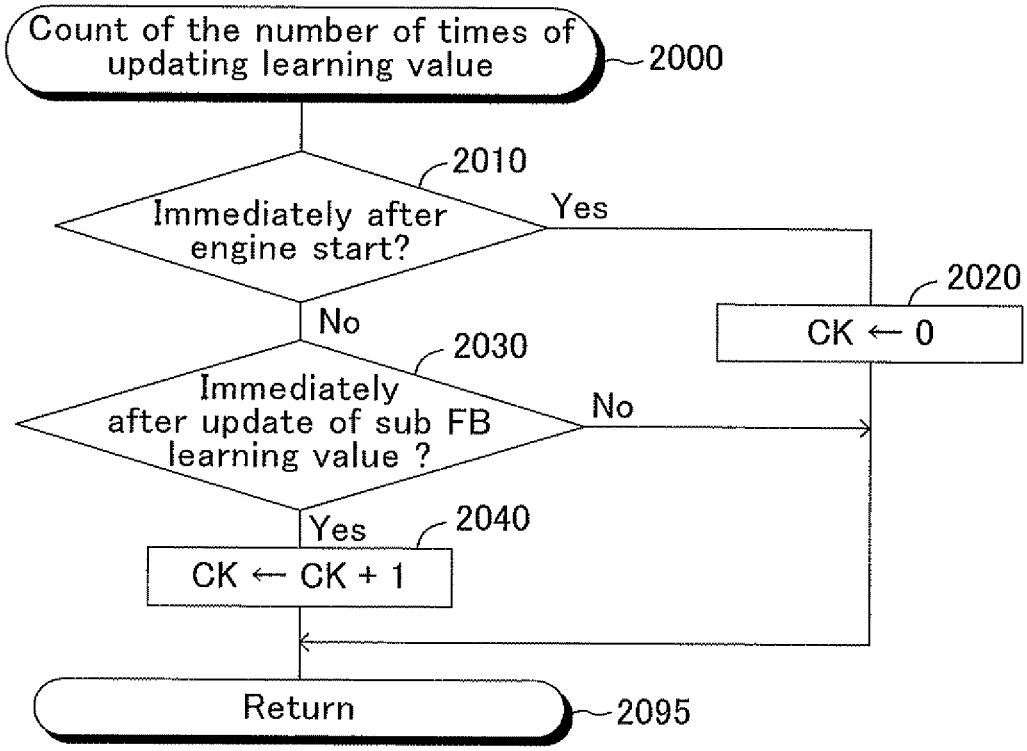
FIG. 20 is a flowchart showing a routine executed by the CPU of the electric controller shown in FIG. 1.

A way for updating counter CK which indicates the number of times of updating learning value will next be described, the counter CK being referred when the CPU determines whether to perform the air-fuel ratio imbalance determination described later. In order to update the counter CK, the CPU executes a "the number of times of updating learning value counting routine" shown by a flowchart in FIG. 20 every time a predetermined time elapses.

Therefore, at an appropriate timing, the CPU starts the process from step 2000 to proceed to step 2010 at which CPU determines whether or not the present timing is immediately after the start of the internal combustion engine 10. When the present timing is immediately after the start of the internal combustion engine, the CPU makes a "Yes" determination at step 2010 to proceed to step 2020 to set the counter CL to (at) "0". It should be noted that the counter CL is set to (at) "0" in the initialization routine described before.

When the present timing is not immediately after the start of the engine 10, the CPU makes a "No" determination at step 2010 to proceed to step 2030 at which the CPU determines whether or not the present time is immediately after the sub FB learning value Vafsfbg is (has been) updated. When the present time is not immediately after the sub FB learning value Vafsfbg is updated, the CPU makes a "No" determination at step 2030 to proceed directly to step 2095 to end the present routine tentatively.

In contrast, when the present time is immediately after the sub FB learning value Vafsfbg is updated, the CPU makes a "Yes" determination at step 2030 to proceed directly to step 2040 to increment the counter CL by "1". Thereafter, the CPU proceeds to step 2095 to end the present routine tentatively. In this way, the counter CL becomes a value indicating "the number of times of updating learning value" after the current start of the engine 10.

<Determination of the Air-Fuel Ratio Imbalance Among Cylinders (Determining/Monitoring the Abnormality State of the Engine)>

Processes for determining whether or not "the air-fuel ratio imbalance among cylinders" as the abnormality state of the engine will next be described. The CPU executes a "the air-fuel ratio imbalance determination routine" shown by a flowchart in FIG. 21 every time a predetermined time elapses.

According to the routine, an average of a plurality of values of the sub FB learning value Vafsfbg is obtained as "a sub FB learning value average Avefsfbg", the sub FB learning value Vafsfbg being values obtained when "an abnormality determination prohibiting condition" described later is not satisfied, and "an abnormality determination allowing condition" described later is satisfied (refer to step 2140 described later). In addition, the sub FB learning value average Avefsfbg is adopted as the first parameter (e.g., imbalance determining parameter), and it is determined that the abnormality state (e.g., the air-fuel ratio imbalance among cylinders) is occurring, when the sub FB learning value average Avefsfbg is equal to or larger than a threshold for abnormality determination Ath.

At an appropriate timing, the CPU starts the process from step 2100 to proceed to step 2105 at which CPU determines whether or not the abnormality determination (the air-fuel ratio imbalance among cylinders determination, or occasionally, misfire occurrence determination) prohibiting condition is satisfied. Hereinafter, this abnormality determination prohibiting condition is also referred to as "abnormality determination terminating condition". When the abnormality determination terminating condition is not satisfied, "a precondition for performing the abnormality determination" is satisfied. When the abnormality determination terminating condition is satisfied, the determination of "the air-fuel ratio imbalance among cylinders" using "the imbalance determining parameter calculated based on the sub FB learning value Vafsfbg" is not performed.

The abnormality determination terminating condition is satisfied, when any one of conditions from (C1) to (C6) described below is satisfied.

(C1) The main feedback control condition is not satisfied.

(C2) The sub feedback control condition is not satisfied.

(C3) The learning condition of the sub feedback amount is not satisfied.

(C4) The oxygen storage amount of the upstream-side catalytic converter 43 is equal to or smaller than a first oxygen storage amount threshold.

(C5) It is inferred that the upstream-side catalytic converter 43 is not activated.

(C6) A flow rate of the exhaust gas discharged from the engine 10 is equal to or larger than an exhaust gas flow rate threshold. That is, the intake air amount Ga measured by the air-flow meter 51 is equal to or larger than a threshold, or the engine load KL is equal to or larger than a threshold.

The reason why the condition (C4) is included is as follows.

When the oxygen storage amount of the upstream-side catalytic converter 43 is equal to or smaller than a first oxygen storage amount threshold, the hydrogen is not sufficiently purified in the upstream-side catalytic converter 43, and thus, the hydrogen may flow out to a position downstream of the catalytic converter 43. Consequently, there is a possibility that the output value Voxs of the downstream air-fuel ratio sensor 56 is affected by the preferential diffusion of hydrogen. In addition to, or alternatively, there is a possibility that an air-fuel ratio of a gas downstream of the catalytic converter 43 does not coincide with "the true average of the air-fuel ratio of the mixture supplied to the entire engine 10". Accordingly, it is likely that the output value Voxs of the downstream air-fuel ratio sensor 56 does not indicate a value corresponding to "the true average of the air-fuel ratio which is excessively corrected by the air-fuel ratio feedback control using the output value Vabyfs of the upstream air-fuel ratio sensor 55". Therefore, it is likely that, if the air-fuel ratio imbalance determination among cylinders is carried out under these states, the determination is erroneous.

It should be noted the oxygen storage amount of the upstream-side catalytic converter 43 is separately obtained according to a well known method. For example, the oxygen storage amount OSA of the upstream-side catalytic converter 43 is obtained by integrating (accumulates sequentially) an amount of an excessive oxygen flowing into the upstream-side catalytic converter 43, and by decreasing an amount of an excessive unburnt substances flowing into the upstream-side catalytic converter 43 from the amount OSA sequentially. That is, the oxygen storage amount OSA is obtained by obtaining an excess and deficiency amount ΔO2 of oxygen (ΔO2=k·mfr·(abyfs−stoich)) based on a difference between the upstream-side air-fuel ratio abyfs and the stoichiometric air-fuel ratio stoichi every time a predetermined time elapses (k is a ratio of oxygen to atmosphere, 0.23; mfr is an amount of fuel supplied for the predetermined time), and by integrating the excess and deficiency amount ΔO2 (refer to Japanese Patent Application Laid-Open No. 2007-239700, Japanese Patent Application Laid-Open No. 2003-336535, and Japanese Patent Application Laid-Open No. 2004-036475, etc.). It should be noted that the thus obtained oxygen storage amount OSA is limited to a value between the maximum oxygen storage amount Cmax of the upstream-side catalytic converter 43 and "0".

The reason why the condition (C6) is included is as follows.

When the flow rate of the exhaust gas discharged from the engine 10 is equal to or larger than the exhaust gas flow rate threshold, an amount of hydrogen flowing into the upstream-side catalytic converter 43 exceeds the ability (capacity) to oxidize hydrogen of the upstream-side catalytic converter 43, and therefore, the hydrogen may flow out to the position downstream of the upstream-side catalytic converter 43. Accordingly, it is likely that the output value Voxs of the downstream air-fuel ratio sensor 56 is affected by the preferential diffusion of hydrogen. Alternatively, an air-fuel ratio at the position downstream of the catalytic converter may not coincide with "the true average of the air-fuel ratio of the mixture supplied to the entire engine". Consequently, even when the air-fuel ratio imbalance among cylinders is occurring, it is likely that the output value Voxs of the downstream air-fuel ratio sensor 56 does not coincide with a value corresponding to "the true air-fuel ratio which is excessively corrected by the air-fuel ratio feedback control using the output value Vabyfs of the upstream air-fuel ratio sensor 55". Therefore, if the air-fuel ratio imbalance determination among cylinders is carried out under these states, it is likely that the determination is erroneous.

Further, the abnormality determination terminating condition is satisfied, when any one of the following conditions (D1)-(D3) is satisfied. The reasons why these conditions are included will be described later.

(D1) "The number of times of updating sub FB learning value Vafsfbg" after the current start of the engine 10 is smaller than "a threshold of the number of times of updating learning value". That is, the counter CK is smaller than a threshold of the number of the learning value updating CKth.

(D2) The statusnow which is the status (the newest status, the last status) at the current determination timing is equal to "0". That is, the state of convergence of the sub FB learning value Vafsfbg is not sufficient, and therefore, is in "the unstable state".

(D3) The statusold which is the status at the previous determination timing is equal to "2", and the statusnow (the newest status, the last status) which is the status at the current determination timing is equal to "1". That is, the state of convergence of the sub FB learning value Vafsfbg has changed from the stable state to the quasi-stable state.

Here, it is assumed that the all of conditions for the abnormality determination terminating condition are not satisfied (that is, all of the conditions (C1)-(C6) and the conditions (D1)-(D3) are unsatisfied). In other words, it is assumed that "the precondition for performing the abnormality determination" is satisfied.

Under this assumption, the CPU makes a "No" determination at step 2105 to proceed to step 2110 to determine whether or not "the abnormality determination allowing condition is satisfied". The abnormality determination allowing condition is satisfied when "a condition (E1) below is satisfied, and either a condition (E2) below or a condition (E3) below" is satisfied. The reason why these conditions are included will be described later. It should be noted that condition (E1) below may be omitted. In this case, the abnormality determination allowing condition is satisfied when either the condition (E2) below or the condition (E3) below is satisfied.

(E1) "The number of times of updating sub FB learning value Vafsfbg" after the current start of the engine 10 is equal to or larger than "the threshold of the number of times of updating learning value". That is, the counter CK is equal to or larger than the threshold of the number of the learning value updating CKth.

(E2) The statusnow which is the status (the newest status, the last status) at the current determination timing is equal to "2. That is, the state of convergence of the sub FB learning value Vafsfbg is sufficient, and therefore, is in "the stable state".

(E3) The statusnow (the newest status, the last status) which is the status at the current determination timing is equal to "1", and the statusold which is the status at the previous determination timing is "1". That is, the condition (E3) is satisfied when it is determined twice consecutively that the state of convergence of the sub FB learning value Vafsfbg is "the quasi-stable state". More specifically, the condition (E3) is satisfied when any one of "the processes at step 1915, the "No" determination at step 1930, and the process at step 1945" is carried out in two consecutive occasions, in each of which the routine shown in FIG. 19 is executed. The routine in FIG. 19 is executed every time "the period (predetermined state determination period) from when the counter CL is "0" to when the counter CL reaches the second update times threshold CLth" elapses. Accordingly, the condition (E3) can be said to be a condition satisfied when a state where the status is determined to be "1" continues over (for) the state determination period (predetermined first threshold period) or more.

When "the abnormality determination allowing condition" is satisfied, the CPU makes a "Yes" determination at step 2110 to execute appropriate processes from steps 2115 to 2160 described below. The processes from step 2115 are for the abnormality determination (the air-fuel ratio imbalance among cylinders determination).

Step 2115: The CPU determines whether or not the present time is "immediately after a timing (immediate after a timing of sub FB learning value update) at which the sub FB learning value Vafsfbg is updated (is try to be changed)". When the present time is the time immediately after the timing of sub FB learning value update, the CPU proceeds to step 2120. When the present time is not the time immediately after the timing of sub FB learning value update, the CPU proceeds directly to step 2195 to end the present routine tentatively.

Step 2120: The CPU increments a value of a learning value cumulative counter Cexe by "1".

Step 2125: The CPU reads (fetches) the sub FB learning value Vafsfbg which is stored into the backup RAM at step 1220 in FIG. 12.

Step 2130: The CPU updates a cumulative value Svafsfbg of the sub FB learning value. That is, the CPU adds "the sub FB learning value Vafsfbg read out (fetched) at step 2125" to "the present cumulative value Svafsfbg" in order to obtain the new cumulative value Svafsfbg.

The cumulative value Svafsfbg is set at "0" in the initialization routine described above. Further, the cumulative value Svafsfbg is set at "0" by a process of step 2160 described later. The process of the step 2160 is executed when the abnormality determination (the determination of the air-fuel ratio imbalance among cylinders, steps 2145-2155) is carried out. Accordingly, the cumulative value Svafsfbg is an integrated (cumulative) value of the sub FB learning value which is updated in a period in which "the abnormality determination terminating condition is not satisfied" after "the start of the engine or the last execution of the abnormality determination (refer to step 2105)", and in which "the abnormality determination allowing condition is satisfied (refer to step 2110)".

Step 2135: The CPU determines whether or not the value of the learning value cumulative counter Cexe is equal to or larger than a counter threshold Cth. When the value of the learning value cumulative counter Cexe is smaller than the counter threshold Cth, the CPU makes a "No" determination at step 2135 to directly proceed to step 2195 to end the present routine tentatively. In contrast, when the value of the learning value cumulative counter Cexe is equal to or larger than the counter threshold Cth, the CPU makes a "Yes" determination at step 2135 to proceed to step 2140.

Step 2140: The CPU obtains a sub FB learning value average Avesfbg (temporal average of the sub FB learning value Vafsfbg) by dividing "the cumulative value Svafsfbg of the sub FB learning value Vafsfbg" by "the learning value cumulative counter Cexe". The sub FB learning value average Avesfbg is the imbalance determining parameter (the first parameter for abnormality determination) which increases as the difference between the amount of hydrogen included in the exhaust gas which has not passed through the upstream-side catalytic converter 43 and the amount of hydrogen included in the exhaust gas which has passed through the upstream-side catalytic converter 43 increases. In other words, the first parameter for abnormality determination is a value varying depending on the learning value Vafsfbg (a value which increases as the learning value Vafsfbg increases), and calculated based on the learning value Vafsfbg.

Step 2145: The CPU determines whether or not the sub FB learning value average Avesfbg is equal to or larger than an abnormality determining threshold Ath. As described above, when the air-fuel ratio non-uniformity (imbalance) among cylinders becomes excessively large, and "the air-fuel ratio imbalance among cylinder" is therefore occurring, the sub feedback amount Vafsfb changes to "a value which corrects (causes) the air-fuel ratio of the mixture supplied to the engine 10 to be shifted to the richer side in a great amount, and accordingly, the sub FB learning value average Avesfbg which is the average value of the sub FB learning value Vafsfbg also changes to "the value to correct/cause the air-fuel ratio of the mixture supplied to the engine 10 to be shifted to the richer side in a great amount (a value equal to or larger than the threshold value Ath).

Accordingly, when the sub FB learning value average Avesfbg is equal to or larger than the abnormality determining threshold value Ath, the CPU makes a "Yes" determination at step 2145 to proceed to step 2150 at which the CPU sets a value of an abnormality occurring flag XIJO to (at) "1". That is, when the value of the abnormality occurring flag XIJO is "1", it is indicated that the air-fuel ratio imbalance among cylinders is occurring. It should be noted that the value of the abnormality occurring flag XIJO is stored in the backup RAM. When the value of the abnormality occurring flag XIJO is set to (at) "1", the CPU may turn on a warning light which is not shown.

In contrast, when the sub FB learning value average Avesfbg is smaller than the abnormality determining threshold value Ath, the CPU makes a "No" determination at step 2145 to proceed to step 2155. At step 2155, the CPU sets the value of the abnormality occurring flag XIJO to (at) "0" in order to indicate that the air-fuel ratio imbalance among cylinders is not occurring.

Step 2160: The CPU proceeds to step 2160 from either step 2150 or step 2155 to set (reset) the value of the learning value cumulative counter Cexe to (at) "0", and set (reset) the cumulative value Svafsfbg of the sub FB learning value to (at) "0".

It should be noted that, when the CPU executes the process of step 2105 and the abnormality determination terminating condition is satisfied, the CPU makes a "Yes" determination at step 2105 to directly proceed to step 2160. Accordingly, the cumulative value Svafsfbg of the sub FB learning value which has been calculated is eliminated, when the abnormality determination terminating condition is satisfied.

Further, when the CPU executes the process of step 2110 and the abnormality determination allowing condition is not satisfied, the CPU directly proceeds to step 2195 to end the present routine tentatively. Accordingly, in this case, the cumulative value Svafsfbg of the sub FB learning value which has been calculated is not eliminated. In other words, only the sub FB learning value Vafsfbg when the abnormality determination allowing condition is satisfied is reflected to (or is used to obtain) the imbalance determining parameter (first parameter for abnormality determination).

Here, the reasons why the conditions (D1)-(D3) of the abnormality determination terminating condition and the conditions (E1)-(E3) of the abnormality determination allowing condition are provided will next be described.

<The Reasons why the Condition (D1) and the Condition (E1) are Provided>

When the data in the backup RAM is lost (eliminated) due to a removal of the battery from the vehicle, and so on, it takes a considerable time for "the convergence state of the learning value Vafsfbg" to change into "a state in which the abnormality determination is allowed (e.g., the status2)" after the start of the engine. Meanwhile, the convergence state of the learning value Vafsfbg comes close to the stable state, after a timing at which the number of update (renewal) of the learning value Vafsfbg (i.e., the counter CK) after the start of the engine reaches "the predetermined threshold of the number of the learning value updating CKth".

In contrast, in a case where the data in the backup RAM is not eliminated (lost), when "the convergence state of the learning value Vafsfbg" when the engine was stopped previously was, for example, the stable state (e.g., the status2), the abnormality determination is performed within a relatively short time after the current start of the engine. However, since there is a possibility that a state of the engine 10 in the current operation has changed, it is preferable that the abnormality determination (the air-fuel ratio imbalance among cylinders determination) be performed at least after the timing at which the number of update (renewal) of the learning value Vafsfbg (the counter CK) after the start of the engine reaches "the predetermined threshold of the number of the learning value updating CKth".

In view of the above, the condition (D1) and the condition (E1) are provided. That is, the CPU of the monitoring apparatus obtains the number of update of the learning value Vafsfbg after the start of the engine 10 (refer to the counter CK), and prohibits to perform the abnormality determination during a period in which "the obtained number of update of the learning value (the counter CK)" is smaller than "the predetermined number of learning update threshold (CKth)" (refer to the condition D1, and step 2105).

Further, the CPU of the present monitoring apparatus obtains the number of times of updating learning value (refer to the counter CK) after the start of the engine 10, and allows to perform the abnormality determination under the condition that "the obtained number of times of updating learning value (the counter CK)" is equal to or larger than "the threshold of the number of the learning value updating (CKth)" (refer to the condition E1, and step 2115).

This allows "the first parameter for abnormal determination" to be obtained based on the learning value Vafsfbg when the convergence state of the learning value is satisfactory, regardless of whether or not the data in the backup RAM is (lost) eliminated. Further, "a period (time) from a timing when the engine is started to a timing when the abnormal determination is performed" when the data in the backup RAM is lost can be the substantially same as that when the data in the backup RAM is not lost.

<The Reason why the Condition (D2) is Provided>

The fact that "the current (newest, last) status is 0 (refer to the condition D2, and step 2105) indicates that the state of convergence of the learning value Vafsfbg is not sufficient. In other words, when the condition D2 is satisfied, it is likely that "the sub FB learning value Vafsfbg is (deviates) away from the convergent value" and "the changing rate (speed) of the sub FB learning value Vafsfbg is large". Therefore, by terminating the abnormality determination when the condition (D2) is satisfied, it can be avoided that "the first parameter for abnormality determination (the imbalance determining parameter)" is calculated based on "the learning value Vafsfbg which is unlikely to be a value in the vicinity of the convergent value". Consequently, it can be avoided that the erroneous determination occurs.

<The Reason why the Condition (D3) is Provided>

The fact that "the statusold which is the status at the previous determination timing is equal to "2", and the statusnow which is the status at the current determination timing is equal to "1" (refer to the condition (D3), and step 2105) indicates that "the state of convergence of the learning value Vafsfbg is determined to be the stable state" has changed into "the state of convergence of the learning value Vafsfbg is determined to be the quasi-stable state".

Under such a state, it is considered (inferred) that the convergence state of the learning value Vafsfbg is changing "from the stable state to the quasi-stable state" due to some sort of reason (for example, the convergent value has changed rapidly, or a disturbance has occurred which causes the air-fuel ratio to greatly fluctuate (vary) temporally). In other words, it is likely that the learning value Vafsfbg under such a state is not a value in the vicinity of the convergent value. Therefore, by terminating the abnormality determination when the condition (D3) is satisfied, it can be avoided that "the first parameter for abnormality determination (the imbalance determining parameter)" is calculated based on "the learning value Vafsfbg which is unlikely to be a value in the vicinity of the convergent value". Consequently, it can be avoided that the erroneous determination occurs.

<The Reason why the Condition (E2) is Provided>

The fact that "the statusnow which is the status (newest status) at the current determination timing is equal to "2" (refer to the condition E2, and step 2110) indicates that "the state of convergence of the learning value Vafsfbg at the present time is sufficient (excellent), and thus, the learning value Vafsfbg is stably in the vicinity of the convergent value". Accordingly, by allowing to perform the abnormality determination when the condition (E2) (together with the above condition (E1)) is/are satisfied, "the first parameter for abnormality determination (the imbalance determining parameter)" can be calculated based on "the learning value Vafsfbg which is likely to be a value in the vicinity of the convergent value". Consequently, the abnormality determination can be performed with high accuracy.

<The Reason why the Condition (E3) is Provided>

The fact that "the statusnow which is the status at the current determination timing is equal to "1", and the statusold which is the status at the previous determination timing is equal to "1" (refer to the condition (E3)) indicates that the state in which the status is determined to be "1" continues over the predetermined state determination period (the first threshold period) or more. In this case, it is considered (inferred) that the convergence state of the learning value Vafsfbg is coming closer to the convergent value stably, and the learning value Vafsfbg is in the vicinity of the convergent value. Accordingly, also when the condition (E3) is satisfied, "the first parameter for abnormality determination (the imbalance determining parameter)" can be calculated based on "the learning value Vafsfbg which is likely to be a value in the vicinity of the convergent value". Further, there may be a case in which the execution of the abnormality determination is delayed, if the abnormality condition is allowed to be performed only when the condition (E2) (together with the condition (E1)) is/are satisfied. Therefore, by allowing to perform the abnormality determination when the condition (E3) (together with the condition (E1)) is/are satisfied, the abnormality determination can be performed at an early timing.

As described above, the monitoring apparatus according to the embodiment of the present invention can perform (execute) the abnormality determination using "the first parameter for abnormality determination" calculated based on "the learning value Vafsfbg" as early as possible and with high accuracy.

That is, the monitoring apparatus described in the present specification is applied to the multi-cylinder internal combustion engine 10, and comprises the injector 25, the catalytic converter 43, the upstream air-fuel ratio sensor 55, and the downstream air-fuel ratio sensor 56.

Further, the monitoring apparatus comprises;

sub feedback amount calculation means (the routine in FIG. 12) for calculating a sub feedback amount Vafsfb to make an air-fuel ratio represented by the output value Voxs of the downstream air-fuel ratio sensor 56 coincide with the stoichiometric air-fuel ratio every time a first update timing arrives (a timing at which the routine shown in FIG. 12 is executed);

fuel injection control means (the routines shown in FIGS. 11 and 10) for controlling an injection amount of fuel injected from the fuel injector every time a second update timing (a timing at which the routine shown in FIG. 11 is executed) arrives based on at least the output value Vafbyfs of the upstream air-fuel ratio sensor and the sub feedback amount Vafsfb in such a manner that "an air-fuel ratio of an air-fuel mixture supplied to the engine coincides with the stoichiometric air-fuel ratio";

learning means (step 1210 to step 1220 in FIG. 12, etc,) for updating (changing) the learning value Vafsfbg of the sub feedback amount every time a third timing (a timing at which the routine shown in FIG. 12 is executed) arrives in such a manner that the learning value Vafsfbg of the sub feedback amount comes closer to an amount corresponding to a steady-state component (ki·SDVoxs) of the sub feedback amount; and monitoring means (the routine shown in FIG. 21, especially, step 2145 to step 2155) for performing (executing) an abnormality determination as to whether or not an abnormality state of the engine (e.g., the air-fuel ratio imbalance among cylinders) is occurring based on the first parameter for the abnormality determination (the sub FB learning value average Avefsfbg) varying depending on the learning value.

Figure 21:
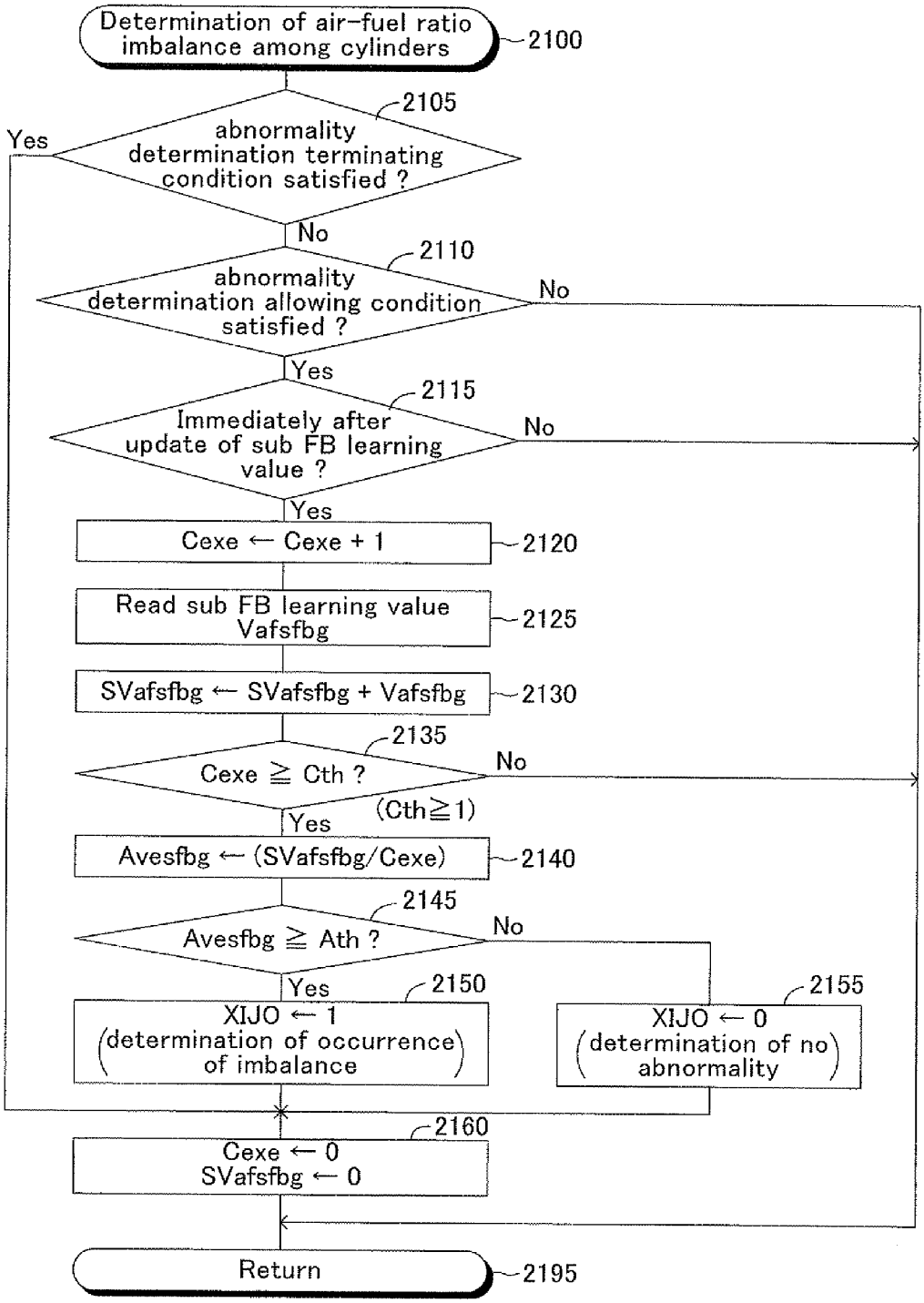
FIG. 21 is a flowchart showing a routine executed by the CPU of the electric controller shown in FIG. 1 for performing a determination of an air-fuel ratio imbalance among cylinders (abnormality determination).

Further, the monitoring apparatus comprises;

learning value changing speed setting means (the routine shown in FIG. 14, especially step 1405 and step 1410, and FIGS. 17-19) for setting a changing speed of the learning value at any one of a first changing speed, a second changing speed smaller than the first changing speed, and a third changing speed smaller than the second changing speed; and monitoring control means (step 2105 and step 2115 in FIG. 21, the condition (D2), the condition (D3), the condition (E2), and the condition (E3)) for allowing or prohibiting to perform (execute) the abnormality determination by the monitoring means, based on the set changing speed of the learning value (in the above example, based on a value of the status corresponding to the changing speed).

In addition, the learning value changing speed setting means is configured in such a manner that it determines, based on a second parameter (the width of variation ΔVafsfbg) relating to the learning value, which one of three states including:

(a) the stable state (status2) in which the learning value is in the vicinity of (close to) the convergent value and is stable;

(b) the unstable state (status0) in which the learning value greatly deviates from the convergent value and varies at a high speed (the changing rate is high); and (c) a quasi-stable state (status1) which is between the stable state and the unstable state is a convergence state of the learning value (the learning value Vafsfbg) with respect to the convergent value of the learning value (e.g., SDVoxs1) (the routines in FIGS. 18 and 19);

it sets the changing speed of the learning value to (at) the first changing speed when the convergence state of the learning value is determined to be the unstable state;

it sets the changing speed of the learning value to (at) the second changing speed when the convergence state of the learning value is determined to be the quasi-stable state; and it sets the changing speed of the learning value to (at) the third changing speed when the convergence state of the learning value is determined to be the stable state (refer to step 1410 in FIG. 14 and FIG. 15).

The monitoring control means is configured in such a manner that it allows to perform (execute) the abnormality determination by the monitoring means, when the convergence state of the learning value is determined to be the stable state (the status2), or in a case where a time period in which the convergence state of the learning value is determined to be the quasi-stable state (the status1) becomes equal to or longer than the predetermined first threshold period (step 2110, the condition (E2), and the condition (E3)).

It should be noted that the monitoring apparatus may be configured in such a manner that it measures a time period in which the value of the status is continued to be set at "1" after the value of the status is set at "1"; it determines whether or not the time period is equal to or longer than the first threshold period (the first threshold time); and it allows to perform (execute) the abnormality determination when the time period becomes equal to or longer than the first threshold period.

The learning value changing speed setting means is configured in such a manner that it obtains the width of variation (width of variation Vafsfbg) in the predetermined state determination period (the period from when the counter CL is "0" to when the counter CL reaches the threshold CLth) as the second parameter relating to the learning value every time the predetermined state determination period elapses; and it determines which one of the three states is the convergence state of the learning value, based on a comparison between the obtained width of variation in the learning value (width of variation ΔVafsfbg) and the predetermined threshold for determination (the first width of variation threshold ΔVth, the second width of variation threshold (ΔVth−α)), third width of variation threshold (ΔVth+α), and the fourth width of variation threshold (ΔVth−α+β) (refer to the routine in FIG. 19).

The monitoring control means is configured in such a manner that it allows to perform (execute) the abnormality determination by the monitoring means, when the convergence state of the learning value is determined to be the stable state (status2) (the condition (E2)), or when the convergence state of the learning value is determined to be the quasi-stable state (status1) twice consecutively (in a row) (the condition (E3)) (step 2110 in FIG. 21).

The learning value changing speed setting means is configured in such a manner that it determines whether or not the width of variation (the width of variation ΔVafsfbg) in (of) the learning value in the predetermined state determination period is smaller than the predetermined determination threshold for stable state (the first width of variation threshold ΔVth, and the second width of variation threshold (ΔVth−α)) serving as the threshold for determination, and when it is determined that the width of variation in the learning value is smaller than the determination threshold for stable state, the learning value changing speed setting means determines that the convergence state of the learning value has changed from one of the three states to the other one of the three states such that the changing speed of the learning value is lowered from the first changing speed to the second changing speed (i.e., from the status0 to status1), or from the second changing speed to the third changing speed (i.e., from the status1 to status2) (step 1910, and step 1925 in FIG. 19).

The learning value changing speed setting means is configured in such a manner that it determines whether or not the width of variation (the width of variation ΔVafsfbg) in (of) the learning value in the predetermined state determination period (the second parameter relating to the learning value) is larger than the predetermined determination threshold for unstable state (third width of variation threshold (ΔVth+α), and the fourth width of variation threshold (α Vth−α+β)) serving as the threshold for determination, and when it is determined that the width of variation in the learning value is larger than the determination threshold for unstable state, the learning value changing speed setting means determines that the convergence state of the learning value has changed from one of the three states to the other one of the three states such that the changing speed of the learning value is increased (changed) from the third changing speed to the second changing speed (i.e., from the status2 to status1), or from the second changing speed to the first changing speed (i.e., from the status1 to status0) (step 1930, and step 1935 in FIG. 19).

The monitoring control means is configured in such a manner that it prohibits to perform (execute) the abnormality determination by the monitoring means, in a case where it is determined that the convergence state of the learning value is the unstable state (status0), or in a case where a state in which it is determined that the convergence state of the learning value is the stable state (status2) has changed into a state in which the it is determined that the convergence state of the learning value is the quasi-stable state (status1) (step 2105 in FIG. 21, the condition (D2), and the condition (D3)).

The learning value changing speed setting means is configured in such a manner that:

it stores, while the engine is operated, the last (newest) determination result as to which one of the three states (status0, satus1, and status2) is the convergence state of the learning value, and a last (newest) value of the learning value, into memory means (the backup RAM) which can retain data while the engine is stopped; and sets the changing speed of the learning value based on the determination result stored in the memory means when the engine is started (step 1405 and step 1410 in FIG. 14, and step 1330 and step 1350 in FIG. 13), and calculates the sub feedback amount Vafsfb based on the last value of the learning value stored in the memory means (step 1240 in FIG. 12).

The learning value changing speed setting means is configured in such a manner that when the data in the memory means is eliminated (lost), it sets the convergence state of the learning value to (at) the unstable state (step 1330 in FIG. 13), and sets the learning value to (at) a predetermined initial value (step 1345 in FIG. 13).

The monitoring means is configured in such a manner that it obtains the first parameter for abnormality determination based only on the learning value during a period in which the monitoring control means allows to perform (excecute) the abnormality determination (step 2110 in FIG. 14, etc,).

The monitoring control means is configured in such a manner that it obtains the number of update (renewal) of the learning value after the start of the engine (the routine in FIG. 20); and prohibits to perform the abnormality determination by the monitoring means during the period in which (while) the obtained number of update of the learning value is smaller than the predetermined number of learning update threshold (step 2105 in FIG. 21, and the condition (D1)).

The fuel injection control means is configured so as to include a main feedback amount calculating means for calculating the main feedback amount to have the air-fuel ratio represented by the output value of the upstream air-fuel ratio sensor coincide with the stoichiometric air-fuel ratio; and so as to control the amount of fuel injected from the fuel injector based on the main feedback amount and the sub feedback amount (the routine in FIG. 11).

The monitoring means is configured so as to calculate the temporal average of the learning value (the sub FB learning value average Avefsfbg) in a period in which the monitoring control means allows to perform the abnormality determination (step 2140 in FIG. 21), obtain the temporal average as the first parameter for abnormality determination, and determine that the air-fuel ratio imbalance among cylinder is occurring when the obtained first parameter is equal to or larger than the threshold for abnormality determination (Ath) (step 2145 to step 2150 in FIG. 21).

It should be noted that various modifications may be adopted without departing from the scope of the invention. For example, the modification may determine that an abnormality state in which a misfiring rate becomes equal to or larger than an tolerable rate is occurring, when the sub FB learning value Vafsfbg (e.g., temporal integrated value SDVoxs) is equal to or smaller than a predetermined value (i.e., based on whether or not an absolute value of the sub FB learning value Vafsfbg (which is negative) is equal to or larger than the predetermined value).

The reason why such a determination can be made is as follows. That is, when the misfire is occurring, a mixture including a fuel and an air is discharged from the cylinder flows into the catalytic converter through the upstream air-fuel ratio sensor. Most of the mixture flowed into the catalytic converter is burnt in the catalytic converter, and flows out as the burnt gas. Accordingly, when the misfire is occurring, the mixture itself reaches the upstream air-fuel ratio sensor, whereas the burnt gas of the mixture reaches the downstream air-fuel ratio sensor.

Generally, when a mixture whose air-fuel ratio is the stoichiometric air-fuel ratio (or in the vicinity of the stoichiometric air-fuel ratio) contacts with the detecting section of an air-fuel ratio sensor, the air-fuel ratio sensor outputs a value corresponding to a ratio leaner than the stoichiometric air-fuel ratio. This is because, it is inferred that a sensitivity of the air-fuel ratio sensor for Oxygen in the mixture is higher than a sensitivity of the air-fuel ratio sensor for the other components in the mixture.

Therefore, every time the misfire occurs, the air-fuel ratio of the mixture supplied to the engine is feedback controlled so as to be an air-fuel ratio richer than the stoichiometric air-fuel, since the air-fuel ratio sensor outputs the value corresponding to the ratio leaner than the stoichiometric air-fuel ratio (even when the air-fuel ratio of the mixture is the stoichiometric air-fuel ratio). The downstream air-fuel ratio sensor outputs the value corresponding to the air-fuel ratio richer than the stoichiometric air-fuel ratio to compensate for an average deviation of the air-fuel ratio toward a rich side, and thus, the integral term of the sub feedback amount Vafsfb comes closer to a convergent value which is shifted to a lean side. Accordingly, it is possible to determine that the misfiring rate becomes equal to or larger than the tolerable rate based on the sub feedback amount Vafsfb.

Further, in the monitoring apparatus, the sub FB learning value average Avefsfbg is obtained as the imbalance determining parameter, however, "the sub FB learning value Vafsfbg itself" when the abnormality determination allowing condition is satisfied can be obtained as the imbalance determining parameter.

Further, the monitoring apparatus (the air-fuel ratio control apparatus) may be configured, as described in Japanese Patent Application Laid-Open (kokai) No. 2007-77869, Japanese Patent Application Laid-Open (kokai) No. 2007-146661, and Japanese Patent Application Laid-Open (kokai) No. 2007-162565, in such a manner that it calculates a main feedback amount KFmain by performing a high-pass-filtering on a difference between the upstream air-fuel ratio abyfs obtained based on the output value of the upstream air-fuel ratio sensor 55 and the target upstream-side air-fuel ratio abyfr, and obtains a sub feedback amount Fisub by performing a Proportional-Integral control on a value obtained by performing a low-pass-filtering on an error between the output value Voxs of the downstream air-fuel ratio sensor 56 and the target downstream-side air-fuel ratio Voxsref. In this case, as described by a formula (11) below, these feedback amounts are used to correct the base fuel injection amount Fbase in a form of independency, to thereby obtains the final fuel injection amount Fi.

$$Fi=KF\text{main}\cdot F\text{base}+Fi\text{sub} \quad (11)$$

Further, the monitoring apparatus may be configured so as to update the sub FB learning value Vafsfbg according to formulas (12) and (13) described below. Vafsfbg(k+1) in the left-hand side of the formulas (12) and (13) represents an the sub FB learning value Vafsfbg after update. The Value p is a value equal to or larger than 0, and smaller than 1.

$$Vafsfbg(K+1)=p\cdot Vafsfbg+(1-p)\cdot ki\cdot SDVoxs \quad (12)$$

$$Vafsfbg(K+1)=p\cdot Vafsfbg+(1-p)\cdot Vafsfb \quad (13)$$

In this case, a changing speed of the learning value Vafsfbg becomes higher, as the value p becomes smaller. Therefore, the changing speed of the learning value Vafsfbg can be set at the first, second, and third changing speed, by setting the value p to (at) p1 when the status is 0 (status0), setting the value p to (at) p2 larger than the value p1 when the status is 1 (status1), and setting the value p to (at) p3 larger than the value p2 when the status is 2 (status2).

The invention claimed is:

1. A monitoring apparatus for an internal combustion engine, applied to a multi-cylinder internal combustion engine having a plurality of cylinders comprising:

a fuel injector for injecting fuel;

a catalytic converter disposed in an exhaust passage of said engine and at a position downstream of an exhaust gas aggregated portion into which exhaust gases discharged from combustion chambers of a plurality of said cylinders of said engine merge;

an upstream air-fuel ratio sensor, disposed in said exhaust passage and at said exhaust gas aggregated portion or between said exhaust gas aggregated portion and said catalytic converter, and outputting an output value corresponding to an air-fuel ratio of a gas flowing at a position at which said upstream air-fuel sensor is disposed;

a downstream air-fuel ratio sensor, disposed in said exhaust passage at a position downstream of said catalytic converter, and outputting an output value corresponding to an air-fuel ratio of a gas flowing at said position at which said downstream air-fuel sensor is disposed;

sub feedback amount calculation means for calculating a sub feedback amount to make an air-fuel ratio represented by said output value of said downstream air-fuel ratio sensor coincide with a stoichiometric air-fuel ratio, every time a predetermined first update timing arrives;

fuel injection control means for controlling an injection amount of fuel injected from said fuel injector every time a predetermined second update timing arrives based on at least said output value of said upstream air-fuel ratio sensor and said sub feedback amount in such a manner that an air-fuel ratio of an air-fuel mixture supplied to said engine coincides with the stoichiometric air-fuel ratio;

learning means for changing a learning value of said sub feedback amount every time a predetermined third update timing arrives in such a manner that said learning value of said sub feedback amount comes closer to an amount corresponding to a steady-state component of said sub feedback amount;

monitoring means for performing an abnormality determination as to whether or not an abnormality state of said engine is occurring based on a first parameter for abnormality determination which varies in accordance with said learning value;

learning value changing speed setting means for setting a changing speed of said learning value at any one of a first changing speed, a second changing speed smaller than said first changing speed, and a third changing speed smaller than said second changing speed; and monitoring control means for allowing or prohibiting said monitoring means to perform said abnormality determination based on said set changing speed of said learning value.

2. The monitoring apparatus according to claim 1, wherein, said learning value changing speed setting means is configured so as to:

determine, based on a second parameter relating to said learning value, which one of three states is a convergence state of said learning value with respect to said convergent value of said learning value, said states; including:

(a) a stable state in which said learning value is in the vicinity of a convergent value of said learning value, and is stable;

(b) an unstable state in which said learning value greatly deviates from said convergent value, and varies at a high speed; and (c) a quasi-stable state which is between said stable state and said unstable state;

set said changing speed of said learning value at said first changing speed when said convergence state of said learning value is determined to be said unstable state;

set said changing speed of said learning value at said second changing speed when said convergence state of said learning value is determined to be said quasi-stable state; and set said changing speed of said learning value at said third changing speed when said convergence state of said learning value is determined to be said stable state.

3. The monitoring apparatus according to claim 2, wherein, said monitoring control means is configured so as to allow said monitoring means to perform said abnormality determination, in a case where said convergence state of said learning value is determined to be said stable state, or in a case where a time period in which said convergence state of said learning value is determined to be said quasi-stable state becomes equal to or longer than a predetermined first threshold period.

4. The monitoring apparatus according to claim 2, wherein, said learning value changing speed setting means is configured in such a manner that it obtains, every time a predetermined state determination period elapses, a width of variation in said learning value in said predetermined state determination period as said second parameter relating to said learning value, and it determines which one of said three states is said convergence state of said learning value based on a comparison between said obtained width of variation in said learning value and a predetermined threshold for determination; and said monitoring control means is configured so as to allow said monitoring means to perform said abnormality determination, when it is determined that said convergence state of said learning value is said stable state, or when it is determined twice consecutively that said convergence state of said learning value is said quasi-stable state.

5. The monitoring apparatus according to claim 4, wherein, said learning value changing speed setting means is configured so as to determine whether or not said width of variation in said learning value in said predetermined state determination period is smaller than a predetermined determination threshold for stable state serving as said threshold for determination, and so as to determine that said convergence state of said learning value has changed from one of said three states to the other one of said three states such that said changing speed of said learning value is lowered from said first changing speed to said second changing speed or from said second changing speed to said third changing speed, when it is determined that said width of variation in said learning value is smaller than said determination threshold for stable state.

6. The monitoring apparatus according to claim 4, wherein, said learning value changing speed setting means is configured so as to determine whether or not said width of variation in said learning value in said predetermined state determination period is larger than a predetermined determination threshold for unstable state serving as said threshold for determination, and so as to determine that said convergence state of said learning value has changed from one of said three states to the other one of said three states such that said changing speed of said learning value is increased from said third changing speed to said second changing speed or from said second changing speed to said first changing speed, when it is determined that said width of variation in said learning value in said predetermined state determination period is larger than said predetermined determination threshold for unstable state.

7. The monitoring apparatus according to claim 2, wherein, said monitoring control means is configured so as to prohibit said monitoring means to perform said abnormality determination, in a case where said convergence state of said learning value is determined to be said unstable state, or in a case where a state in which said convergence state of said learning value is determined to be said stable state has changed into a state in which said convergence state of said learning value is determined to be said quasi-stable state.

8. The monitoring apparatus according to claim 2, wherein, said learning value changing speed setting means is configured in such a manner that it obtains, every time a predetermined state determination period elapses, a width of variation in said learning value in said predetermined state determination period as said second parameter relating to said learning value, and it determines which one of said three states is said convergence state of said learning value based on a comparison between said width of variation in said learning value and a predetermined threshold for determination; and said monitoring control means is configured in such a manner that it prohibits said monitoring means to perform said abnormality determination, in a case where said convergence state of said learning value is determined to be said unstable state, or in a case where a state in which said convergence state of said learning value is determined to be said stable state has changed into a state in which said convergence state of said learning value is determined to be said quasi-stable state.

9. The monitoring apparatus according to claim 8, wherein, said learning value changing speed setting means is configured so as to determine whether or not said width of variation in said learning value in said predetermined state determination period is smaller than a predetermined determination threshold for stable state serving as said threshold for determination, and so as to determine that said convergence state of said learning value has changed from one of said three states to the other one of said three states such that said changing speed of said learning value is decreased from said first changing speed to said second changing speed or from said second changing speed to said third changing speed, when it is determined that said width of variation in said learning value in said predetermined state determination period is smaller than said predetermined determination threshold for stable state.

10. The monitoring apparatus according to claim 8, wherein, said learning value changing speed setting means is configured so as to determine whether or not said width of variation in said learning value in said predetermined state determination period is larger than a predetermined determination threshold for unstable state serving as said threshold for determination, and so as to determine that said convergence state of said learning value has changed from one of said three states to the other one of said three states such that said changing speed of said learning value is increased from said third changing speed to said second changing speed or from said second changing speed to said first changing speed, when it is determined that said width of variation in said learning value in said predetermined state determination period is larger than said predetermined determination threshold for unstable state.

11. The monitoring apparatus according to claim 2, wherein, said learning value changing speed setting means is configured in such a manner that:

it stores, when said engine is operated, a last determination result as to which one of said three states is said convergence state of said learning value and a last value of said learning value into memory means which can retain data while said engine is stopped; and it sets, when said engine is started, said changing speed of said learning value based on said determination result stored in said memory means, and calculates said sub feedback amount based on said last value of said learning value stored in said memory means.

12. The monitoring apparatus according to claim 11, wherein, said learning value changing speed setting means is configured in such a manner that when said data in said memory means is lost, it sets said convergence state of said learning value at said unstable state, and sets said learning value at a predetermined initial value.

13. The monitoring apparatus according to claim 1, wherein, said monitoring means is configured so as to obtain said first parameter for abnormality determination based only on said learning value during a period in which said monitoring control means allows to perform said abnormality determination.

14. The monitoring apparatus according to claim 1, wherein, said monitoring means is configured so as to obtain the number of updates of said learning value after a start of said engine; and so as to prohibit said monitoring means to perform said abnormality determination during a period in which said obtained number of updates of said learning value is smaller than a predetermined number of learning updates threshold.

15. The monitoring apparatus according to claim 1, wherein, said fuel injection control means is configured so as to include main feedback amount calculation means for calculating a main feedback amount to have an air-fuel ratio represented by said output value of said upstream air-fuel ratio sensor coincide with said stoichiometric air-fuel ratio, and so as to control an amount of fuel injected from said injector based on said main feedback amount and said sub feedback amount; and said monitoring means is configured so as to calculate and obtain a temporal average of said learning value in a period in which said monitoring control means allows to perform said abnormality determination, as said first parameter for abnormality determination, and so as to determine that an air-fuel ratio imbalance among cylinders is occurring when said obtained first parameter is equal to or larger than a threshold for abnormality determination.

* * * * *